US008393104B1

(12) United States Patent
Moody et al.

(10) Patent No.: US 8,393,104 B1
(45) Date of Patent: Mar. 12, 2013

(54) FOLDING STACK IMPROVEMENTS

(75) Inventors: Joseph R. Moody, Jacksonville, FL (US); Joseph D. Gaddini, Cape Coral, FL (US); Mark Best, Merritt Island, FL (US)

(73) Assignee: Grip Pod Systems International, LLC, Cape Coral, FL (US)

( * ) Notice: Subject to any disclaimer, the term of this patent is extended or adjusted under 35 U.S.C. 154(b) by 103 days.

(21) Appl. No.: 12/986,374

(22) Filed: Jan. 7, 2011

Related U.S. Application Data

(60) Division of application No. 12/856,340, filed on Aug. 13, 2010, now Pat. No. 7,987,623, which is a continuation-in-part of application No. 12/700,887, (Continued)

(51) Int. Cl.
*F41C 23/00* (2006.01)

(52) U.S. Cl. ..... 42/72; 42/94; 42/71.01; 89/1.42; 89/37.04

(58) Field of Classification Search ..... 42/72, 94, 42/71.01; 89/1.42, 37.04
See application file for complete search history.

(56) References Cited

U.S. PATENT DOCUMENTS

| | | | |
|---|---|---|---|
| 271,251 | A | 1/1883 | Leerbech |
| 575,529 | A | 1/1897 | Stephens |
| 583,656 | A | 6/1897 | McGrady |

(Continued)

FOREIGN PATENT DOCUMENTS

| | | |
|---|---|---|
| WO | 2005019762 | 3/2005 |

OTHER PUBLICATIONS

Gun Accessories (by weapon), [online] MSP Mounting Solutions Plus, mountsplus.com, GRIP POD GPA 1-BLACK/PLYMER The Grip Pod System (GPA), 6 pages, retrieved on Sep. 19, 2008, retrieved from: http://www.mountsplus.com/thestore/65_other.html.

Guns America—Rock Creek Barrels Sopmod Raptor Bipod—Gun Parts Ri . . . , [online] Classified Ad, Rock Creek Barrels Sopmod Raptor Bipod, 2 pages, retrieved on Mar. 19, 2008, retrieved from: http://www.gunsamerica.com/97689284/Non-Guns/Gun-Parts_Rifle-Accuracy-Sniper/RO . . . .

(Continued)

*Primary Examiner* — Michelle Clement
(74) *Attorney, Agent, or Firm* — Brian S. Steinberger; Law Offices of Brian S. Steinberger, P.A.

(57) ABSTRACT

Adapter devices, apparatus, systems and methods of allowing a firearm to be supported by a foldable fore grip/gun handle. The fore grip gun handle can have bipod type legs that can be extendable from the handle. The fore grip handle can be just a vertical extension. The adapter can allow for the fore grip/gun handle to move from a fold back position along the bottom of the firearm so that the firearm can be easily carried, and the adapter to can allow for the handle to move down to a vertical support position beneath the firearm when the firearm is to be used. The adapter can also support a light in both a folded position and in a downwardly extended position, where light can be aimed forward, rearward to the side and/or pointed down from the firearm. The adapter can allow for a dual functioning component that can be either or both a fore grip and/or a light source. Other versions of the adapter can include a slidable thumb switch for locking a swinging plate with picatinny side rails to a main plate, and spring loaded detents for locking the swinging plate in substantially vertical orientations. Additionally, a folding rail system can be substituted for the existing picatinny rail system on firearms. The folding rail can have mounting holes for allowing the entire folding rail to be directly attached to the firearm, and have a hinge for allowing portions of the picatinny rails to pivot relative to the rest of the picatinny rails.

20 Claims, 42 Drawing Sheets

Related U.S. Application Data filed on Feb. 5, 2010, now Pat. No. 8,028,457, which is a division of application No. 11/934,392, filed on Nov. 2, 2007, now Pat. No. 7,861,451, application No. 12/986,374, which is a continuation-in-part of application No. 11/652,337, filed on Jan. 11, 2007, now Pat. No. 7,568,304, which is a continuation-in-part of application No. 11/485,762, filed on Jul. 13, 2006, now Pat. No. 7,490,429, which is a continuation-in-part of application No. 10/725,082, filed on Dec. 2, 2003, now Pat. No. 7,111,424, and a continuation-in-part of application No. 29/259,347, filed on May 5, 2006, now Pat. No. Des. 566,219.

(60) Provisional application No. 60/905,556, filed on Mar. 7, 2007.

(56) References Cited

U.S. PATENT DOCUMENTS

| | | | | |
|---|---|---|---|---|
| 713,114 | A | 11/1902 | Force | |
| 721,425 | A | 2/1903 | Clyde | |
| 1,295,688 | A | 2/1919 | Butler | |
| 1,355,660 | A | 10/1920 | Farquhar | |
| 1,382,409 | A | 6/1921 | Butler | |
| 1,580,406 | A | 4/1926 | Browning | |
| 2,386,802 | A | 10/1945 | Johnson | |
| 2,420,267 | A | 5/1947 | Sefried | |
| 2,436,349 | A | 2/1948 | Adams | |
| 2,472,804 | A | 6/1948 | Bird | |
| 2,489,283 | A | 11/1949 | Garand | |
| 2,763,456 | A | 9/1956 | Breer | |
| 2,807,904 | A | 10/1957 | Kreske | |
| 2,898,137 | A | 8/1959 | Kreske | |
| 2,991,579 | A | 7/1961 | Lies | |
| 3,235,997 | A | 2/1966 | Stoner | |
| D222,118 | S | 9/1971 | Nakatani | |
| 3,632,073 | A | 1/1972 | Nakatani | |
| 4,121,799 | A | 10/1978 | Michio | |
| 4,545,660 | A | 10/1985 | Rudolf | |
| 4,776,124 | A | 10/1988 | Clifton | |
| 4,807,837 | A | 2/1989 | Gawlik | |
| D304,062 | S | 10/1989 | Barrett | |
| 5,029,407 | A | 7/1991 | Kirkpatrick | |
| 5,074,188 | A | 12/1991 | Harris | |
| 5,081,478 | A | 1/1992 | Hayashida | |
| 5,194,678 | A | 3/1993 | Kramer | |
| D346,636 | S | 5/1994 | Bechtel | |
| 5,345,706 | A | 9/1994 | Brown | |
| 5,384,609 | A | 1/1995 | Ogawa | |
| D356,137 | S | 3/1995 | Hull | |
| 5,438,786 | A | 8/1995 | Hilderbrand | |
| 5,711,103 | A | 1/1998 | Keng | |
| D390,301 | S | 2/1998 | Peterson | |
| 5,815,974 | A | 10/1998 | Keng | |
| 6,289,622 | B1 | 9/2001 | Desch | |
| 6,385,892 | B1 | 5/2002 | Vendetti | |
| 6,487,807 | B1 | 12/2002 | Kopman | |
| 6,539,660 | B1 | 4/2003 | Yeargin | |
| 6,622,416 | B2 | 9/2003 | Kim | |
| 6,655,069 | B2 | 12/2003 | Kim | |
| 6,785,997 | B2 | 9/2004 | Oz | |
| 6,827,319 | B2 | 12/2004 | Mayr | |
| 6,843,015 | B2 | 1/2005 | Sharp | |
| 6,920,713 | B1 | 7/2005 | Love | |
| 7,111,424 | B1 | 9/2006 | Moody | |
| 7,121,034 | B2 | 10/2006 | Keng | |
| 7,143,986 | B1 | 12/2006 | Austin | |
| 7,191,557 | B2 * | 3/2007 | Gablowski et al. | 42/72 |
| 7,222,451 | B2 | 5/2007 | Keng | |
| 7,243,454 | B1 * | 7/2007 | Cahill | 42/72 |
| 7,290,740 | B2 | 11/2007 | Joy et al. | |
| 7,430,828 | B2 * | 10/2008 | Munst | 42/72 |
| 7,464,495 | B2 * | 12/2008 | Cahill | 42/72 |
| 7,520,083 | B2 * | 4/2009 | Dextraze | 42/126 |
| D591,882 | S | 5/2009 | Chen | |
| 7,559,167 | B1 | 7/2009 | Moody et al. | |
| 7,614,174 | B1 | 11/2009 | Beltz | |
| 7,676,977 | B1 * | 3/2010 | Cahill et al. | 42/94 |
| 7,793,454 | B1 * | 9/2010 | Beltz | 42/94 |
| 7,797,875 | B1 * | 9/2010 | Carrier et al. | 42/124 |
| 7,891,126 | B2 * | 2/2011 | Moody et al. | 42/72 |
| 8,156,678 | B2 * | 4/2012 | Hoel et al. | 42/90 |
| 2003/0192223 | A1 | 10/2003 | Sharp | |
| 2004/0000083 | A1 | 1/2004 | Grant | |
| 2004/0060222 | A1 | 4/2004 | Oz | |
| 2005/0188588 | A1 | 9/2005 | Keng | |
| 2005/0188597 | A1 | 9/2005 | Keng | |
| 2005/0204603 | A1 | 9/2005 | Larsson | |
| 2005/0217161 | A1 | 10/2005 | Haugen | |
| 2005/0241206 | A1 | 11/2005 | Teetzel | |
| 2005/0242250 | A1 | 11/2005 | Keng | |
| 2006/0010748 | A1 * | 1/2006 | Stoner et al. | 42/71.01 |
| 2006/0156609 | A1 * | 7/2006 | Kim | 42/124 |
| 2006/0191183 | A1 | 8/2006 | Griffin | |
| 2006/0277809 | A1 | 12/2006 | Moody | |
| 2007/0079541 | A1 | 4/2007 | Peterson | |
| 2007/0163163 | A1 | 7/2007 | Munst | |
| 2007/0180752 | A1 | 8/2007 | Houde-Walter | |
| 2007/0271832 | A1 | 11/2007 | Griffin | |
| 2007/0271834 | A1 * | 11/2007 | Keng | 42/124 |
| 2008/0052979 | A1 | 3/2008 | Lee | |
| 2009/0044439 | A1 | 2/2009 | Phillips | |
| 2009/0056192 | A1 * | 3/2009 | Oz | 42/94 |
| 2009/0126250 | A1 | 5/2009 | Keng | |
| 2009/0133309 | A1 * | 5/2009 | Cahill | 42/72 |
| 2009/0193702 | A1 | 8/2009 | Lin | |
| 2010/0107467 | A1 * | 5/2010 | Samson et al. | 42/127 |
| 2011/0047850 | A1 * | 3/2011 | Rievley et al. | 42/72 |
| 2011/0047851 | A1 * | 3/2011 | Mock et al. | 42/72 |
| 2011/0099873 | A1 * | 5/2011 | Bentley | 42/71.01 |

OTHER PUBLICATIONS

Ghillie Suit Rail Intervace System, [online] Ghillie Suits—ar—15 Rifle . . . , Pistol Grips, Handgun Grips and Revolver and Gun Grips Archive, Rifle Bipods, blog written Mar. 11, 2008, 2 pages, retrieved on Mar. 19, 2008, retrieved from: http://ghillierailintervacesystem.blogspot.com/.

Versa-Pod New Short Prone Bipod w/ Spring-Activated Legs, [online] The Shooters Box.com, 2p ages, retrieved on Mar. 19, 2008, retrieved from: http://www.theshootersbox.com/store/index.php?main_page=product_info&products_id=9.

Current "AR Deals" . . . , [online] Questar International, AR Deal Items, updated Mar. 2, 2008, 2 pages, retrieved on Mar. 19, 2008, retrieved from: http://www.questar.ca/deals/ar_deals.htm.

Versa-Pod Bipods, [online] GunAccessories.com, Vers-Pod Bipods, Prone Position Bipods, 4 pages, retrieved on Mar. 19, 2008, retrieved from: http://www.gunaccessories.com/VersaPod/default.asp.

Israel Defense Forces Rifle Accessories and Improvements, [online] Israel Defense Forces Rifle Accessories and Improvements made by Warriors for Warriors, Canted Ergonomic Fore Grip, Pistol Grip, Folding Pistol Grip, T-Pod Tactical Grip, and Bipod, 6 pages, retrieved on Mar. 19, 2008, retrieved from: http:///www.zahal.org/rifle/.

Firearm Accessories, Gemtech for the 21st Century, [online] Custom Accessories, Available, Vertical Foregrip Replacement Center Core, 2 pages, retrieved on Mar. 19, 2008, retrieved from: http://srtestore.com/FirearmAccess.pdf.

FAB Defense, Operational Accessories Planning and Performance, [online] Canted Ergonomic Foregrip, BENEFITS, www.fab-defense.com, retrieved on Mar. 19, 2008, retrieved from: http:www.fab-defense.com/fab_Catalog.pdf—similar pages.

Battenfeld Technologies, Inc., [online] 2005 catalog, Caldwell Shooting Supplies, Muley-pod, Caldwell Bipods, 3 pages, retrieved on Mar. 19, 2008, retrieved from: http://www.battenfeld-technologies.com/battenfeldcatalog05.pdf-similar pages.

Brugger & Thomet Unipod, Forward Grip with Retractable Bipod, [online] DSA, Inc. Systems Second to None, DSA Order Center, 1 page, retrieved on Oct. 17, 2008, retrieved from: http:www.dsarms.com/item-detail.cfm?ID=BT21830A&storeid=1&image-bt21830A.gif.

Denis, H.R., Archer, M.A., "Jane's Infantry Weapons" 1976, pp. 1-3.

* cited by examiner 1935
1810
1930
1800

1930
1940

1810
1930
1940

1930
1940

1932
1933
1815
1810
1942
1930
1938
1937
1940
1945
1812

FOLDING STACK IMPROVEMENTS

This invention is a divisional application of U.S. patent application Ser. No. 12/856,340 filed Aug. 13, 2010, now U.S. Pat. No. 7,987,623, which is a continuation-in-part of U.S. patent application Ser. No. 12/700,887 filed Feb. 5, 2010, now U.S. Pat. No. 8,028,457, which is a divisional of U.S. patent application Ser. No. 11/934,392 filed Nov. 2, 2007, now U.S. Pat. No. 7,861,451; which claims the benefit of priority to U.S. Provisional Patent Application. Ser. No. 60/905,556 filed Mar. 7, 2007, and this invention is a continuation in part of U.S. patent application Ser. No. 11/652,337 filed Jan. 11, 20007 now U.S. Pat. No. 7,568,304, which is a continuation in part of U.S. patent application Ser. No. 11/485,762 filed Jul. 13, 2006 now U.S. Pat. No. 7,490,429, which is a continuation in part of U.S. patent application Ser. No. 10/725,082 filed Dec. 2, 2003, now U.S. Pat. No. 7,111,424, and U.S. Design patent application ser. No. 29/259,347 filed May 5, 2006 now U.S. Pat. D566,219.

FIELD OF THE INVENTION

The present invention relates to guns and firearms and more particularly to devices, apparatus, systems and methods of using a foldable accessory adapters or folding rail assemblies for allowing a firearm to be supported by various devices such as but not limited to fore grip/gun handle that can have bipod type legs or only a vertical extension, and or other accessories such as a light or a combination fore grip and light to be foldable underneath the firearm.

BACKGROUND AND PRIOR ART

For many years, there has been considerable amount of prior art for fore grips and bipod devices, that date back to pre-20$^{th}$ century times, with bipods having a familiar appearance, structure and configuration, where the fore grips and bipods are generally kept in a vertical orientation beneath the firearm.

For example, some known prior art includes but is not limited to U.S. Pat. Nos. 271,251; 1,295,688; 1,355,660; 1,382,409; 1,580,406; 2,386,802; 2,420,267; 2,436,349, and 3,235,997. These patents disclose the respective art in relation to bipods, but do not disclose a fore grip or gun handle with a concealable and collapsible bipod. U.S. Pat. No. 6,487,807 describes a tripod gun handle that provides a combination pistol grip and pivotal tripod. An examination of this patent reveals a number of problems with this device, and the most obvious problem is that the tripod legs are positioned on the exterior of the handle when not deployed. If the gun with this device attached was being used in wet or muddy environments, either in a deployed or storage position, the ingress of mud and dirt into and around the handle could result in the deployment and storage of the tripod legs being severely restricted due to the mud or foreign matter. Another problem is that deployment requires the rotation of a disengagement cam to force the legs into their deployed position and then a leg locking assembly is rotated to lock the legs into a locked position. Two separate actions are required to deploy and lock the tripod legs into a locked position.

Another problem with these bipods and leg stands is that the fore grip type stands are generally locked in a fixed position, which means an operator would have to physically move and/or physically raise the stand to adjust the firearm to fire a shot. Such physical movements of having to physically cant, tilt and/or lift the stand would be naturally uncomfortable to the operator. In addition such physical movements can cause the firearm to be held in an unsteady position that makes both a steady and reliable shot at an intended target both difficult and potentially impossible.

Another problem with many firearms having fore grips and bipods is that the fore grips remain in fixed vertical type orientations beneath the firearm at all times. Thus, these firearms can be cumbersome to carry since the fore grip is sticking down which can hit or rub against the sides of the human carrier. Also the fixed vertically oriented fore grips make the firearms difficult to store and transport since the lower extending vertical fore grip takes up valuable space and room during transport.

Attempts over the years have been made to allow for allowing for some folding of portions of firearms. See for example, U.S. Pat. Nos. 4,351,224 to Curtis; 4,625,620 to Harris; 5,074,188 to Harris; 5,085,433 to Parsons; 5,711,103 to Keng; 6,470,617 to Gregory; 6,517,133 to Seegmiller et al.; and 6,763,627 to Kaempe. However, none of these references overcomes all of the problems with the prior art described above.

Thus, the need exists for solutions to the problems addressed above.

The novel invention allows stands such as bipods to be able to fold as desired by the firearm operator.

SUMMARY OF THE INVENTION

A primary objective of the subject invention is to provide devices, apparatus, systems and methods of attaching and using a firearm fore grip/gun handle that can fold up along the firearm when not being used.

A secondary objective of the subject invention is to provide devices, apparatus, systems and methods of a detachable firearm fore grip/gun handle that can fold down to extend vertically below when the firearm is being used.

A third objective of the subject invention is to provide devices, apparatus, systems and methods of using a firearm fore grip/gun handle with extendable bipod legs.

A fourth objective of the subject invention is to provide devices, apparatus, systems and methods of attaching and using a firearm fore grip/gun handle that allows for a light to be attached to the fore grip/gun handle.

A fifth objective of the subject invention is to provide devices, apparatus, systems and methods of incorporating a light into a firearm fore grip/gun handle.

A sixth objective of the subject invention is to provide devices, apparatus, systems and methods of attaching and using a firearm fore grip gun handle with a pivotable light.

A seventh objective of the subject invention is to provide devices, apparatus, systems and methods of attaching and using a firearm fore grip gun handle with a foldable light.

An eighth objective of the subject invention is to provide devices, apparatus, systems and methods of using a folding plate assembly for attaching to existing picatinny rails on a firearm, that can support accessories such as foregrips, lights, and the like.

An ninth objective of the subject invention is to provide devices, apparatus, systems and methods of substituting a folding rail assembly for the existing picatinny rails plate on firearms, where the folding rail plate assembly does not enlarge the existing picatinny rail plate used on firearms.

An tenth objective of the subject invention is to provide devices, apparatus, systems and methods of substituting a folding rail assembly for the existing picatinny rails plate on firearms, that uses less material and is less expensive than a folding plate adapter.

A firearm fore grip adapter having an adapter member, an upper portion on the adapter member for allowing the member to be attachable beneath a firearm, and a lower portion pivotally attached to the adapter member, the lower portion for supporting a fore grip thereon, wherein the fore grip can move between a vertical downward position for supporting the firearm to a folded position with fore grip adjacent to the firearm. The upper portion can be an upper clamp for clamping the adapter member underneath of the firearm.

The upper clamp can include clamp edges for sliding about picatinny rails underneath the firearm. The upper clamp can include compressible clamp edges for clamping about picatinny rails underneath the firearm with a rotatable knob/screw.

The lower portion can include rails for allowing the adapter to attach to detachable fore grip. The adapter can include a pullable button for releasing the pivotable lower portion. The adapter can include a depressible button for releasing the pivotable lower portion. The adapter can include a switch for releasing the pivotable lower portion.

The fore grip can have bipod legs. The fore grip can have a light.

The invention can include an adapter member, an upper portion on the adapter member for allowing the member to be attachable beneath a firearm, and a lower portion pivotally attached to the adapter member, the lower portion for supporting another component thereon, wherein the other component can move between a vertical downward position for to a folded position adjacent to the firearm.

The another component can include a light. The another component can include a vertical fore grip. The another component can include both a vertical fore grip and a light. The another component can include a vertical fore grip with a light integrated inside of the fore grip.

A novel method of attaching a foldable accessory mounting plate to a firearm, can include the steps of providing a firearm having opposite facing picatinny rails underneath the firearm, providing a top plate member with an upper surface having a pair of opposite facing grooves, providing a bottom plate member with opposite facing picatinny rails, hingedly attaching one end of the bottom plate member to the top plate member by the hinge, sliding and mating the opposite facing grooves on the upper surface of the top plate member about the picatinny rails underneath the firearm, providing a vertically extending elongated accessory having an upper surface having a pair of opposite facing grooves, sliding and mating the opposite facing grooves on the upper surface of the elongated accessory about the picatinny rails on the bottom plate member, and folding the vertically extending elongated accessory to a horizontal orientation underneath the firearm by the hinge between the top and the bottom plate member.

The accessory can include a light. The accessory can include vertical fore grip. The method can include the steps of deploying a pair of legs with feet beneath the vertical fore grip and expanding the feet on the legs apart from one another. The vertical fore grip can include a light.

Another embodiment of the invention can have telescoping extendable legs that can be individually extended from beneath the fore grip handle.

The invention can be used with fore grips having concealable and collapsible bipod legs. Alternatively, the accessory mount can be used with other types of fore grips such as basic vertical fore grips, or any stands that can be attached to rails such as picatinny rails beneath firearms.

A firearm fore grip with accessory mount holder, can include an elongated handle having a top end and a bottom end and outer sidewalls between the top end and the bottom end, and an accessory mount having a portion that is attached to a portion of the outer sidewalls of the handle, the accessory mount having rails for allowing an accessory to be removably attached to the rails on the accessory mount.

The accessory mount can be molded to a side portion of the outer sidewalls of the handle.

Another embodiment of the firearm adapter can include an adapter member having an upper side and a lower side, a clamp on the upper side of the adapter member for allowing the member to be clamped to picatinny rails located beneath a firearm, a swing plate pivotally attached to the lower side of the adapter member, the swing plate having picatinny side edges for supporting an accessory thereon, and a sliding switch for allowing the swing plate to be released from a horizontal locked position to be able to rotate to a substantially vertical position.

The sliding switch can include an angled raised surface for allowing a finger of a user to push against, and a spring for biasing the sliding switch to the locked position. The sliding switch can include a set screw for adjusting the biasing extension of the spring.

The adapter can include a catch on a free end of the swinging plate for catching onto a protruding end on the sliding switch, so that the swinging plate is held in the locked position, and a spring loaded latch for locking the swinging plate in the substantially vertical position.

The adapter can include both a first spring for biasing the sliding switch to the locked horizontal position, and a second spring for locking the swinging plate to the substantially vertical position.

The accessory supported by the adapter can be a vertical fore grip, a bipod, or a fore grip with collapsible bipod legs. Additionally, the accessory can include a light or laser source.

A novel method of attaching a foldable accessory mounting plate to a firearm, can include the steps of providing a firearm having opposite facing picatinny rails underneath the firearm, clamping upper sides of a top plate member about the picatinny rails, pivotally attaching one end of a bottom plate member to the top plate member, locking the bottom plate member into a folded horizontal position parallel to the top plate member by a sliding switch being moved in one direction, and releasing the bottom plate member to rotate to a substantially vertical position by moving the sliding switch in an opposite direction.

The method can include the steps of spring biasing the sliding switch toward the one position, and/or locking the bottom plate member to the substantially vertical position by a spring.

A folding rail for firearms can be a folding rail assembly that can be substituted for an existing picatinny rails on a firearm, The folding rail can include a plate shaped member having a first end, a second end, a first longitudinal picatinny rail along one side of the plate shaped member between the first end and the second end, and a second longitudinal picatinny rail along an opposite side of the plate shaped member between the first end and the second end, and a hinge for allowing a portion of both the first longitudinal picatinny rail and the second picatinny rail to pivot relative to the plate shaped member, from a horizontal position to a substantially vertical position, wherein the plate shaped member is attached to an undersurface of a firearm.

The folding rail can include a latch for locking the portion of both the first longitudinal picatinny rail and the second picatinny rail to be in the horizontal position relative to the plate shaped member, and mounting holes in the plate shaped member for allowing fasteners to attach the plate shaped member to the undersurface of the firearm.

The plate shaped member can include a forward end with picatinny rails on both sides, and a rearward end with picatinny rails on both sides, with a middle rail section between the foreward end and the rearward end, the middle end being pivotally attached to one of the foreward end or the rearward end. The pivotal middle rail section includes picatinny rails on both sides of the middle rail section.

Further objects and advantages of this invention will be apparent from the following detailed description of a presently preferred embodiment, which is illustrated in the accompanying flow charts and drawings.

BRIEF DESCRIPTION OF THE FIGURES

Referring particularly to the drawings for the purposes of illustration only, and not limitation.

DESCRIPTION OF THE PREFERRED EMBODIMENT

Figure 1:
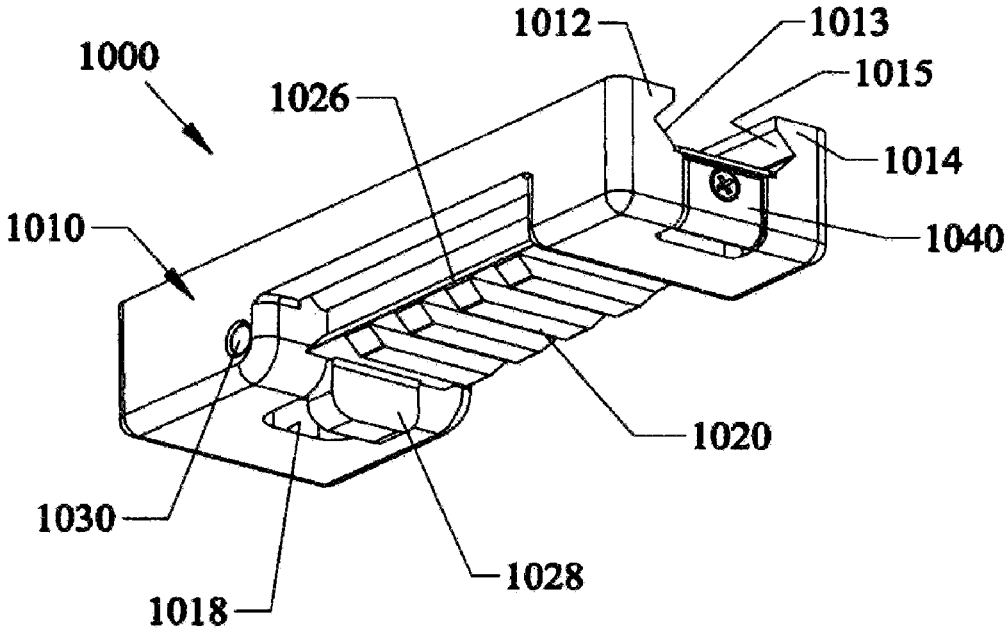
FIG. 1 is a bottom rear right perspective view of a folding stacking unit.

Before explaining the disclosed embodiment of the present invention in detail, it is to be understood that the invention is not limited in its application to the details of the particular arrangement shown since the invention is capable of other embodiments. Also, the terminology used herein is for the purpose of description and not of limitation.

The invention claims the benefit of priority to U.S. Provisional Patent Application Ser. No. 60/905,556 filed Mar. 7, 2007, and this invention is a continuation in part of U.S. patent application Ser. No. 11/485,762 filed Jul. 13, 2006, which is a continuation in part of U.S. patent application Ser. No. 10/725,082 filed Dec. 2, 2003, now U.S. Pat. No. 7,111,424, and U.S. Design patent application Ser. No. 29/259,347 filed May 5, 2006, all by the same inventors and assigned to the same assignee, which are all incorporated by reference.

The inventors of the subject invention have to date patented at least one U.S. Pat. No. 7,111,424 to Gaddini, which is incorporated by reference. This patent includes a replaceable mounting assembly that allows for mounting of the gun handle by various means to a gun. A fore grip or gun handle, designed with ergonomic reasons in mind, provides a stable means of holding the gun. A plurality of legs that are concealed within the fore grip are coupled via a hinge to a spring piston assembly. A spring-loaded fulcrum release mechanism holds the piston assembly in a compressed and locked position.

When the piston assembly is released upon activation of the spring-loaded fulcrum release mechanism, the legs are driven downwards by the piston and upon being released from the confinement of the fore grip are deployed outwards to a locked position by a hinge or pivot mechanism. The legs have feet that are designed so that, when the legs are concealed within the handle, the feet seal off the deployment and spreader mechanisms from entrance of any debris, material etc that may interfere with the deployment of the bipod.

As shown in the figures, the invention can be used with the inventors novel fore grip that has a mounting section or end having parallel rails that can be attached to rails, such as picatinny rails on a firearm such as a rifle, and the like, by adjusting the head piece clamps with rail clamp bolt. The fore grip can include of a machining or a casting that utilizes aluminum or a molding that utilizes high impact resistant polymer or a composite material. The fore grip is a grip for gripping by the hand of a user when the fore grip is attached to the firearm.

Although the mounting end is shown as being an integral part of the handle for illustration purposes only, it should be understood that the mounting end head piece can be a separate component that is then attached by other members, such as threads or a lock screw or locking bolt to the handle. For illustrative purposes, the mounting end head piece uses a picatinny mounting rail (MIL-STD-1913 rail), a mounting system widely used by military for attachment of various devices to military rifles. However, it should be understood that other methods of attachment to a firearm could be used.

As described in the parent patent applications that are incorporated by reference, the fore grip can have a handle portion, with bottom retaining cap have a concealable and collapsible bipod legs. One version can have a tubular recess consisting of a first cylindrical cutout housing the bipod legs when concealed and a sliding piston that deploys the legs and a second cylindrical cutout housing a release mechanism and a void space for other accessories. The release mechanism such as a depressible button has a compression spring positioned between the piston assembly and the bottom of the first cylindrical cutout and the compression spring. The legs are connected to the bottom of the piston assembly via a hinge and spring that when released from confinement within the fore grip, causes the legs to expand outward until deployed.

Another version of the fore grip with bipod uses only one spring, wherein the legs can be gravity and/or snap/shook released from the handle by a switch(such as the depressible button) and the spring expands the legs out to the fully deployed position.

To use the fore grip, a user simply attaches the fore grip to the firearm, regardless of whether or not the bipod legs are deployed. If the legs are deployed, then the user has the option of using the gun with the legs deployed or compressing or squeezing the legs together, and pushing them upwards into the fore grip until the male part of the spring-loaded fulcrum release mechanism catches and locks the bipod legs and the piston assembly into the closed position.

As described above, the invention can be used with the inventors' novel bipod fore grip shown in the figures. A preferred embodiment can have the head piece having a length of approximately 1.85 inches a width of approximately 1.29 inches and a height of approximately 1.15 inches. In a fully leg retracted/closed position, the fore grip can have a height of approximately 6.32 inches. The handle portion 110 can have a length of approximately 2.95 inches and a width of approximately 1.37 inches. The legs can have a width of approximately 0.73 inches along with the feet having a width of approximately 0.99 inches. In a fully deployed/expanded position, the fore grip can have an overall height of approximately 8.57 inches, with the legs 120 having a spread eagle angle therebetween of approximately 76 degrees, and the inside angle of the feet 128 to the rest of the legs being approximately 52 degrees. The feet can be spread apart from toe to toe at approximately 6.95 inches.

Although, the preferred embodiment lists specific dimensions, the invention can be practiced with different sized and shaped components.

The fore grip can be made from various components such as but not limited to polymeric materials, such as but not limited to plastic and/or glass filled nylon with and without metal inserts such as aluminum, galvanized metal, stainless steel, and the like Additionally, the fore grip can include void spaces where possible to decrease weight.

Although a depressible button is shown above, the invention can use other types of activation such as but not limited to toggle switches, pressure actuated switches, temperature actuated switches and the like, to release the inside legs to slide down and expand outward from beneath the housing.

FOLDING STACKING PLATE DESIGNATOR REFERENCE NUMBERS

1000 Folding Stacking Unit
1004 Optional clamp turn screws to attach clamps
1006 Optional side plate for clamp turn screws
1010 Rail Mount Plate/top plate member
1012 leg member
1013 inwardly facing groove
1014 leg member
1015 inwardly facing groove
1018 notch on lower surface of top plate member
1019 pin-hole
1020 Pivot Rail Member/lower-bottom plate member
1022 Upper pivot rail edge
1024 Side Rail
1026 Side Rail
1028 front tab
1029 pin-hole
1030 Pivot Pin
1040 Release Button
1045 fastener(screw, and the like)
1050 Pivot Rail Latch
1052 Ledge edge of Latch
1055 Longitudinal Top Slot
1060 Release Button
1062 Finger Access Slot of Release button
1070 Latch Cover Plate
1074 Downwardly protruding pin
1075 fastener(s)
1075R threaded receiving holes
1080 Picatinny Rail
1090 Vertical Fore Grip
1100 Latch Spring
1110 Latch Catch
1200 Firearm(i.e. rifle, etc.)
1400 Attachable/detachable light accessory/fore grip with light
1450 upper mounting plate with grooves
1455 fastening screw knob
1500 fore grip with built in light
1510 lens
1515 light source
1520 cap
1530 batteries
1550 inside of light fore grip
1590 depressible switch
1700) Adapter assembly with one long clamp.
1710) Adapter body.
1720) Swing plate.
1730) Pivot pin.
1740) Detent plate.
1750) Detent latch.
1760) Picatinny rail.
1770) Grip pod assembly.
1780) Adapter assembly with two short clamps.
1790) Gun.
1800) Folding rail assembly.
1810) Folding assembly swing plate.
1820) Thumb nut.
1830) Thumb slide.
1840) Plate latch.
1850) Long clamp.
1860) Set screw.
1870) Clamp screw.
1880) Short clamp A.
1890) Short clamp B.
1900) Radial stress relief slot.
1910) Slide spring.
1920) Detent spring.
1930) Folding rail body.
1940) Folding rail swing plate latch.

Figure 2:
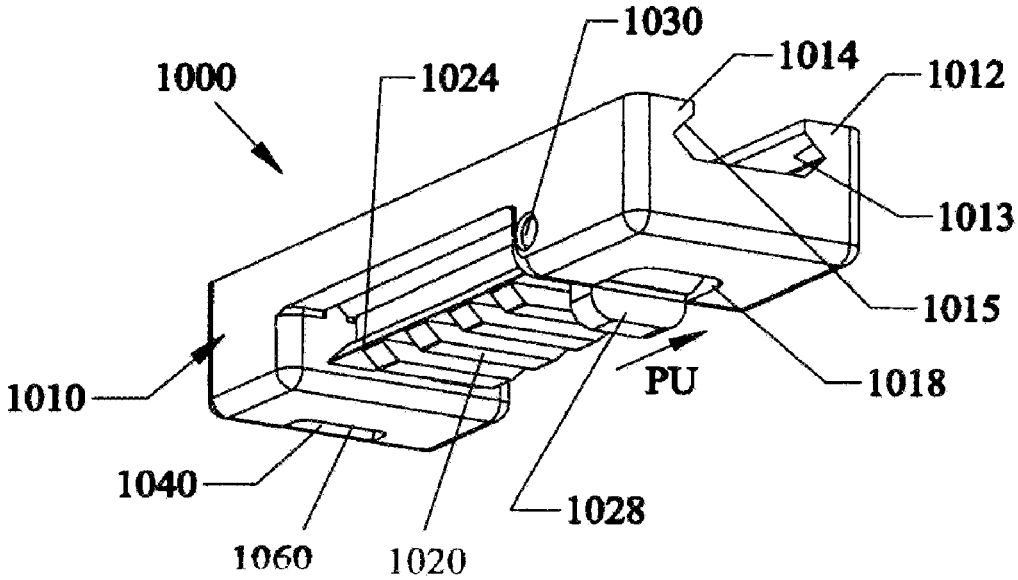
FIG. 2 is a bottom front left perspective view of the stacking unit of FIG. 1.
Figure 3:
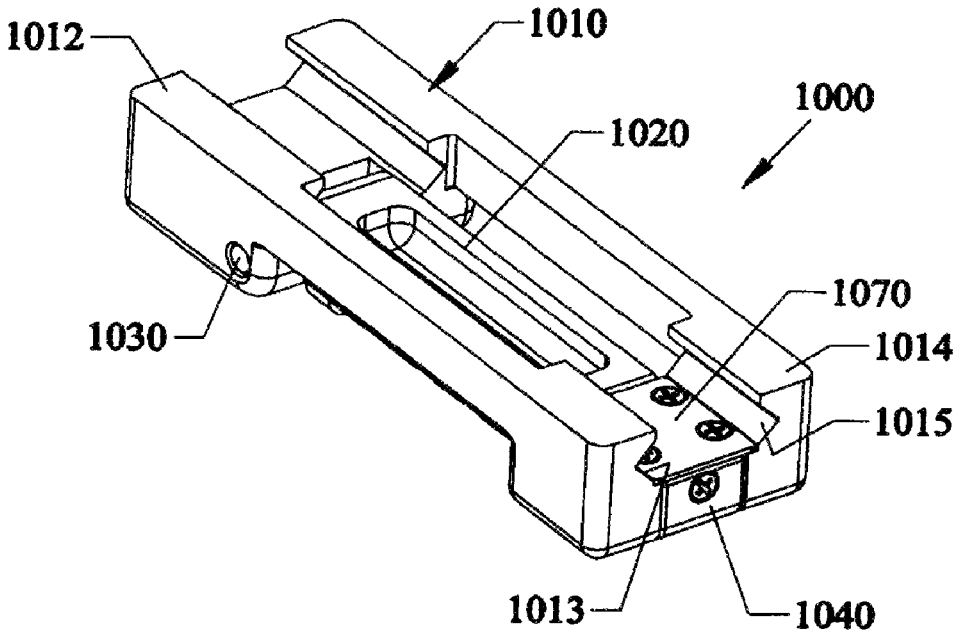
FIG. 3 is a top rear right perspective view of the stacking unit of FIG. 1.
Figure 4:
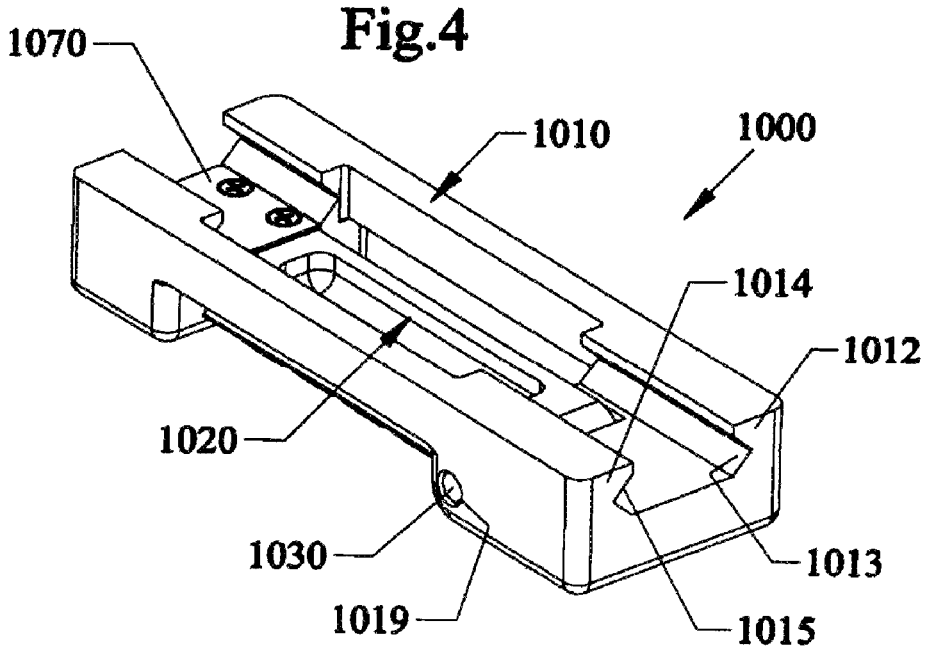
FIG. 4 is top front left perspective view of the stacking unit of FIG. 1.
Figure 8:
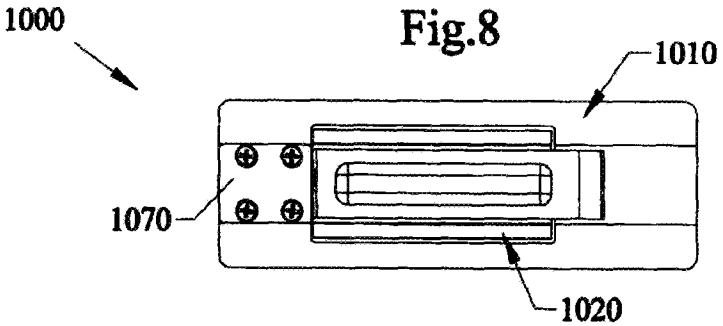
FIG. 8 is a top view of the stacking unit of FIG. 1.
Figure 6:
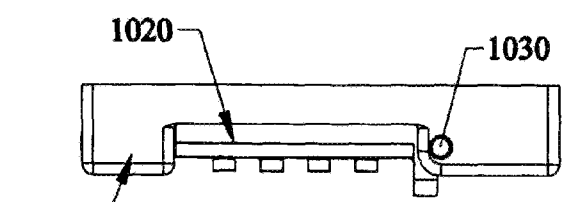
FIG. 6 is a left side view of the stacking unit of FIG. 1.
Figure 9:
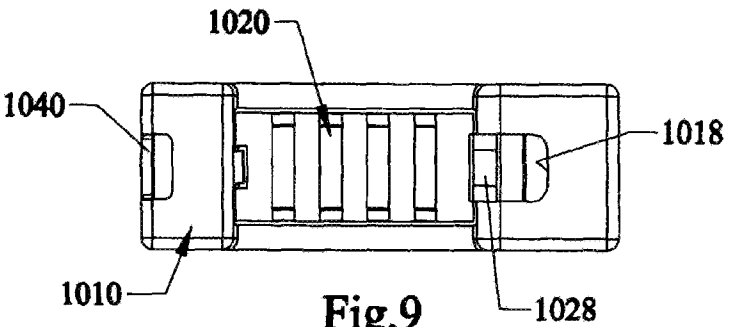
FIG. 9 is a bottom view of the stacking unit of FIG. 1.
Figure 5:
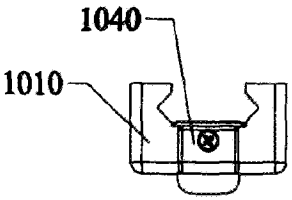
FIG. 5 is a rear end view of the stacking unit of FIG. 1.
Figure 7:
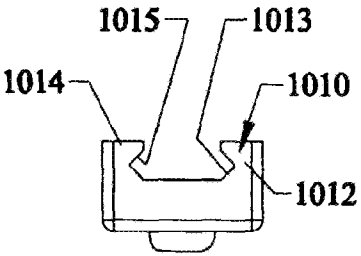
FIG. 7 is a front end view of the stacking unit of FIG. 1.

FIG. 1 is a bottom rear right perspective view of a folding stacking unit 1000. FIG. 2 is a bottom front left perspective view of the stacking unit 1000 of FIG. 1. FIG. 3 is a top rear right perspective view of the stacking unit 1000 of FIG. 1. FIG. 4 is top front left perspective view of the stacking unit 1000 of FIG. 1. FIG. 5 is a rear end view of the stacking unit 1000 of FIG. 1. FIG. 6 is a left side view of the stacking unit 1000 of FIG. 1. FIG. 7 is a front end view of the stacking unit 1000 of FIG. 1. FIG. 8 is a top view of the stacking unit 1000 of FIG. 1. FIG. 9 is a bottom view of the stacking unit 1000 of FIG. 1.

Figure 10:
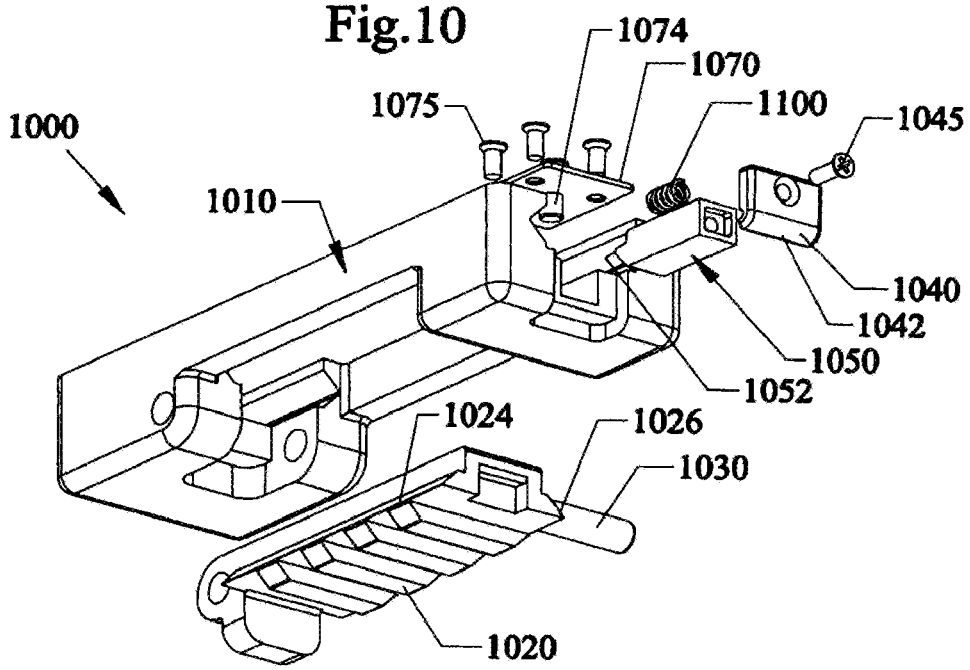
FIG. 10 is an exploded perspective view of the stacking unit of FIG. 1.
Figure 11:
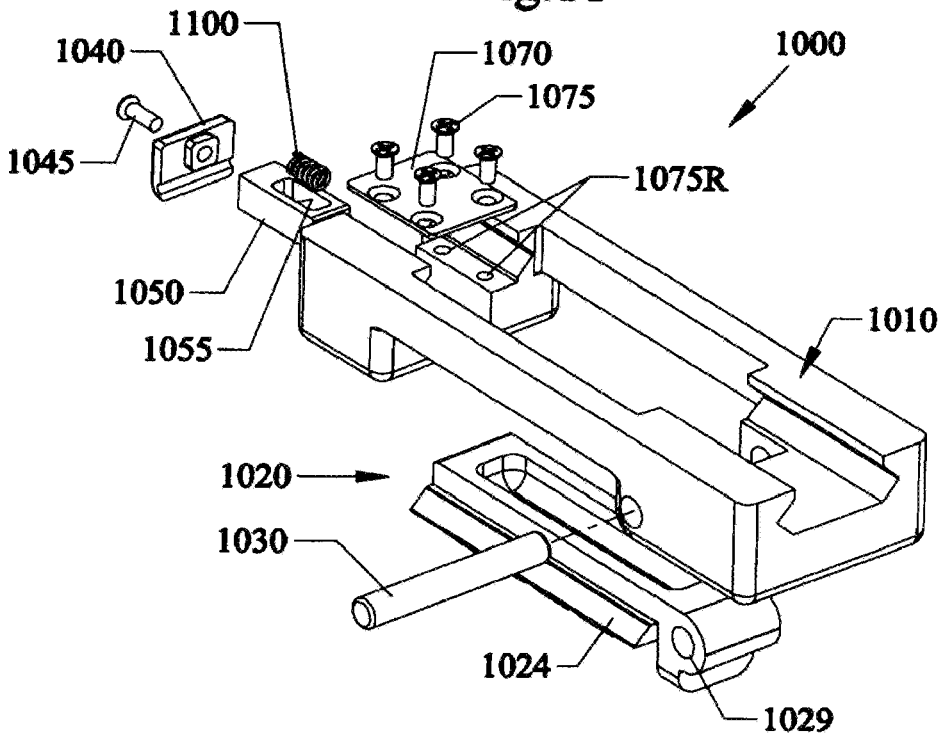
FIG. 11 is an exploded perspective view of the stacking unit of FIG. 1.

Referring to FIGS. 1-10, stacking unit 1000 can have a rail mount plate 1010 being a top plate member which hingedly attaches to a lower plate member 1020 which functions as a lower plate member by pivot pin 1030. FIG. 10 is an exploded perspective view of the stacking unit 1000 of FIG. 1. FIG. 11 is an exploded perspective view of the stacking unit 1000 of FIG. 1.

Referring to FIGS. 1-11, the stacking unit 1000 can include an upper surface with a pair of leg members 1012, 1014 each with internal facing side grooves 1013, 1015. The grooves 1013, 1015 are inwardly facing clamp edges that can slide about existing picatinny rails underneath of a firearm, such as a rifle and the like, which will be described in greater detail below. The inwardly facing clamp edges 1013, 1015 can also include optional clamp turn screws 1004 (FIG. 20) to attach the inwardly facing clamp edges about both sides of the existing picatinny rails underneath the firearm.

The stacking unit 1000 can also include a lower plate member 1020 (pivot rail) having opposite facing side rails 1024, 1026 that can be similar to or replicate the existing picatinny rails underneath the firearm. The side rails 1024, 1026 can be used for mounting a vertical fore grip such as the inventor's novel bipod fore grip thereon, which is shown below in FIG. 20.

The lower member 1020 of the stacking unit 1000 can be pivotally mounted to the rail mount plate 1010 by a pivot pin 1030 that passes through pin-hole 1029 of the bottom plate member 1020 and pin-hole 1019 of top plate member 1010. The fit can be a frictional fit where the operator pulling back on front tab 1028 can extend the pivot rail member(lower member) from a position horizontal to and within the top member(rail plate member) 1010 to a position substantially perpendicular to the rail mount plate member 1010, where it is held in place by friction. Tab 1028 rests inside of notch 1018 on the lower surface of top plate member 1010 while lower plate member 1020 is perpendicular to top plate member 1010.

Figure 13:
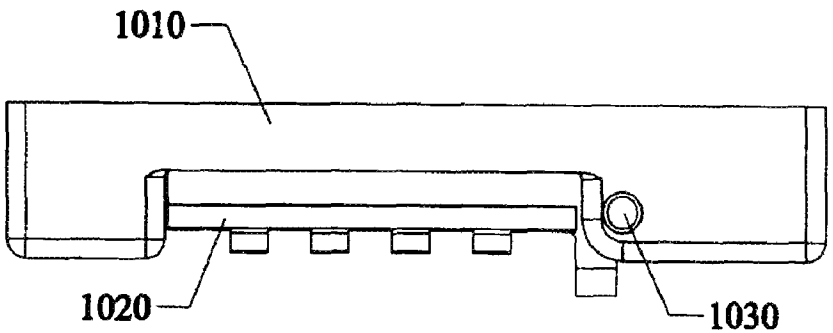
FIG. 13 is an enlarged left side view of the stacking unit of FIGS. 1, 6.
Figure 12:
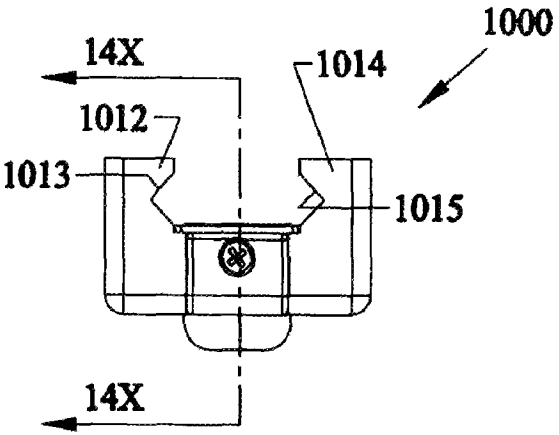
FIG. 12 is an enlarged rear end view of the stacking unit of FIGS. 1, 5.
Figure 14:
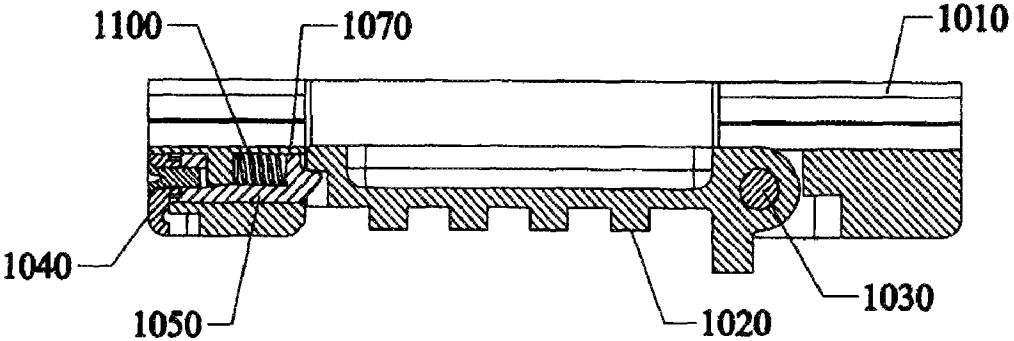
FIG. 14 is a cross-sectional view of the stacking unit of FIG. 12 along arrows 14X.

FIG. 12 is an enlarged rear end view of the stacking unit 1000 of FIGS. 1, 5. FIG. 13 is an enlarged left side view of the stacking unit 1000 of FIGS. 1, 6. FIG. 14 is a cross-sectional view of the stacking unit 1000 of FIG. 12 along arrows 14X.

Figure 16:
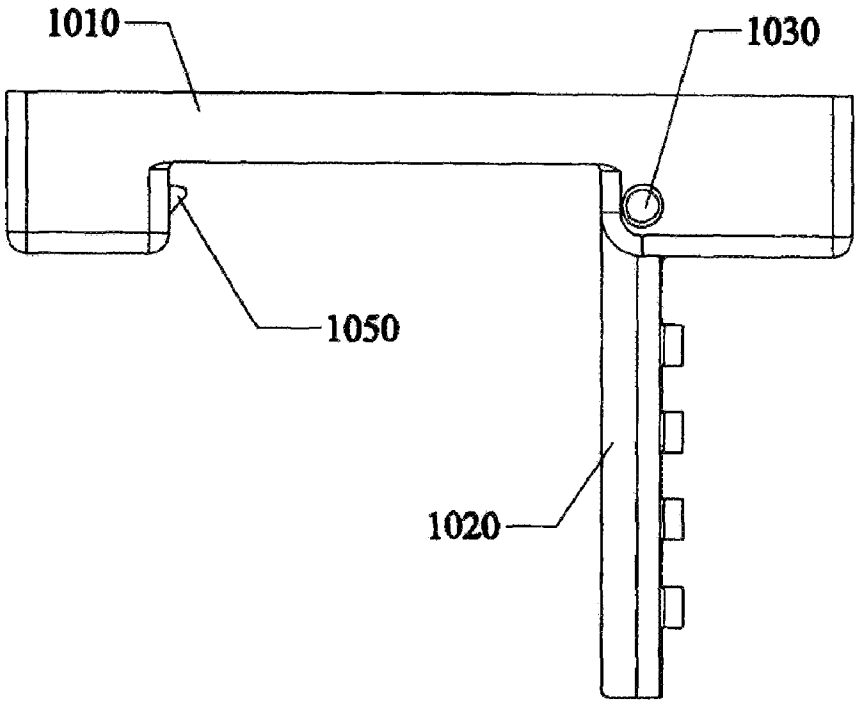
FIG. 16 is a left side view of FIG. 15.
Figure 15:
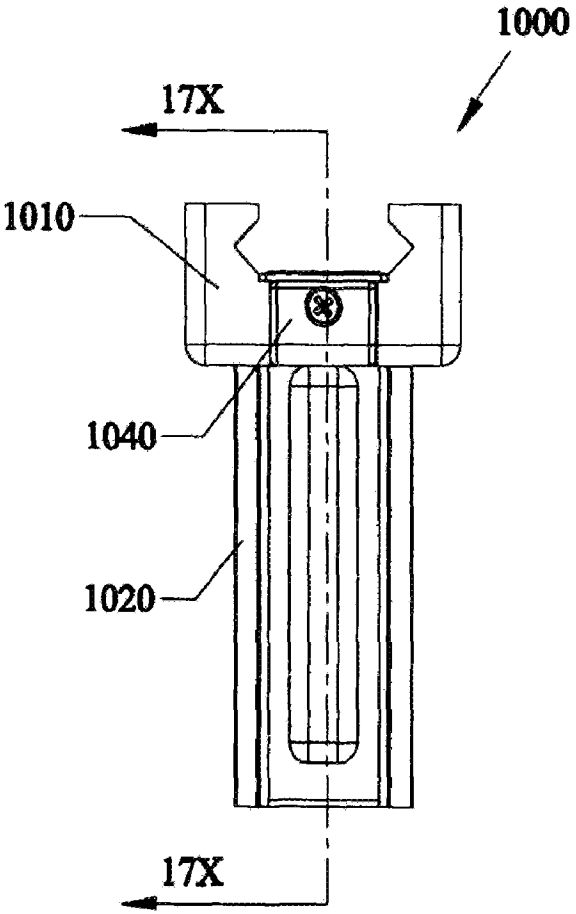
FIG. 15 is a rear view of the preceding stacking unit with pivot rail folded forward.

FIG. 15 is a rear view of the preceding stacking unit 1000 with lower plate member 1020 (pivot rail member) folded forward. FIG. 16 is a left side view of FIG. 15.

Figure 17:
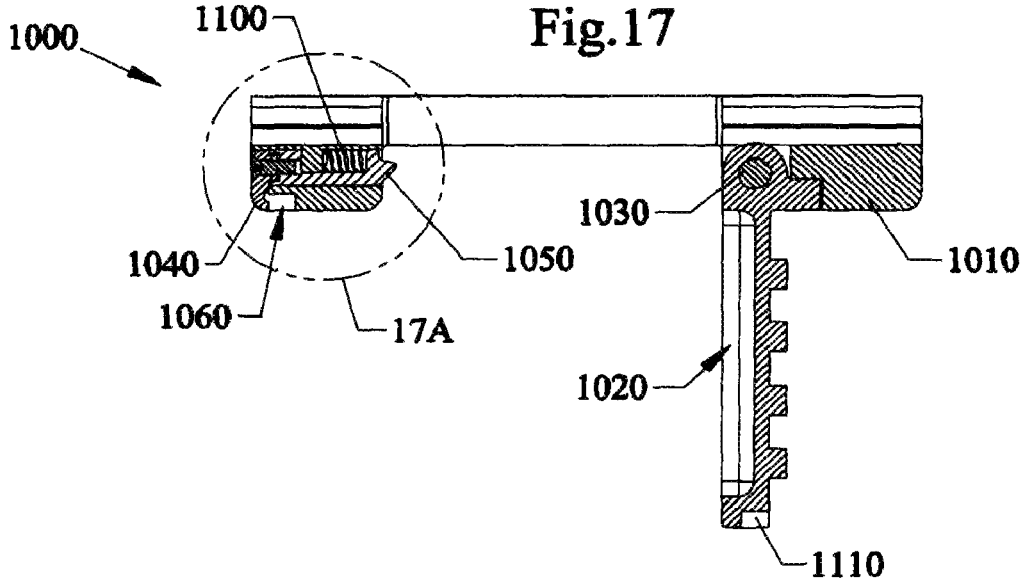
FIG. 17 is a cross-sectional view of FIG. 15 with pivot rail folded forward.
Figure 17A:
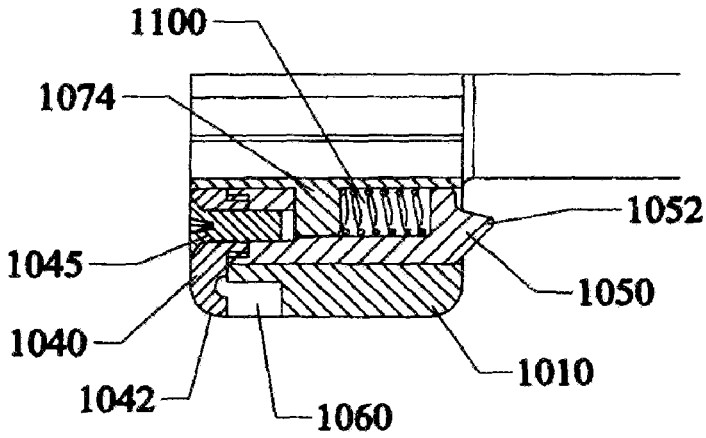
FIG. 17A is an enlarged view of the rail mount plate, release button, pivot rail latch, release button finger access slot and latch spring shown in FIG. 17.

FIG. 17 is a cross-sectional view of FIG. 15 with pivot rail member 1020 folded forward. FIG. 17A is an enlarged view of the rail mount plate(top plate member) 1010, release button 1060, pivot rail latch 1050, release button finger access slot 1060 and latch spring shown 1100 in FIG. 17.

Figure 18:
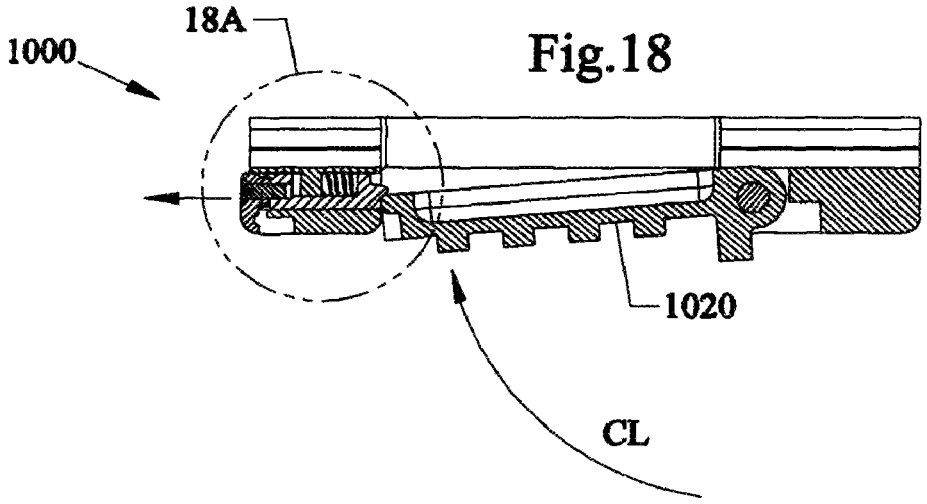
FIG. 18 is another cross-section view of FIGS. 15, 17 with pivot rail being folded.
Figure 18A:
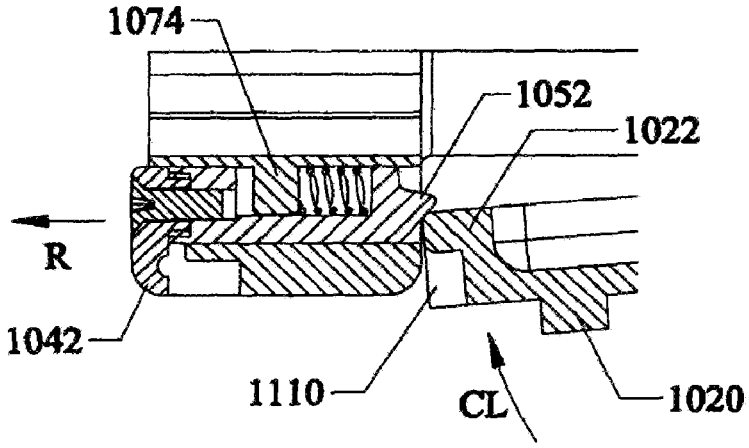
FIG. 18A is an enlarged view of the rail mount plate, release button, pivot rail latch, release button finger access slot and latch spring shown in FIG. 18.

FIG. 18 is another cross-section view of FIGS. 15, 17 with pivot rail member(lower plate member 1020) being folded. FIG. 18A is an enlarged view of the rail mount plate member (top plate member) 1010, release button 1060, pivot rail latch 1050, release button finger access slot 1060 and latch spring 1100 shown in FIG. 18.

Figure 19:
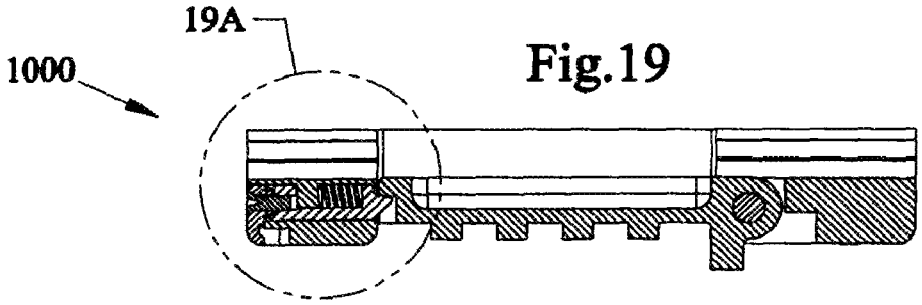
FIG. 19 is another cross-section view of FIGS. 15, 18-18 with pivot rail locked.
Figure 19A:
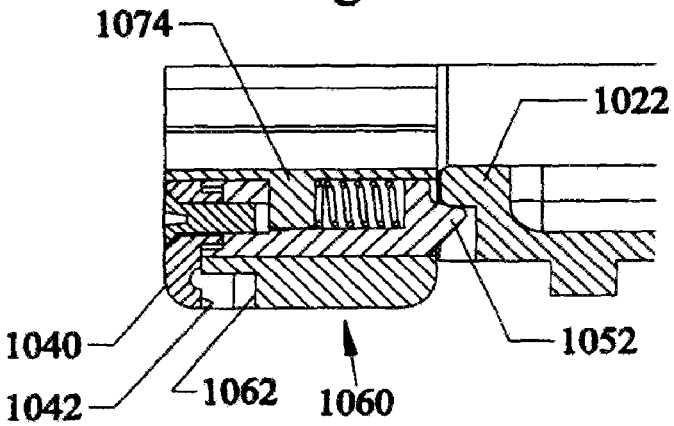
FIG. 19A is an enlarged view of the rail mount plate, release button, pivot rail latch, release button finger access slot and latch spring shown in FIG. 19.

FIG. 19 is another cross-section view of FIGS. 15, 18-18 with pivot rail locked. FIG. 19A is an enlarged view of the rail mount plate, release button 1060, pivot rail latch 1050, release button finger access slot 1060 and latch spring 1100 shown in FIG. 19.

Referring to FIGS. 12-18B, pushing the lower plate member(pivot rail member) 1020 in the opposite direction of CL allows the lower member 1020 to pivot back to latch and lock onto the rail mount plate 1010 which is shown in FIGS. 12-18B below.

As shown in FIGS. 10-11, and 17-19A, latch spring 1100 fits inside a top longitudinal slot 1055 within latch 1050. An inner end of latch 1050 includes a ledge edge 1052 which can latch against upper ledge edge 1022 of pivot rail member 1020 (shown more clearly in FIGS. 17-19A. A release button 1040 can be held in place by a fastener 1045 such as a screw, and the like, which fastens into threaded surfaces in the end of pivot rail latch 1050 opposite to end having ledge edge 1052.

A downwardly protruding pin 1074 in plate 1076 can fit into longitudinal top slot 1055 of pivot rail latch 1050 and be held in place by fasteners 1075, such as screws which lock plate 1070 to threaded receiving holes 1075R in top plate member 1010.

The downwardly protruding pin 1074 is useful so that pivot rail latch 1050 can move to the left and right by the slot 1055 sliding about the downwardly protruding pin 1074.

The operation of using the release button 1060 will know be described in reference to FIGS. 19A, 18A, and 17A in that order, the release button 1060 can be moved by the operator using a finger inserted into access slot 1062 of the release button 1060 to press against downwardly protruding lip edge 1042 in the direction of arrow R. Mount plate 1010 which is fixably attached to pivot rail latch 1050 contracts against latch spring 1100 while moving ledge edge 1052 away from upper pivot rail edge 1022 of pivot rail member 1020. This allows the pivot rail member(lower plate member 1020) to be able to pivot downward to a vertical position as shown in FIG. 17.

The pivotable lower plate member 1020 can have a pair of opposite facing rails that can mount to the inventors' bipod with extendable legs, which is shown and described in their previous patent, and other patents pending.

Alternatively, the stacking unit 1000 can allow for other fore grips to be mounted thereon. Still furthermore, the stacking unit can be an integral part of a vertical fore grip.

While a pullout type switch is shown, the lower portion of the stacking unit can be released with other types of buttons, such as a depressible button, and the like.

Figure 20:
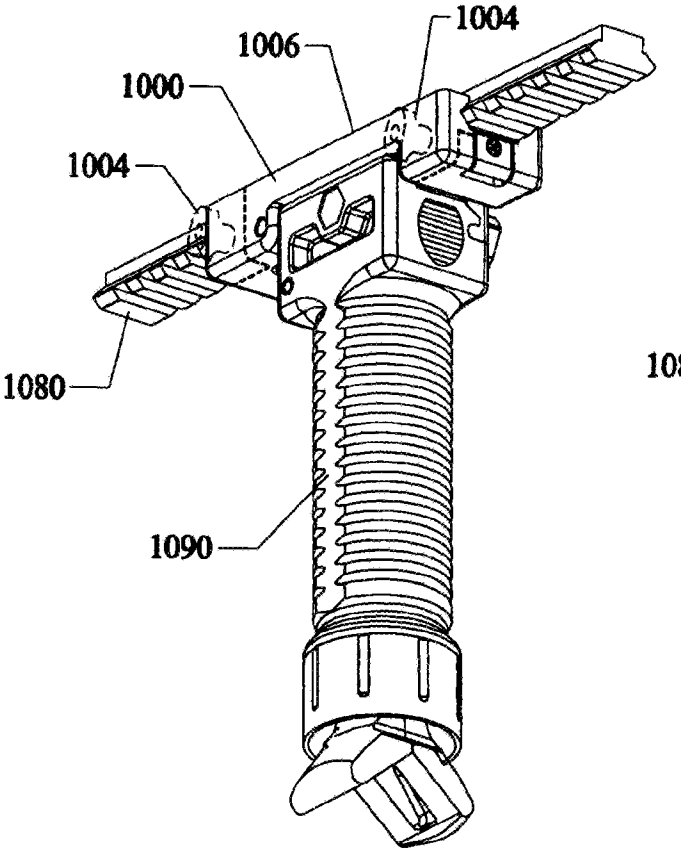
FIG. 20 is a rear bottom right perspective view of the folding stacking unit attached to a vertical fore grip, with the stacking unit mounted to a picatinny rail of a firearm.

FIG. 20 is a rear bottom right perspective view of the folding stacking unit 1000 attached to a vertical fore grip 1090, with the stacking unit 1000 mounted to a picatinny rail 1080 of a firearm(not shown) such as a rifle, and the like. As previously described the clamp screw 1004 can be used to attach the folding stacking unit 1000 by holding an optional side plate 1006 in place.

Figure 21:
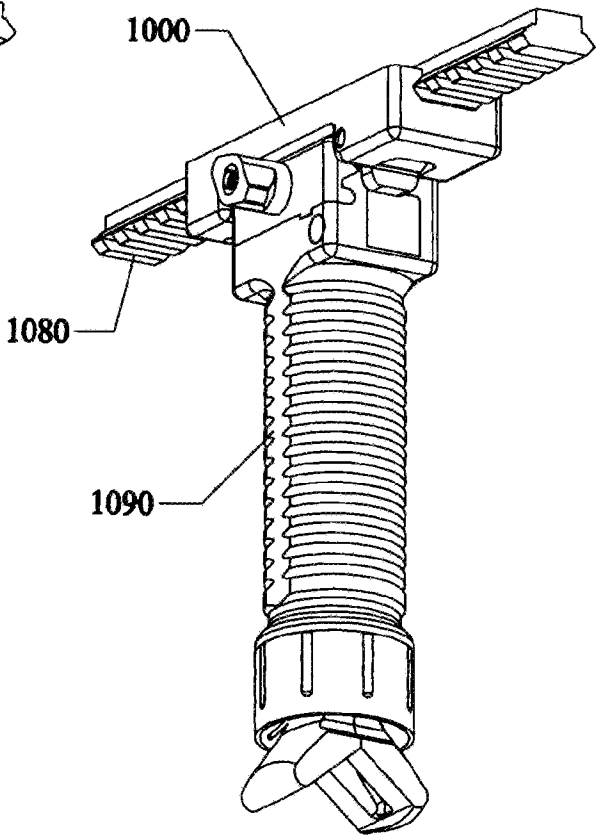
FIG. 21 is a front bottom left perspective view of FIG. 20 showing the folding stacking unit attached to a vertical fore grip, with the stacking unit mounted to the firearm.
Figure 23:
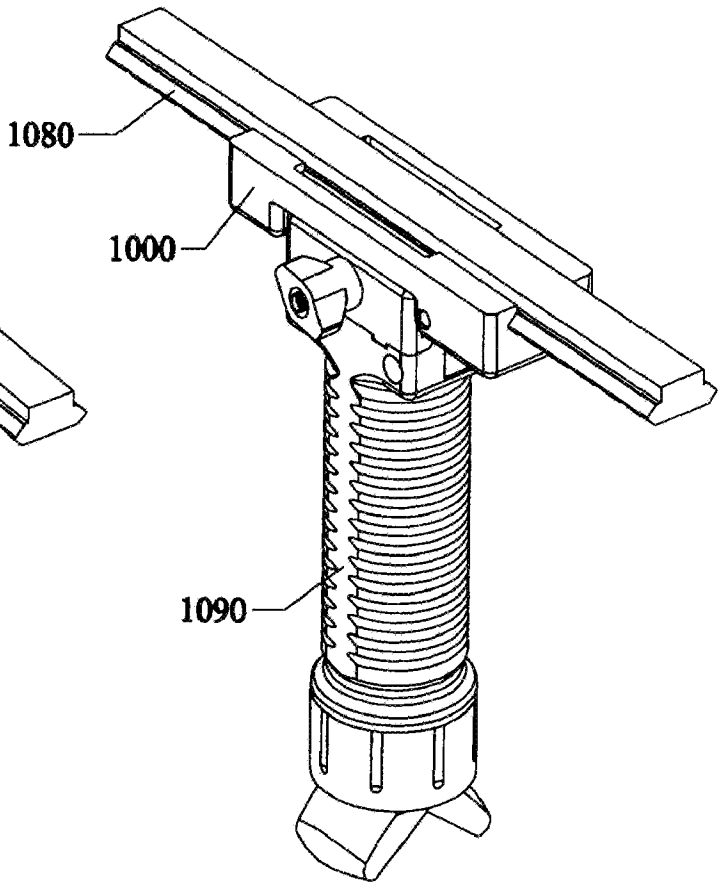
FIG. 23 is front top left perspective view of the folding stacking unit attached to a vertical fore grip, with the stacking unit mounted to the firearm of FIG. 21.
Figure 22:
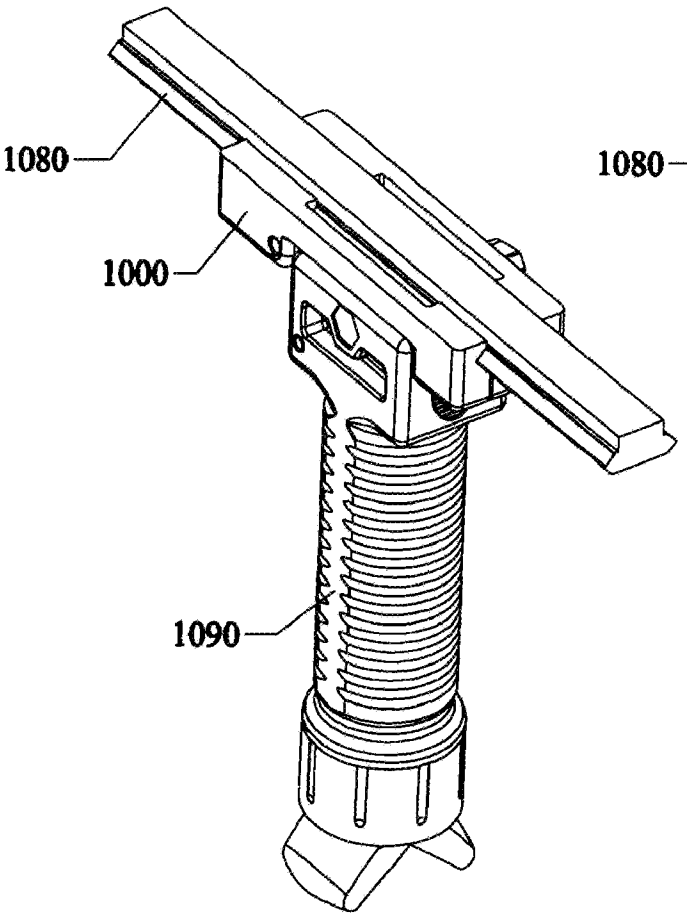
FIG. 22 is a rear top right perspective view of the folding stacking unit attached to fore grip, with the stacking unit mounted to a picatinny rail of a firearm of FIG. 20.

FIG. 21 is a front bottom left perspective view of FIG. 20 showing the folding stacking unit 1000 attached to a vertical fore grip 1090, with the stacking unit 1000 mounted to the picatinny rails 1080 of a firearm(not shown) such as a rifle, and the like. FIG. 22 is a rear top right perspective view of the folding stacking unit 1000 attached to fore grip 1090, with the stacking unit 1000 is mounted to a picatinny rail 1080 of a firearm of FIG. 20. FIG. 23 is front top left perspective view of the folding stacking unit 1000 attached to a vertical fore grip 1090, with the stacking unit 1000 mounted to the firearm of FIG. 21.

Figure 24:
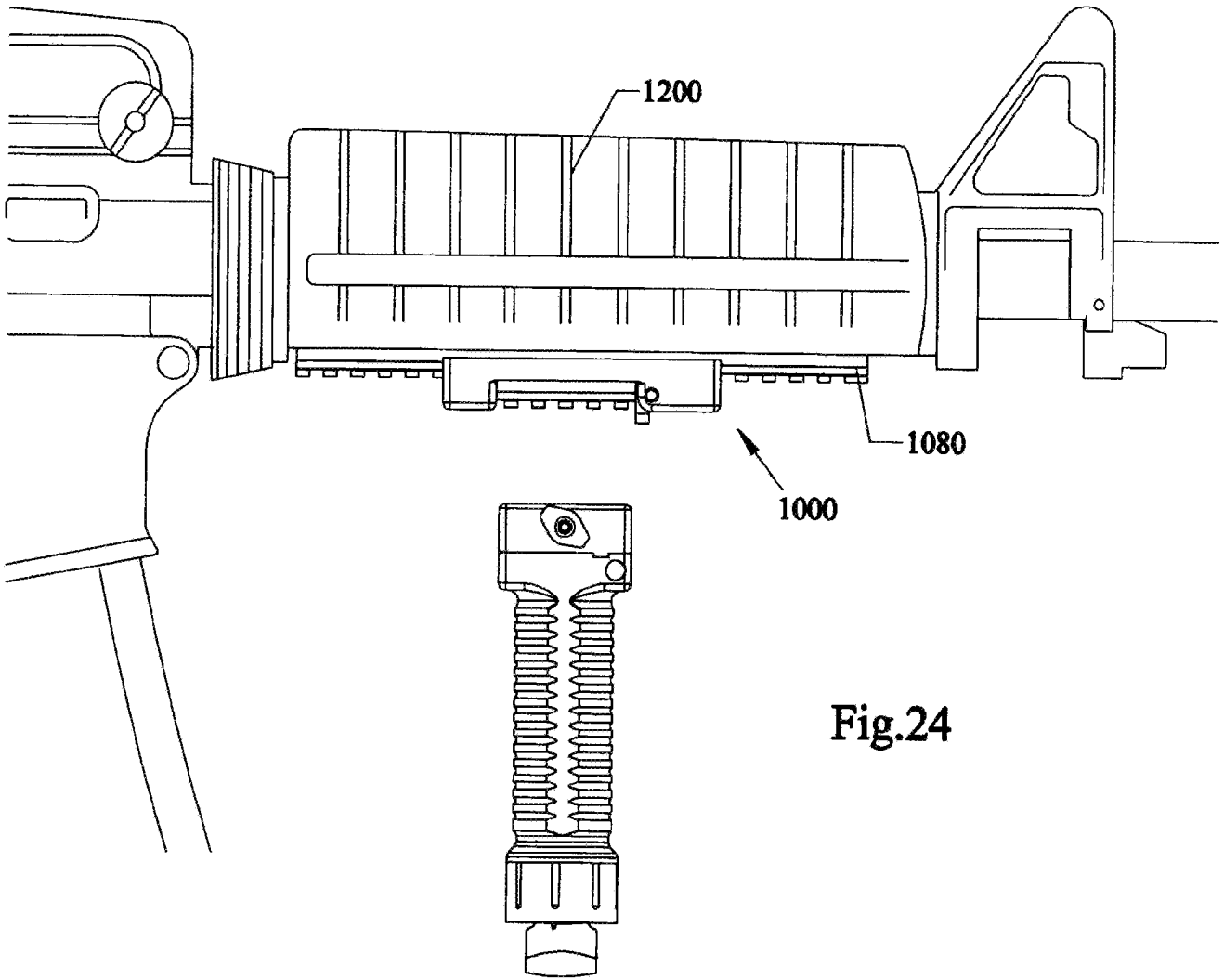
FIG. 24 is side view of bipod vertical fore grip detached from the stacking unit that is mounted beneath the firearm.

FIG. 24 is side view of bipod vertical fore grip 1090 detached from the stacking unit 1000 that is mounted beneath the firearm 1200. As previously described, the clamping grooves of the stacking unit 1000 can mateably slide about the picatinny type rails 1080 under the firearm 1200. Alternatively, the stacking unit 1000 can be attached to the picatinny rails by removing the optional side plate 1006 (shown in FIG. 20), by fasteners 1004 and positioning the remaining clamping groove about a picatinny rail and fastening the side plate 1006 back in place with fastener 1004.

Figure 25:
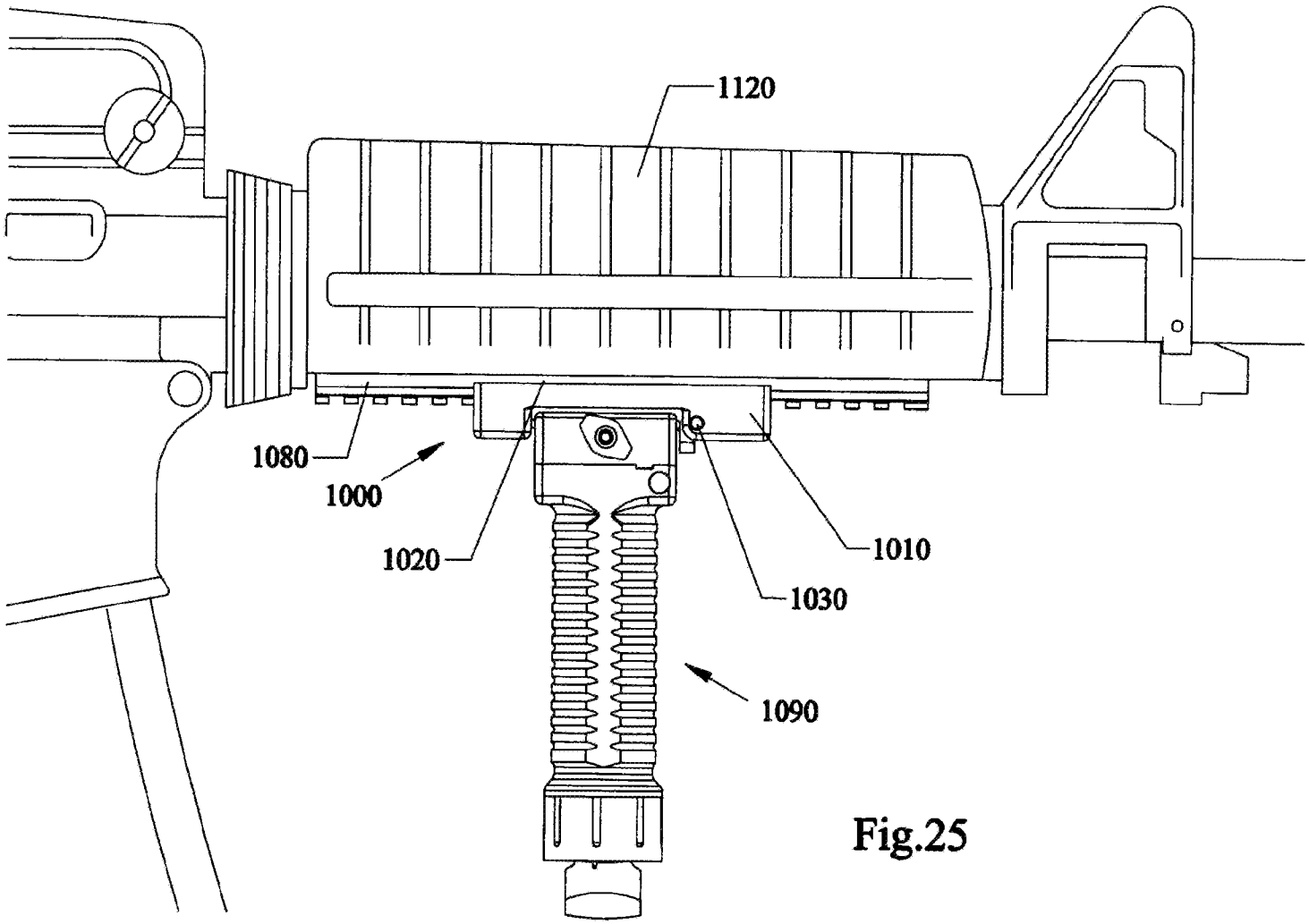
FIG. 25 is another side view of FIG. 24 with the fore grip mounted to the stacking unit.
Figure 25A:
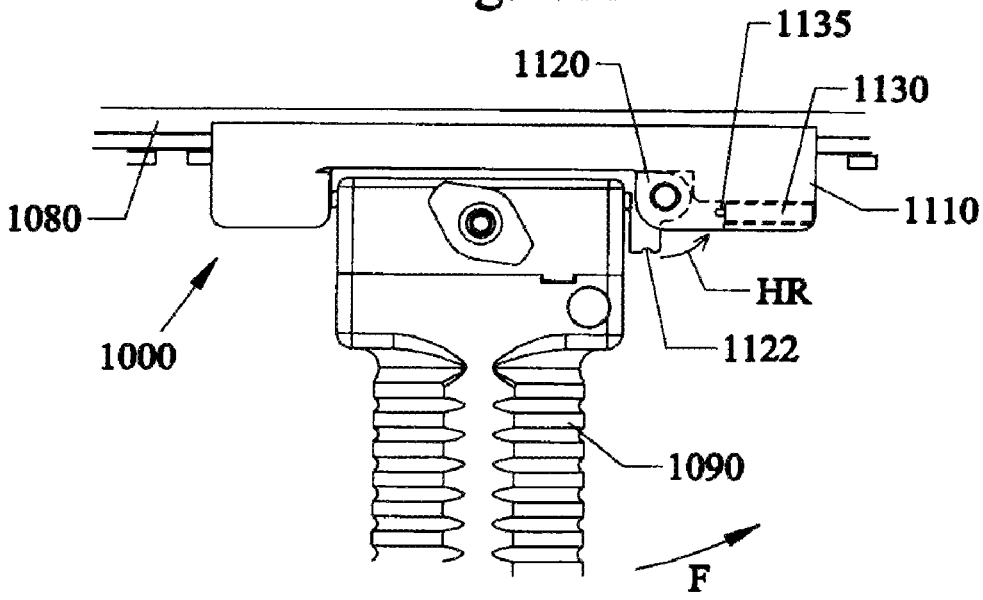
FIG. 25A is an enlarged view of the fore grip mounted to stacking unit of FIG. 25.

FIG. 25 is another side view of FIG. 24 with the fore grip 1090 mounted to the stacking unit 1000. FIG. 25A is an enlarged view of the fore grip 1090 mounted to stacking unit 1000 of FIG. 25.

Figure 26A:
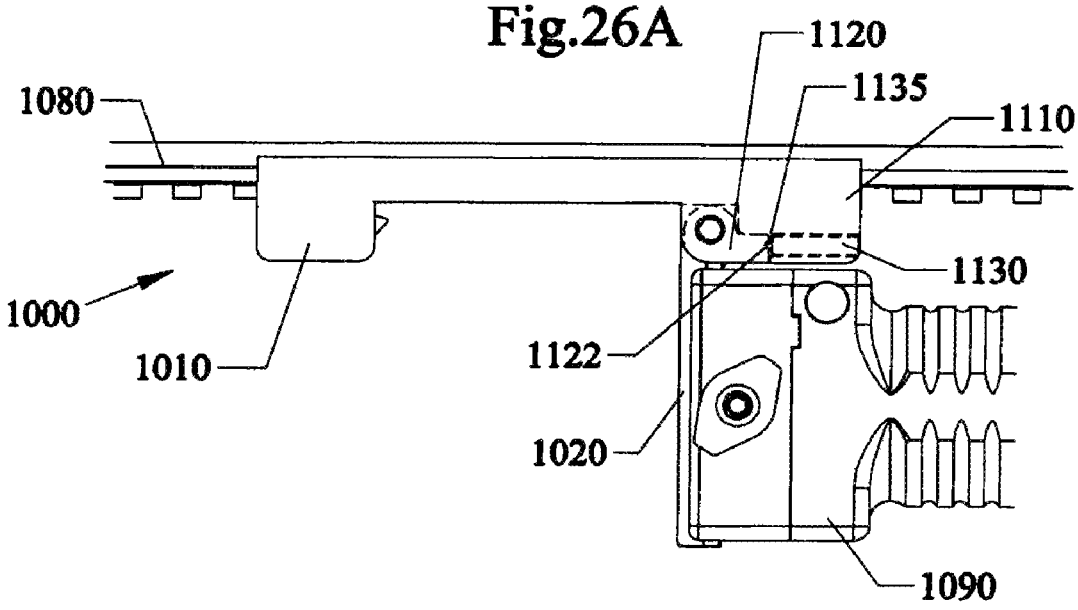
FIG. 26A is an enlarged view of the folded fore grip and mounting plate of FIG. 26.
Figure 26:
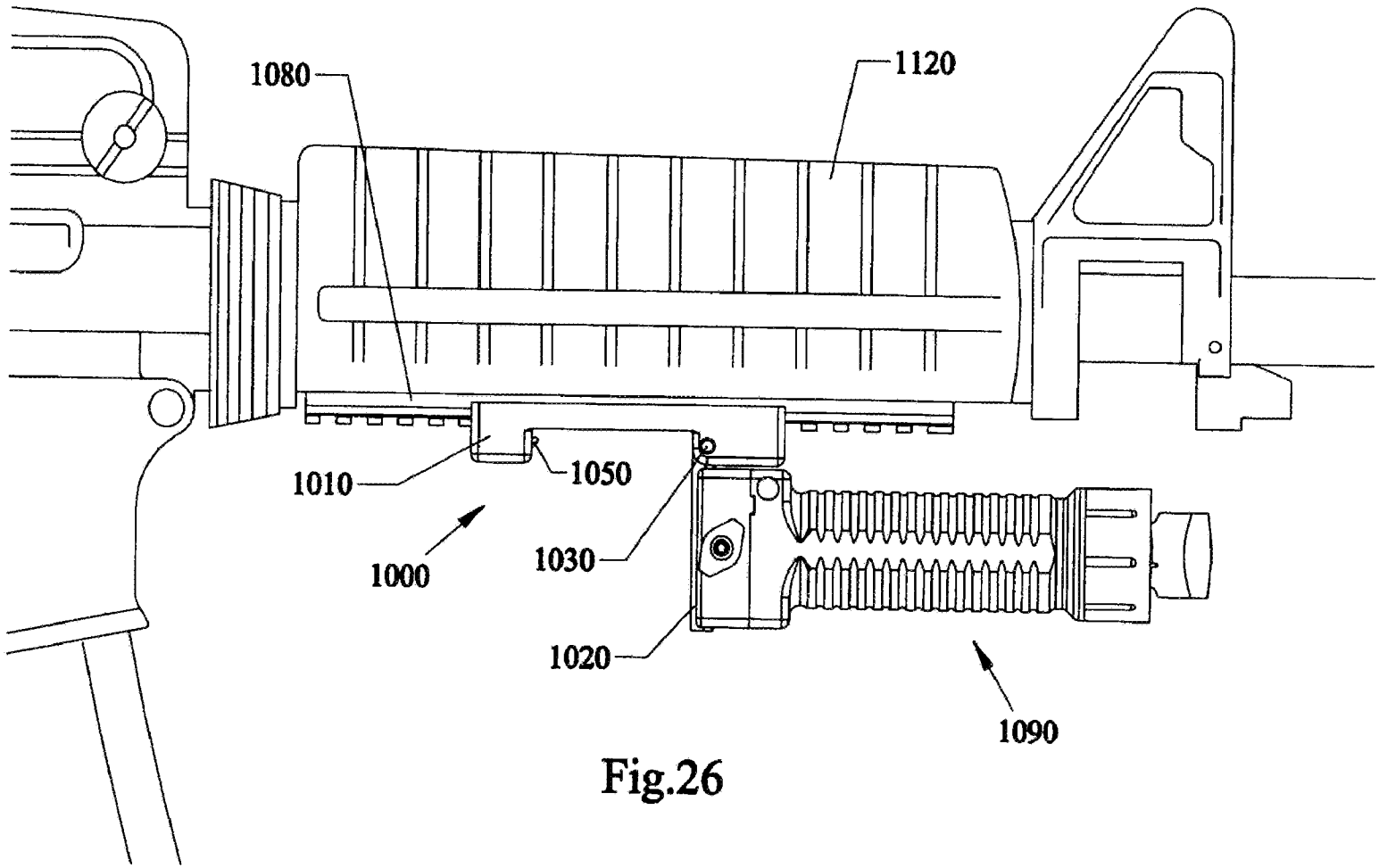
FIG. 26 is another view of FIGS. 24-25 with fore grip in folded position to firearm.

FIG. 26 is another view of FIGS. 24-25 with fore grip in folded position to the firearm. FIG. 26A is an enlarged view of the folded fore grip 1090 and mounting plate 1000 with firearm 1200 of FIG. 26.

Similar to the techniques for mounting the stacking unit 1000 to the firearm 1200, the fore grip 1090 can be mounted by sliding the grooves on the top of the fore grip 1090 about the side rails 1024, 1026 on the sides of the lower plate member(pivot rail member) 1020. Alternatively, the side plates on the top of the fore grip 1090 can be removed and the fore grip 1090 attached to the side rails of the pivot rail member 1020 similar to the technique described above.

Referring to FIGS. 25, 25A, 26 and 26A, pivot rail member 1020 with fore grip 1090 can be held in a horizontal orientation by a frictional fit. Alternatively, a pivotal lock catch 1120 which is pivotally attached to an undersurface portion of top plate member 1010 to one side of the fore grip 1090 has a pivotal arm with a notch end 1022. Folding up fore grip 1090 in the direction of arrow F causes pivotal lock catch 1120 to rotate up so that rounded tip edges about notch 1022 push back spring biases spring pin 1135 in set screw 1130 until pin 1135 extends and catches into notch 1022 resulting in the fore grip 1090 being locked in a horizontal position. Pulling down on the bottom of fore grip 1090 can cause the other tip edge of pivotal lock catch 1120 to push against pin 1135 allowing the fore grip 1090 to go back to a vertical position.

LIGHT EMBODIMENTS

Figure 27:
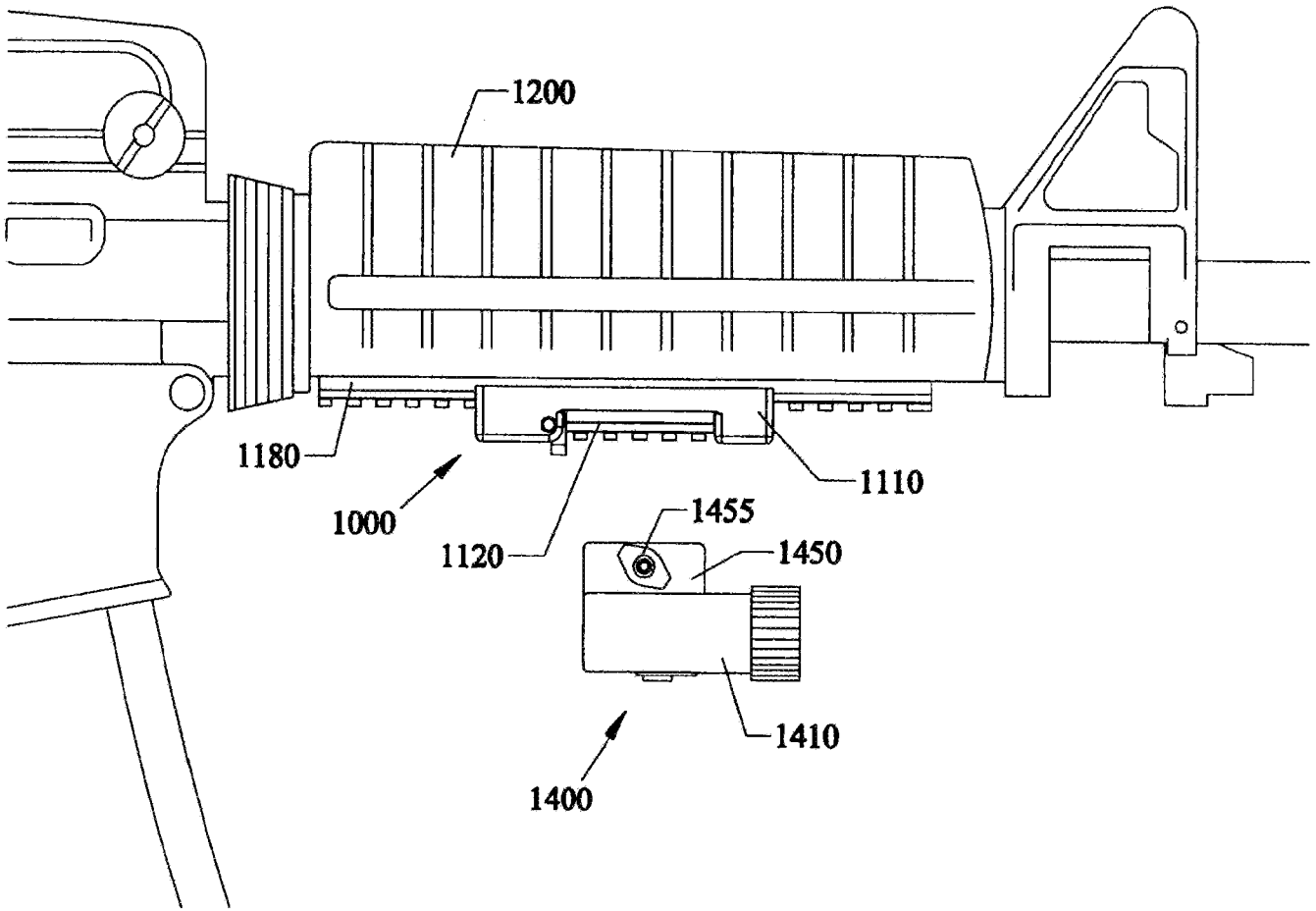
FIG. 27 is a side view of a foldable light/foldable fore grip with light detached from a stacking unit that is mounted beneath a firearm.
Figure 28:
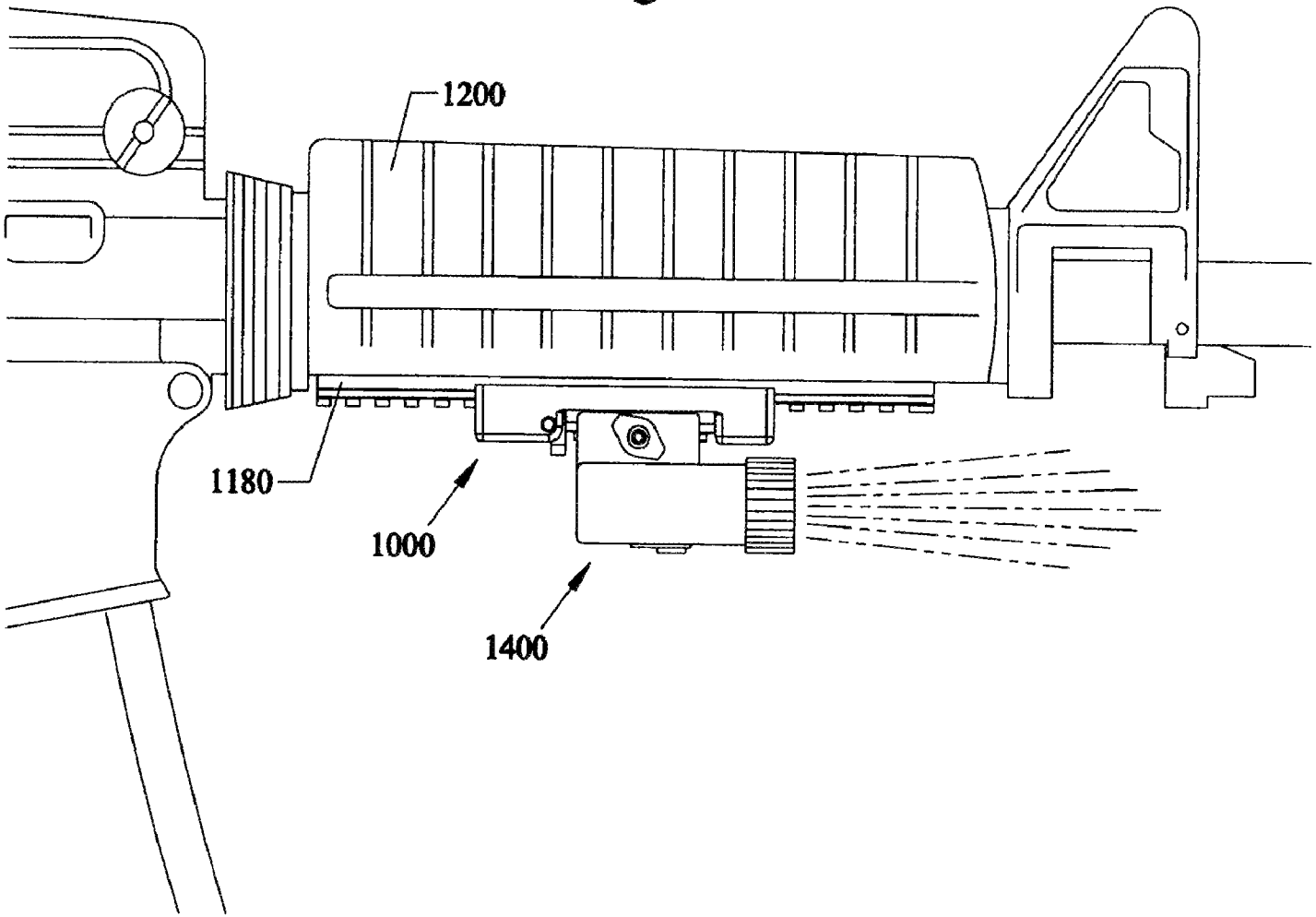
FIG. 28 is another view of FIG. 27 showing the light/fore grip with light, attached to the firearm mounted stacking unit, with light/fore grip with light, in folded position.
Figure 29:
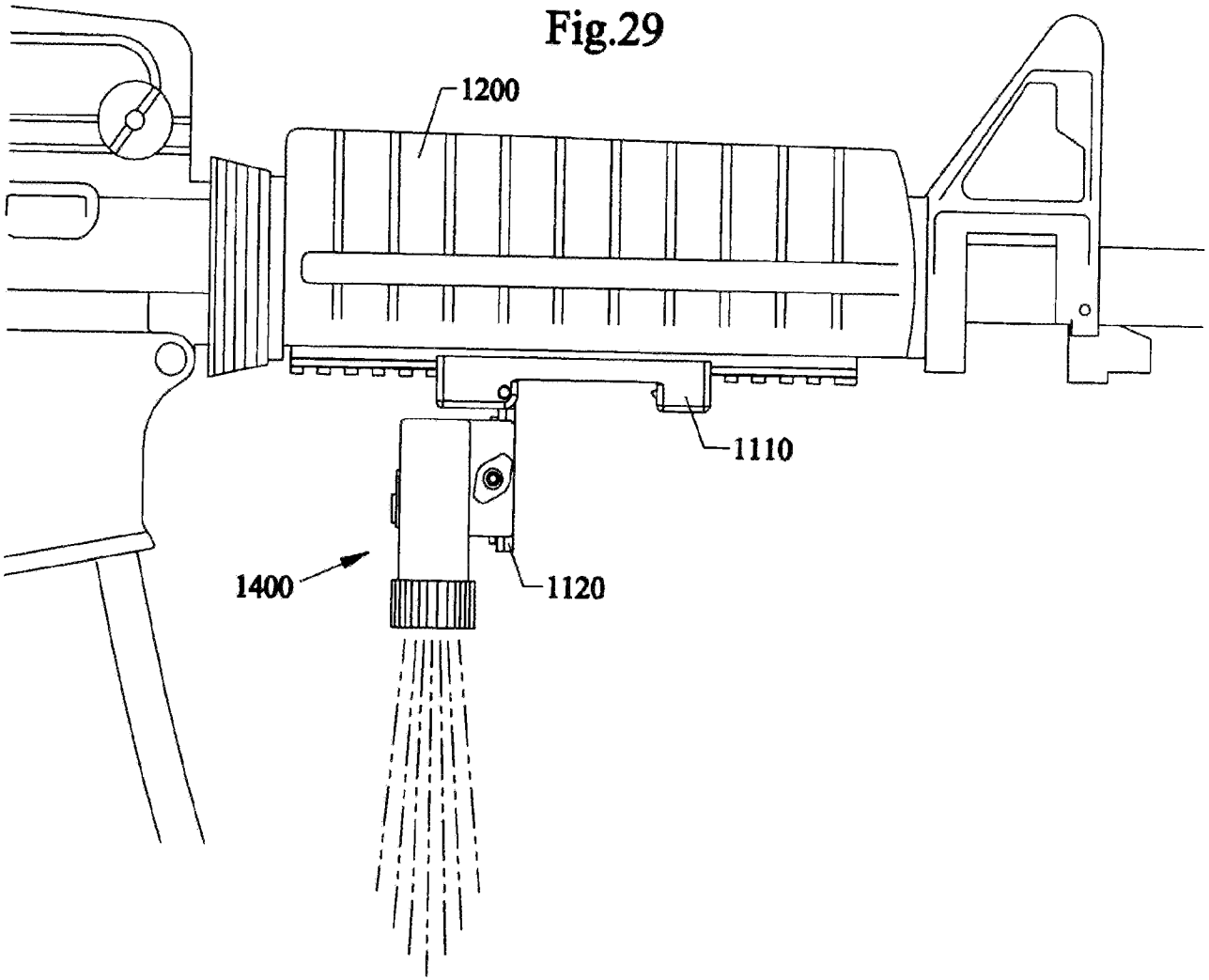
FIG. 29 is another view of FIGS. 27-28 with light/fore grip with light in downward extended position, with the light being useable as a map light, or the light being used as a vertical fore grip.

FIG. 27 is a side view of a foldable light/foldable fore grip light 1400 detached from a stacking unit 1000 that is mounted beneath a firearm 1200. FIG. 28 is another view of FIG. 27 showing the light/fore grip 1400 with light 1410, attached to the firearm mounted stacking unit 1000, with light/fore grip 1400 with light 1410, in folded position. FIG. 29 is another view of FIGS. 27-28 with light/fore grip 1400 with light 1410 in downward extended position, with the light 1410 being useable as a map light, or the light being used as a vertical fore grip.

Referring to FIGS. 27-29, the invention can have a novel light mounted to the stacking unit 1000, so that the light can be used in either a folded position, or in a downwardly extending position. The light/fore grip 1400 with light 1410 can have an upper plate member assembly 1450 similar to dual inwardly facing grooves that exist on the top of the fore grip 1090 described above, with optional fastener 1455, which can attach to the lower plate member 1120 similar to the previous embodiments above.

The folding unit can also allow the light to fold frontward, so that the light is turned on in the direction of where the firearm is pointed. Additionally, the folding unit can allow the light to face rearward behind the firearm. Additionally, the folding unit can allow the light to face sideways to the left and to the right of the firearm, as well.

Figures 30, 31:
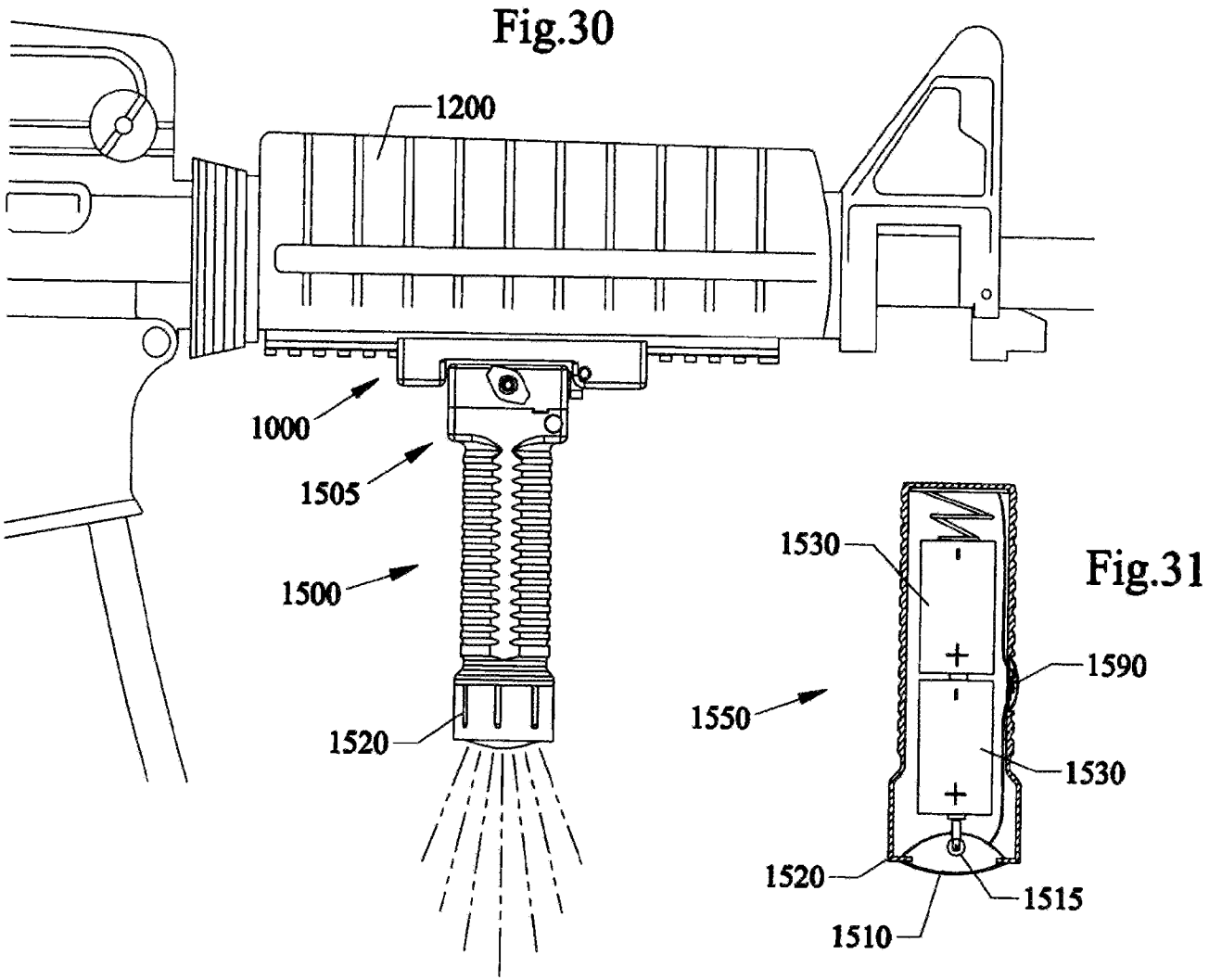
FIG. 30 shows a novel combined vertical fore grip with built in-light.
FIG. 31 is a side cross-sectional view of the interior of the fore grip light of FIG. 30.

Still furthermore, the invention can allow for both a vertical fore grip with a light built 1550 into the fore grip 1500, so that it can have dual functions for use as a vertical fore grip and as light. The light can be useful for non firearm use, such as a map light to allow the operator to view maps, and the like, during dark conditions. FIG. 30 shows a novel combined vertical fore grip 1500 with built in-light. FIG. 31 is a side cross-sectional view of the interior of the fore grip light 1500 of FIG. 30.

Referring to FIGS. 30-31 the fore grip 1500 can have a similar shape to the exterior surfaces of the fore grip 1090 previously described with an upper end 1505 being attachable to the lower plate member 1020 of stacking unit 1000 similar to the fore grip 1090 previously described. The inside 1550 of the fore grip 1500 can include components such as but not limited to batteries 1530 and a light source 1515, such as a bulb, LED(light emitting diode), and the like, and lens 1510. Cap 1520 can rotate to both turn on the light and allow the lens 1510 to extend beneath fore grip 1500. Alternatively, side button 1590 can be depressed to active and deactivate light 1515.

A list of components for additional embodiments will now be described. 1700) Adapter assembly with one long clamp.

Figure 32:
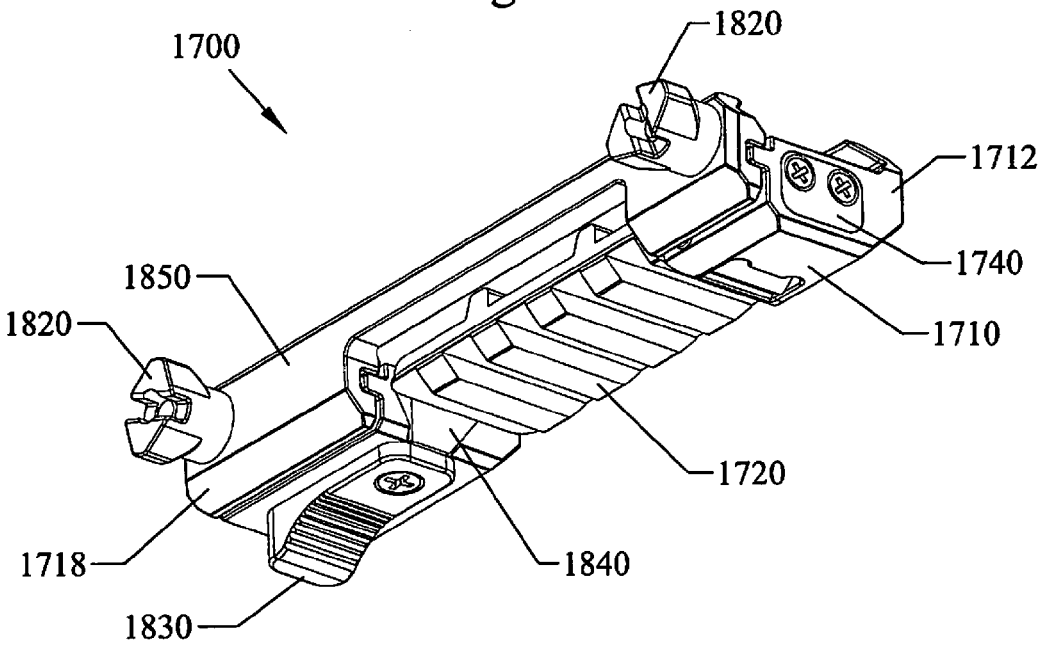
FIG. 32 is a front bottom perspective view of another embodiment of the folding stack adapter assembly with long clamp.
Figure 33:
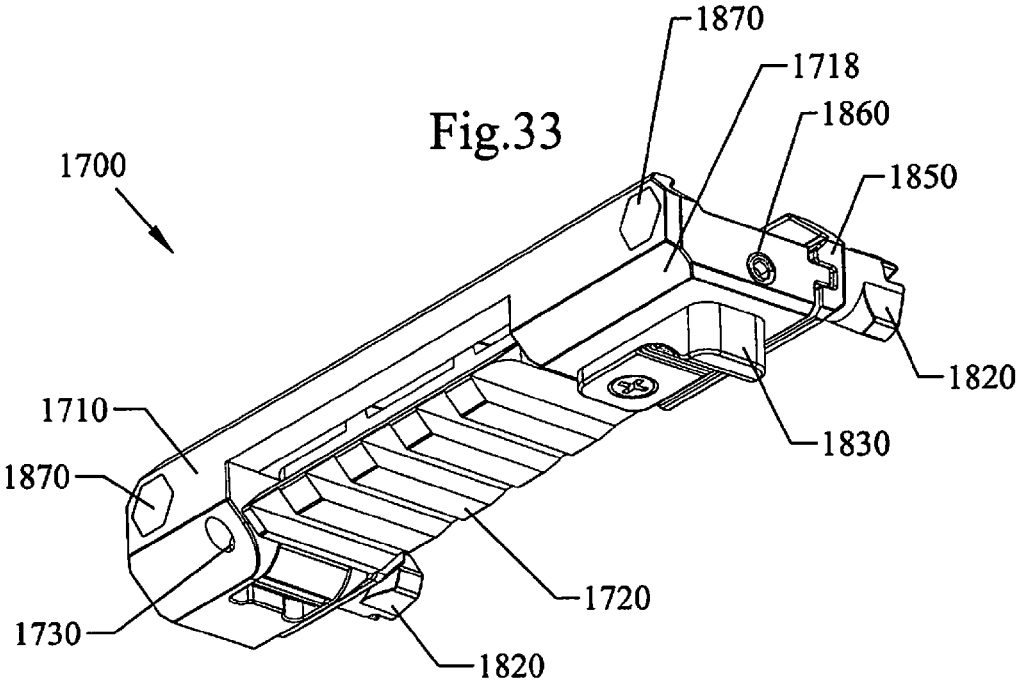
FIG. 33 is a rear bottom perspective view of the adapter assembly of FIG. 32.
Figure 34:
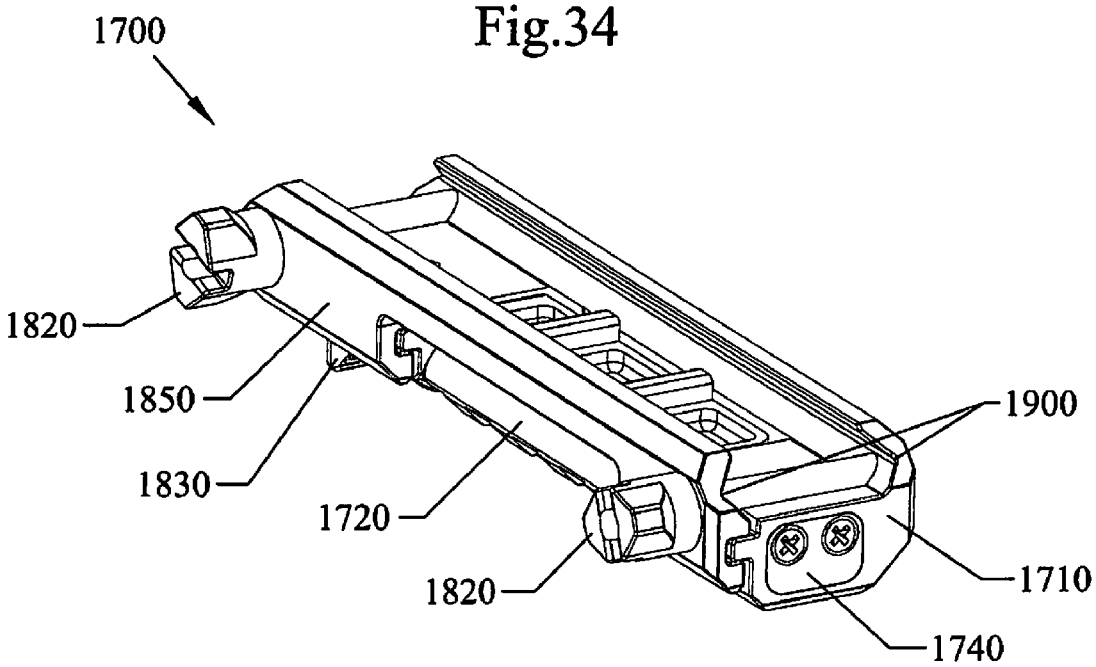
FIG. 34 is a front top perspective view of the adapter assembly of FIG. 32.
Figure 35:
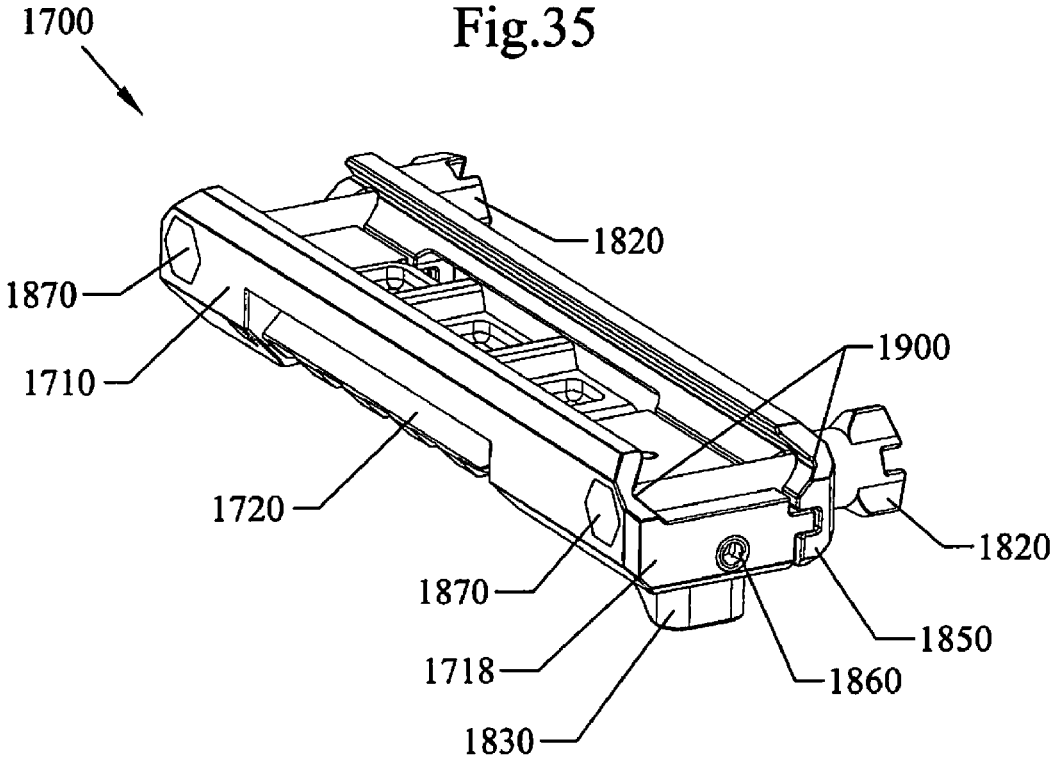
FIG. 35 is a rear top perspective view of the adapter assembly of FIG. 32.
Figure 36:
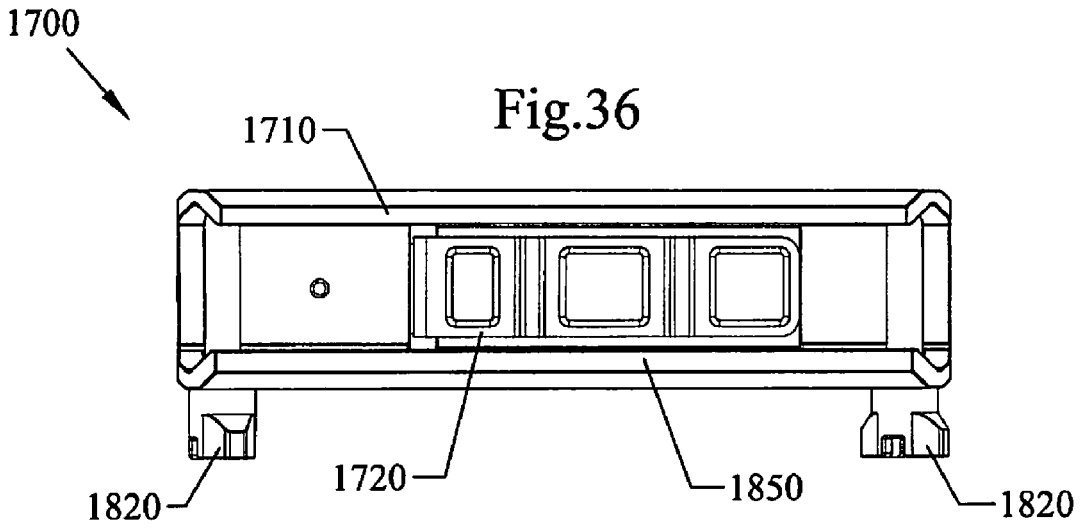
FIG. 36 is a top view of the folding stack adapter assembly of FIG. 32.
Figure 37:
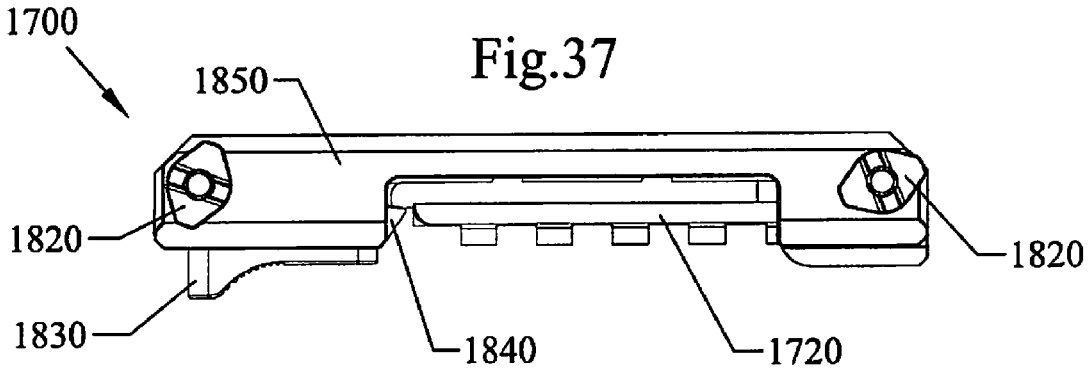
FIG. 37 is a side view of the folding stack adapter assembly of FIG. 32.
Figure 38:
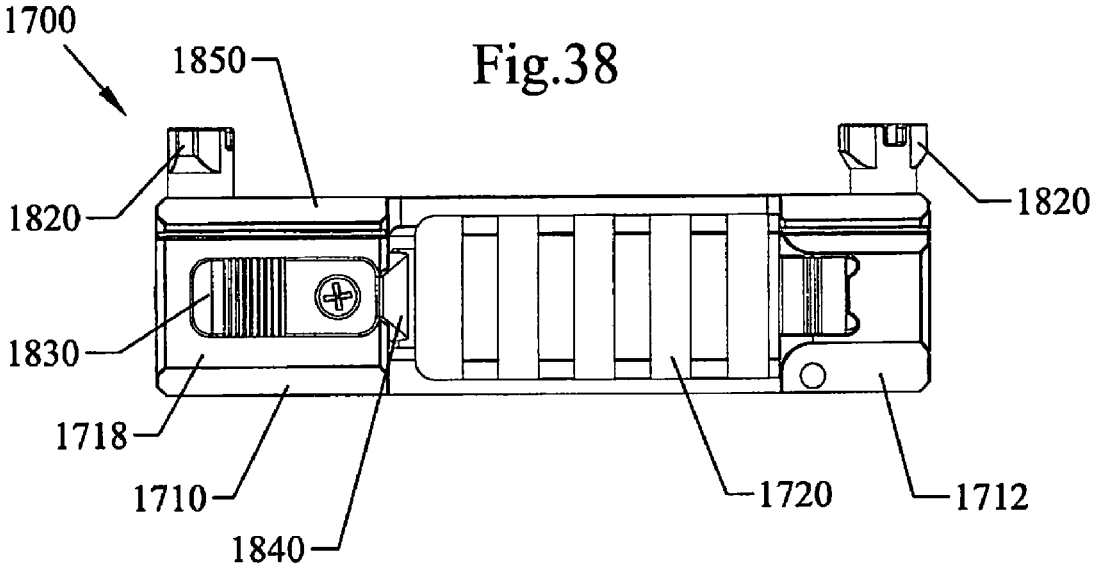
FIG. 38 is a bottom view of the adapter assembly of FIG. 32.
Figure 40:
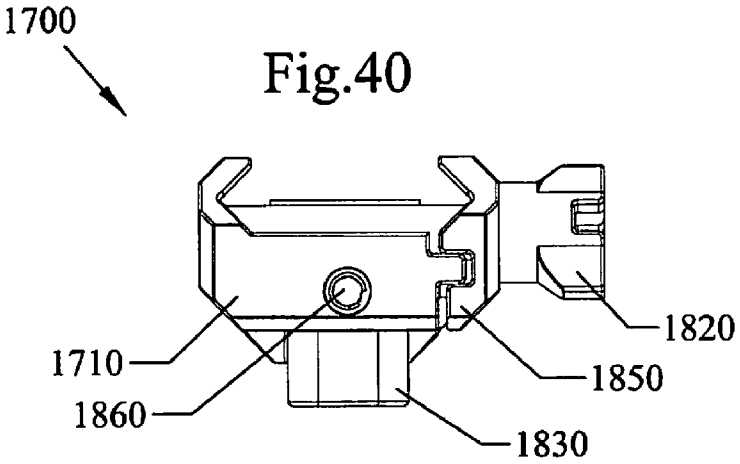
FIG. 40 is a right view of the adapter assembly of FIG. 32.
Figure 39A:
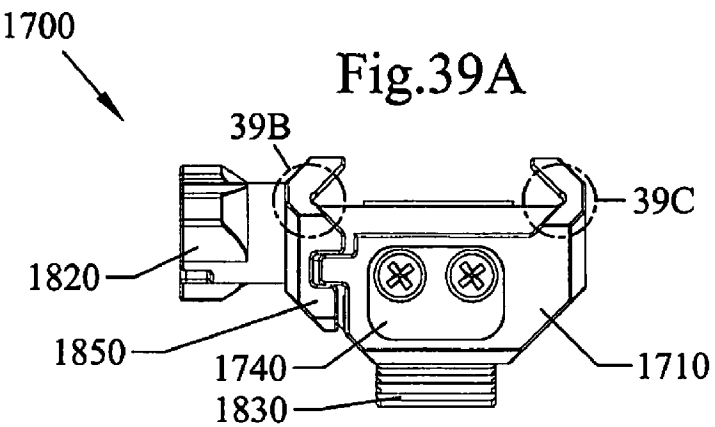
FIG. 39A is a left view of the adapter assembly of FIG. 32.
Figure 39C:
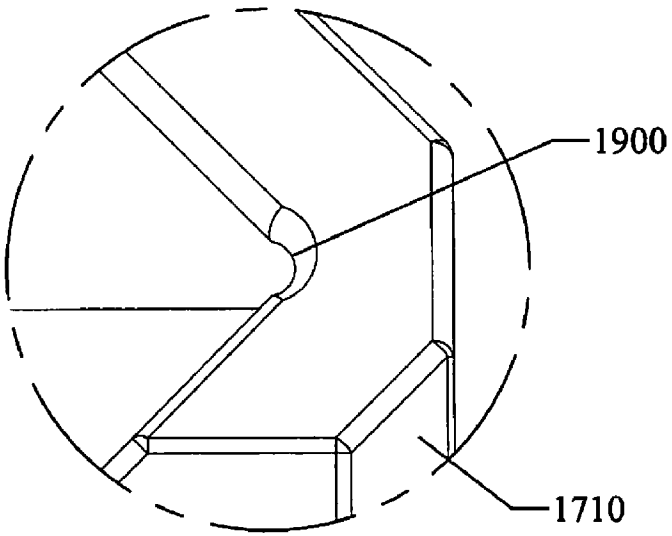
FIG. 39C is another radial slot cut in clamping apex to relieve mechanical clamping stress.
Figure 39B:
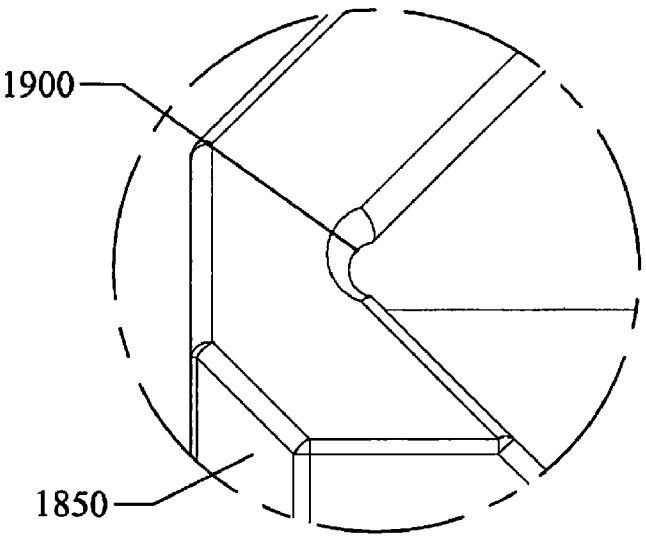
FIG. 39B is an enlarged view of a portion of the adapter assembly of FIG. 39A showing radial slot cut in clamping apex to relieve mechanical clamping stress.
Figure 41:
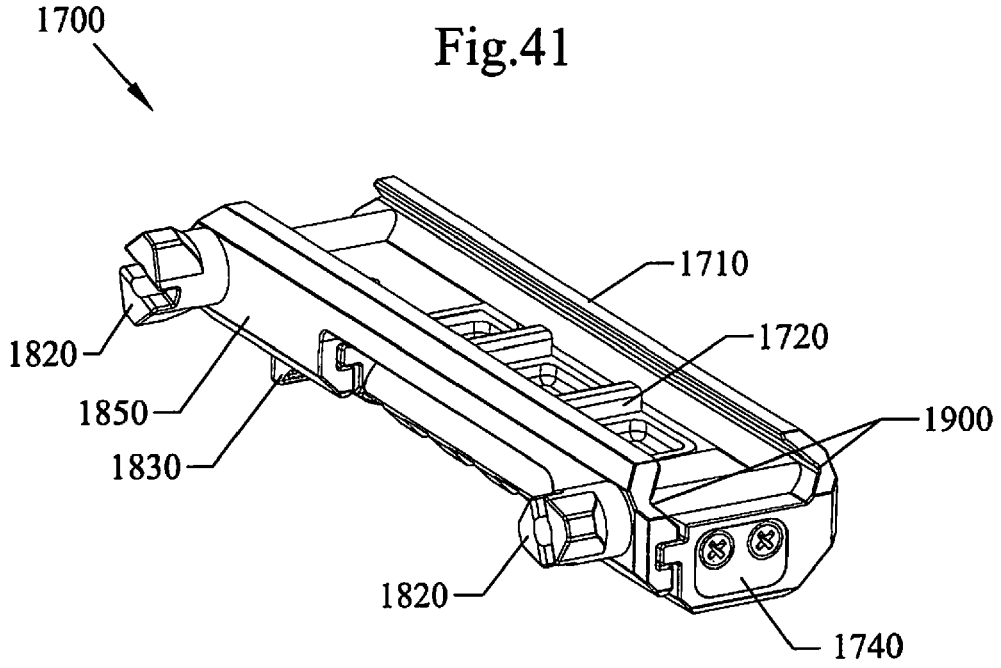
FIG. 41 is a front top perspective view of the adapter assembly of FIG. 32 with a long clamp.
Figure 42:
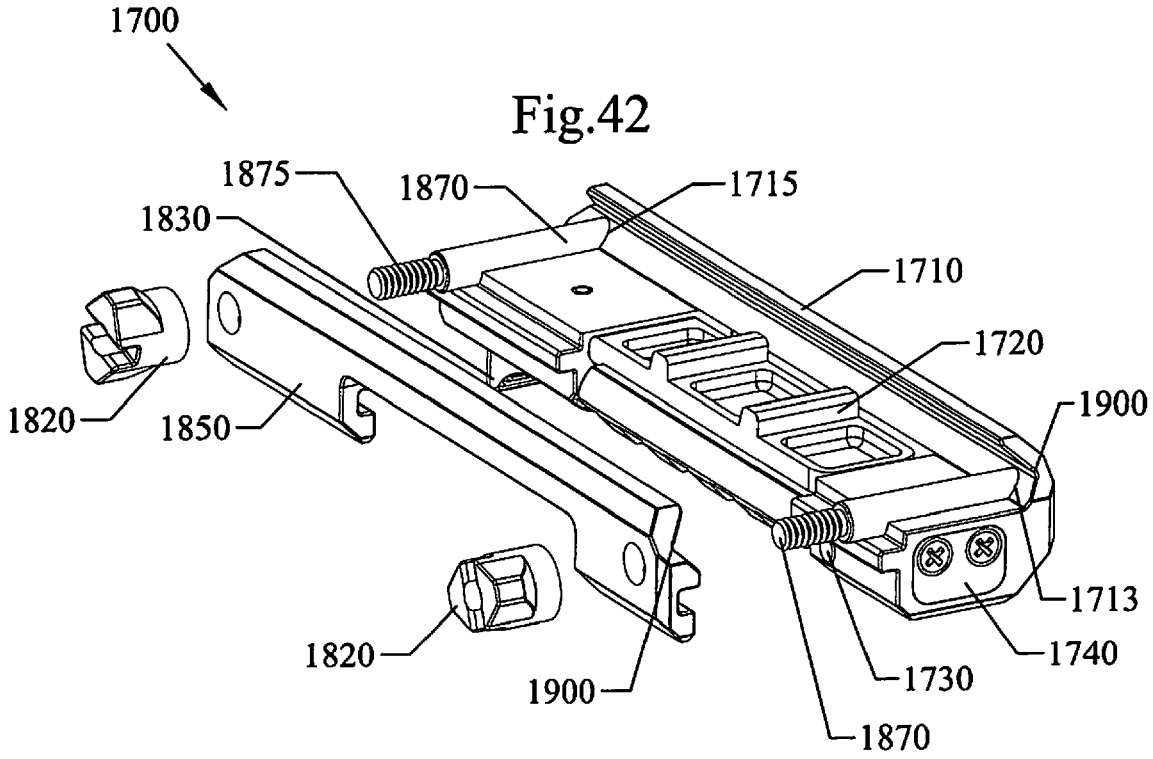
FIG. 42 is a front top perspective view of the adapter assembly of FIG. 32 with exploded long clamp.

1710 Adapter body.
1712 Front end
1713 Front horizontal slot
1715 Rear horizontal slot
1717 Longitudinal slot
1718 Rear end
1719 Cavity with mateable grooved interior walls
1720 Swing plate.
1722. Side edges
1724 bottom of plate with raised flat ribs(four shown)
1725 hinge end
1726 top of plate with raised rounded ribs(two shown)
1727 groove in rounded surface of hinge end 1725
1728 outer ledge catch end
1730 Pivot pin.
1740 Detent plate.
1745 Screw type fasteners
1750 Detent latch.
1752 U-shaped slot
1758 Protruding end
1760 Picatinny rail.
1770 Grip pod assembly.
1780 Adapter assembly with two short clamps.
1790 Gun.
1800 Folding rail assembly.
1810 Folding assembly swing plate.
1815. Hinge
1820 Thumb nuts.
1830 Thumb slide.
1835 Screw type fastener
1840 Plate latch.
1842 Raise side edges of plate latch
1844 Rear end of latch
1845. Slot in latch
1848 Protruding end
1850 Long clamp.
1860 Set screw.
1870 Clamp screws.
1875 Threaded ends.
1880 Short clamp A.
1890 Short clamp B.
1900 Radial stress relief slot.
1910 Slide spring.
1920 Detent spring.
1930 Folding rail body.
1932. Forward End
1933. opening
1935. Base
1937. opening
1938 rearward end
1940 Folding rail swing plate latch.
1942. Rotatable Knob
1945 Protruding edge Adapter Assembly with One Long Clamp FIG. 32 is a front bottom perspective view of another embodiment of the folding stack adapter assembly 1700 with long clamp. FIG. 33 is a rear bottom perspective view of the adapter assembly 1700 of FIG. 32. FIG. 34 is a front top perspective view of the adapter assembly of FIG. 32. FIG. 35 is a rear top perspective view of the adapter assembly 1700 of FIG. 32. FIG. 36 is a top view of the folding stack adapter assembly 1700 of FIG. 32. FIG. 37 is a side view of the folding stack adapter assembly 1700 of FIG. 32. FIG. 38 is a bottom view of the adapter assembly 1700 of FIG. 32. FIG. 39A is a left view of the adapter assembly 1700 of FIG. 32. FIG. 39B is an enlarged view of a portion of the adapter assembly 1700 of FIG. 39A showing radial slot cut in clamping apex to relieve mechanical clamping stress. FIG. 39C is another radial slot cut in clamping apex to relieve mechanical clamping stress. FIG. 40 is a right view of the adapter assembly 1700 of FIG. 32. FIG. 41 is a front top perspective view of the adapter assembly 1700 of FIG. 32 with a long clamp 1850. FIG. 42 is a front top perspective view of the adapter assembly 1700 of FIG. 32 with exploded long clamp 1850.

Figure 45:
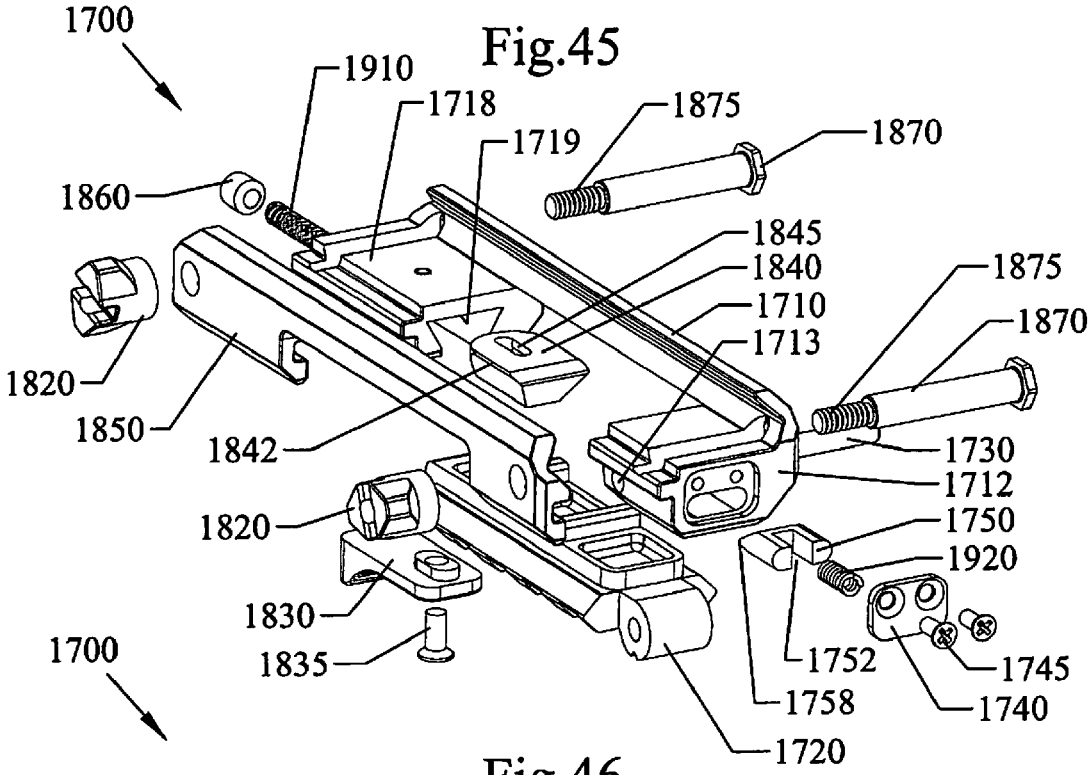
FIG. 45 is an exploded top front perspective view of the adapter assembly with long clamp.
Figure 46:
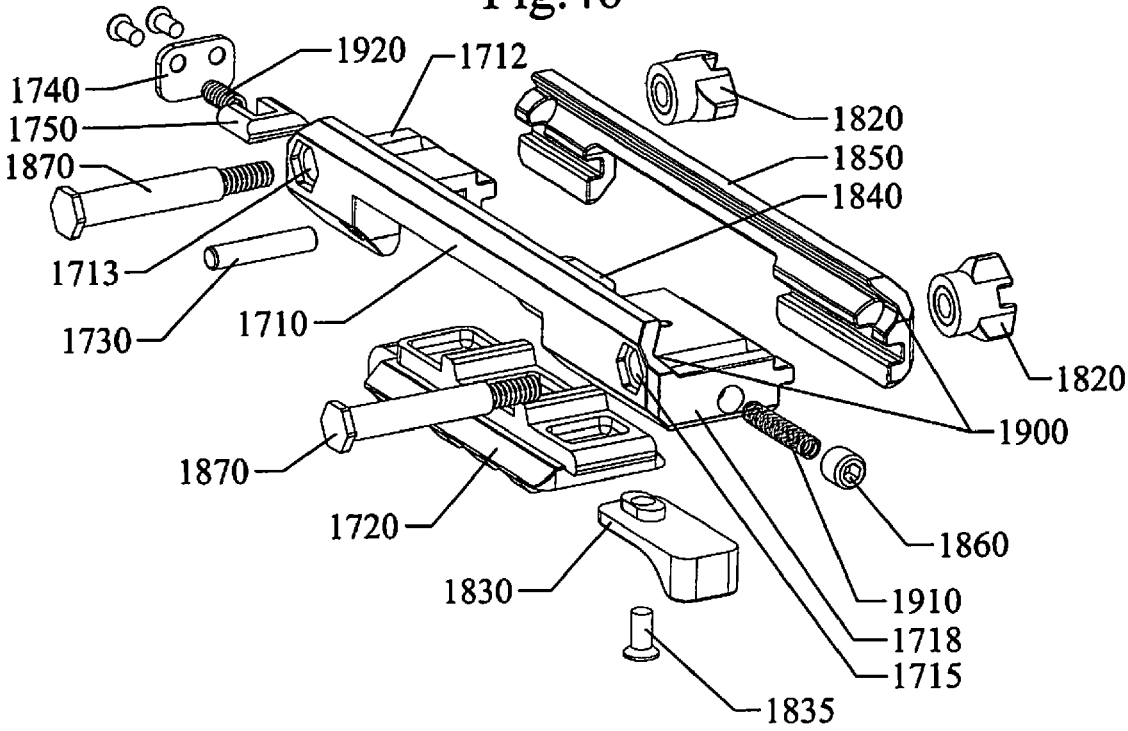
FIG. 46 is an exploded top rear perspective view of the adapter assembly of FIG. 45 with long clamp.
Figure 47:
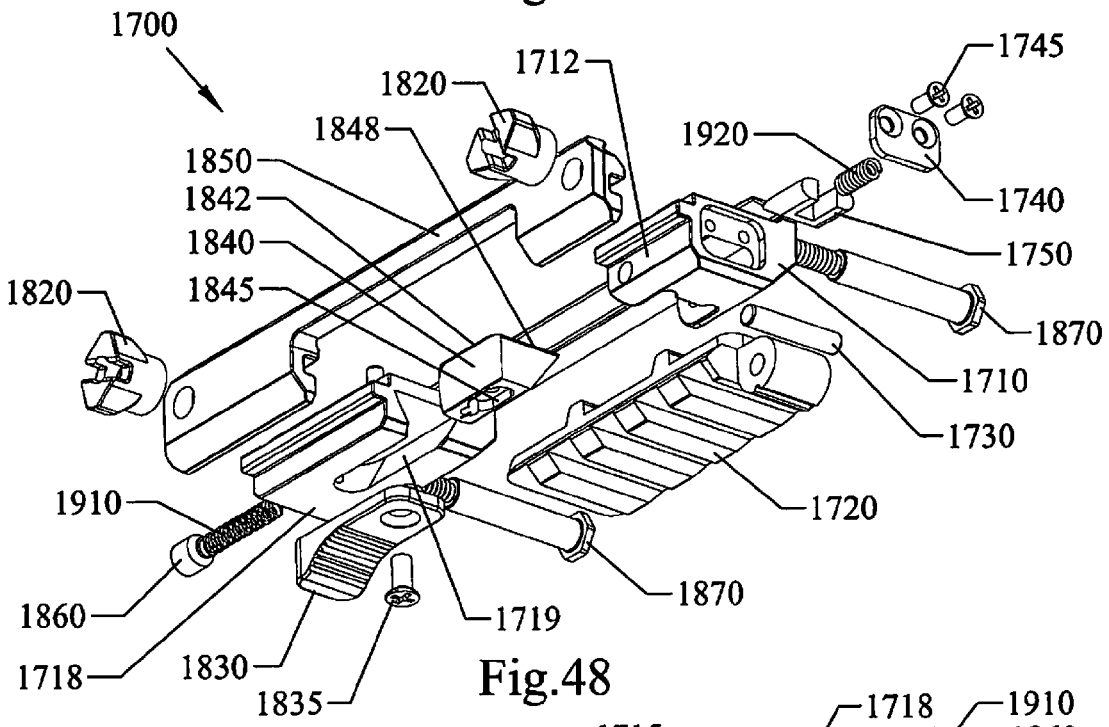
FIG. 47 is an exploded bottom front perspective view of the adapter assembly of FIG. 45 with long clamp.
Figure 48:
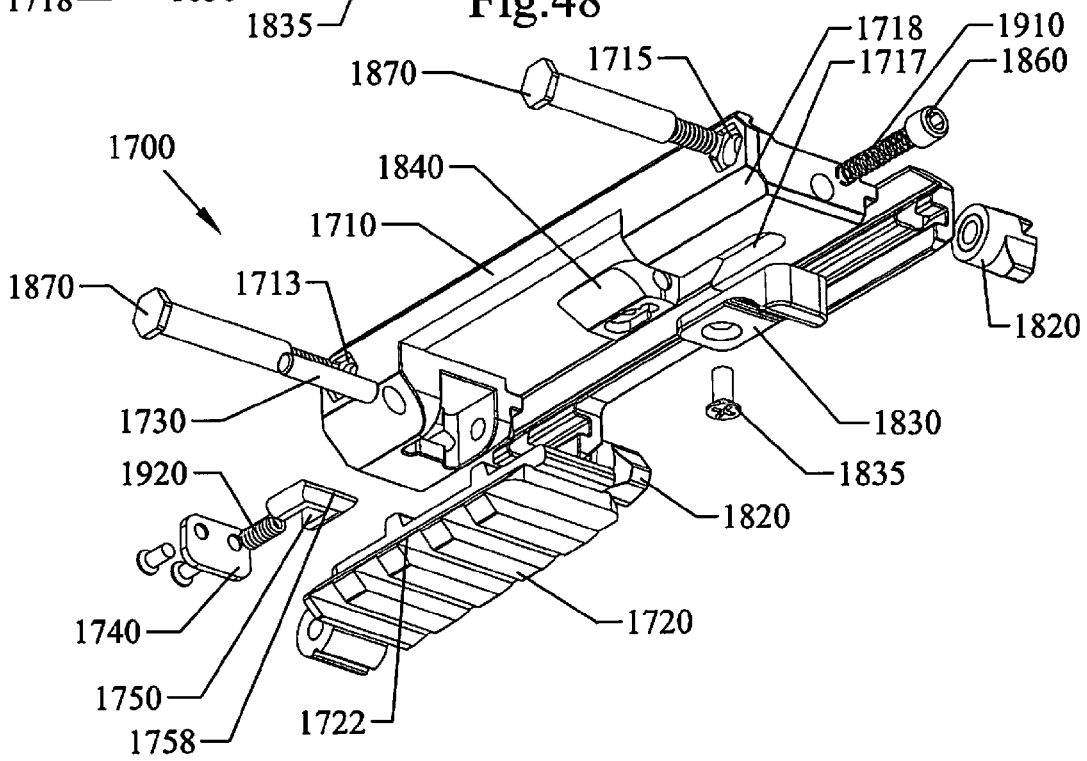
FIG. 48 is an exploded bottom rear perspective view of the adapter assembly of FIG. 45 with long clamp.
Figure 49:
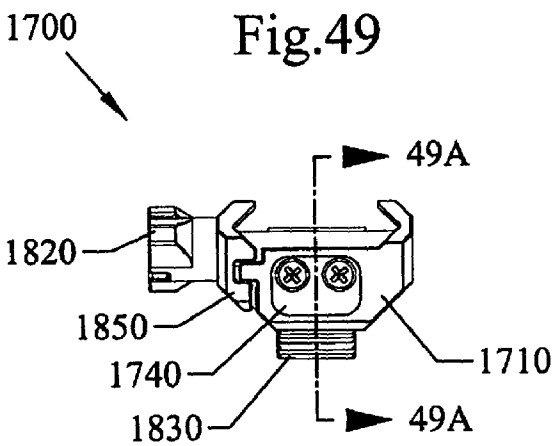
FIG. 49 is an end view of the adapter assembly of FIG. 45 with long clamp.
Figure 49A:
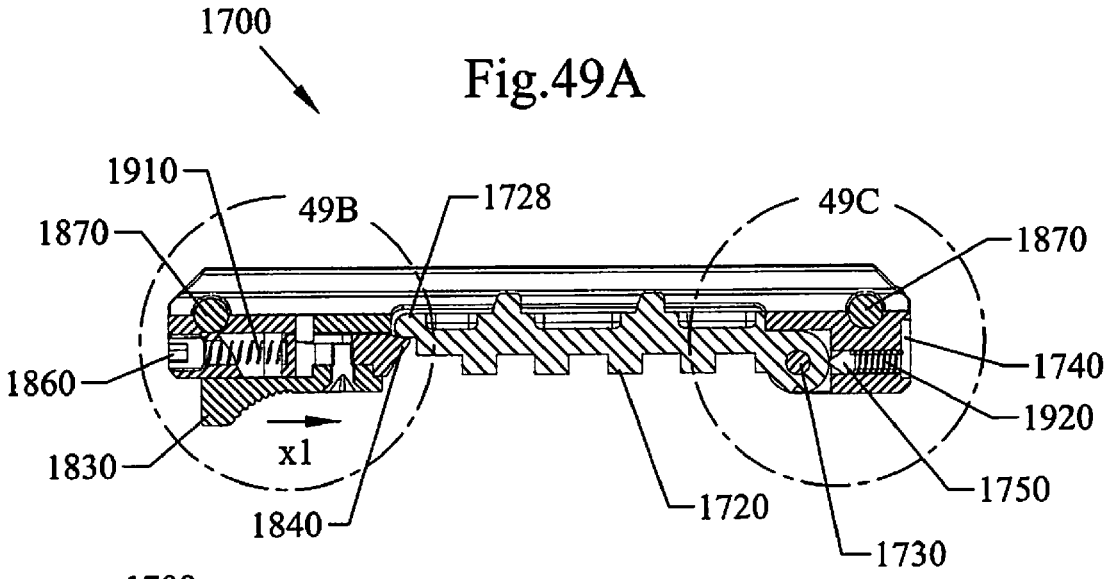
FIG. 49A is a cross-sectional view of the adapter assembly of FIG. 45 with pivot rail up.

FIG. 45 is an exploded top front perspective view of the adapter assembly with long clamp. FIG. 46 is an exploded top rear perspective view of the adapter assembly of FIG. 45 with long clamp. FIG. 47 is an exploded bottom front perspective view of the adapter assembly of FIG. 45 with long clamp. FIG. 48 is an exploded bottom rear perspective view of the adapter assembly of FIG. 45 with long clamp 1850. FIG. 49 is an end view of the adapter assembly of FIG. 45 with long clamp 1850. FIG. 49A is a cross-sectional view of the adapter assembly of FIG. 45 with pivot rail up.

Figure 50:
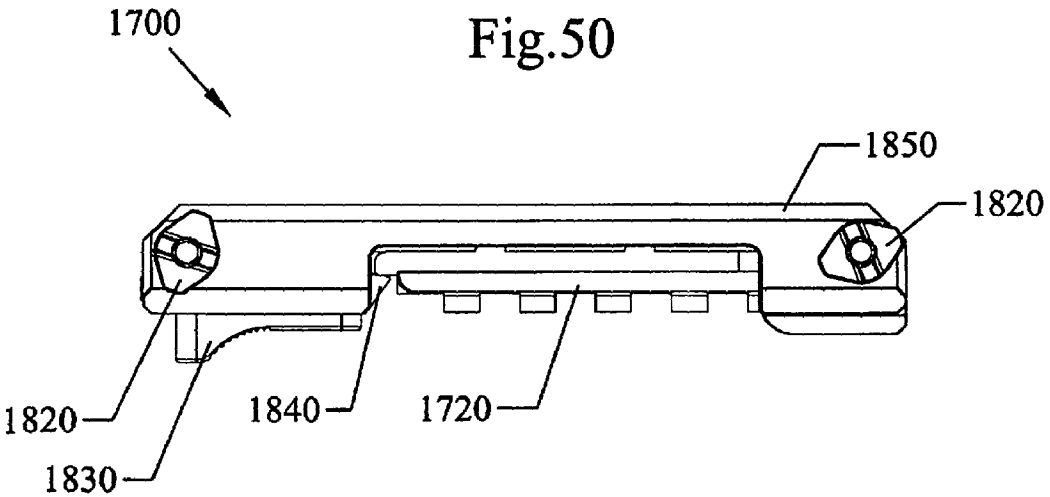
FIG. 50 is a side view of the adapter assembly.
Figure 51A:
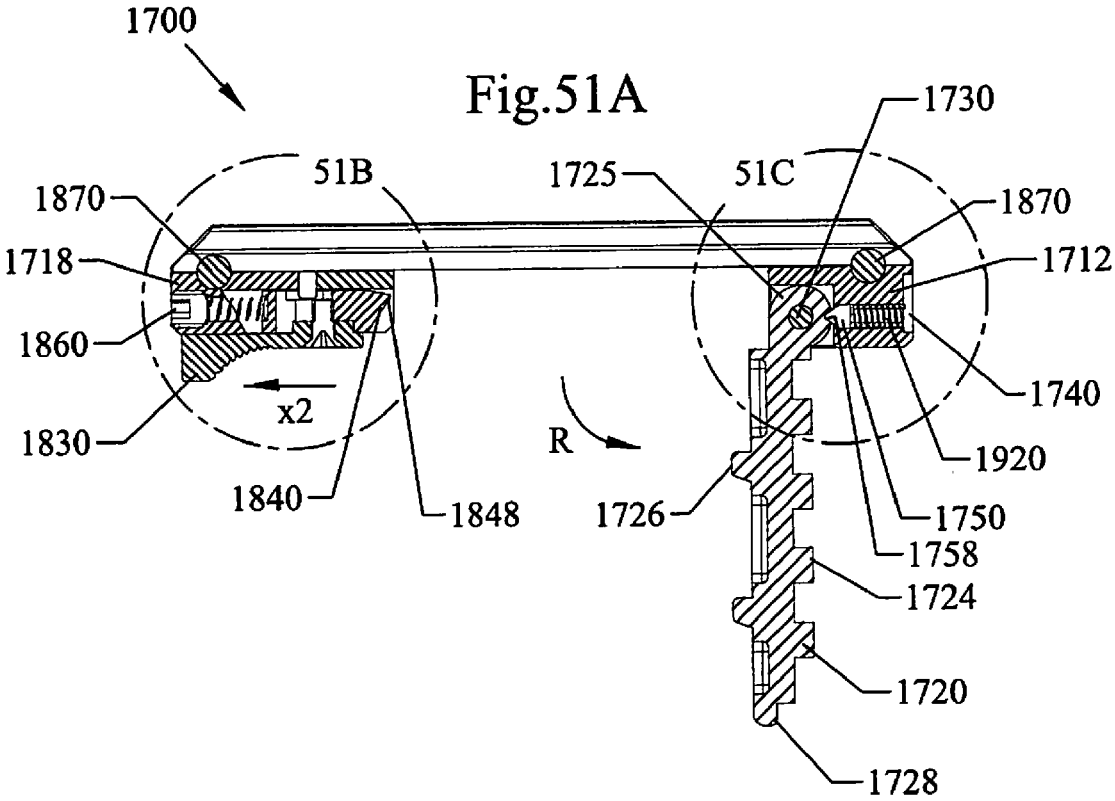
FIG. 51A is a cross-section view of the adapter assembly of FIG. 49A with pivot rail down.
Figure 49B:
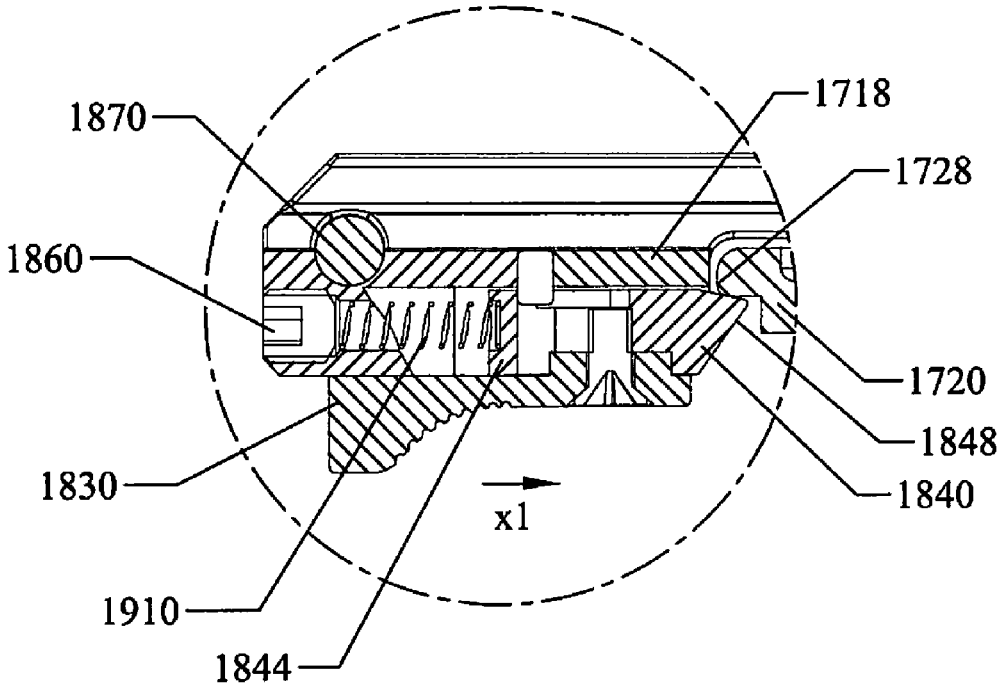
FIG. 49B is an enlarged view of the thumb slide of FIG. 49A.
Figure 51B:
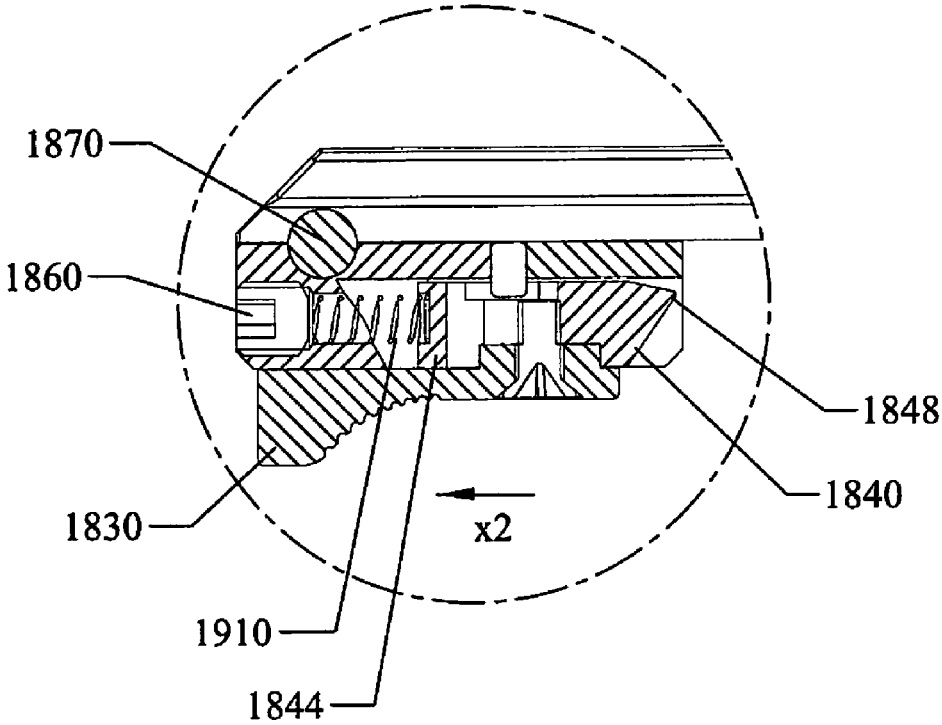
FIG. 51B is another view of the thumb slide of FIG. 49B with pivot rail down.
Figure 49C:
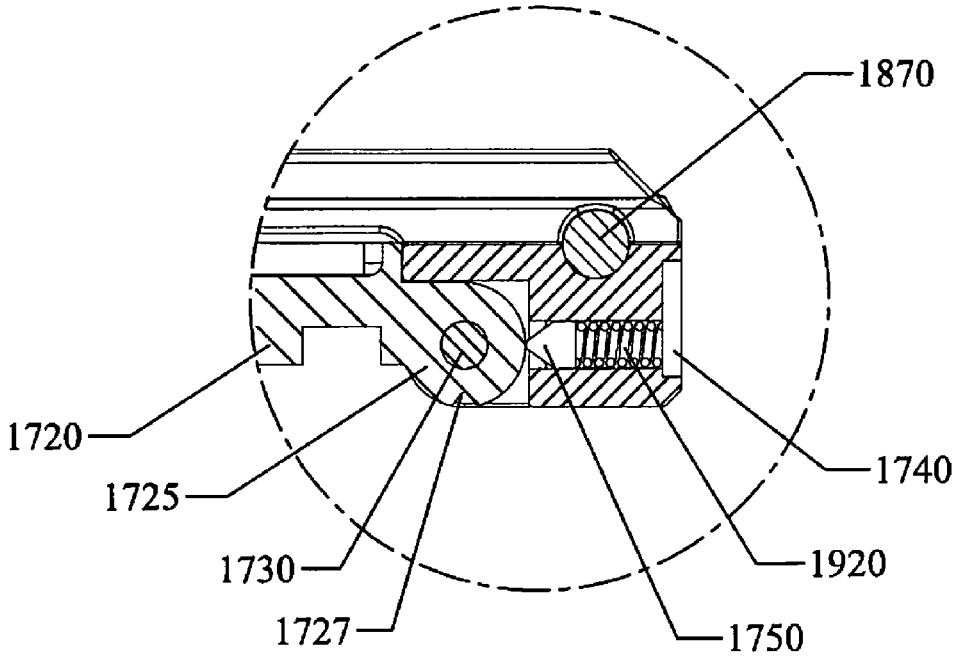
FIG. 49C is an enlarged view of the detent latch of FIG. 49B.
Figure 51C:
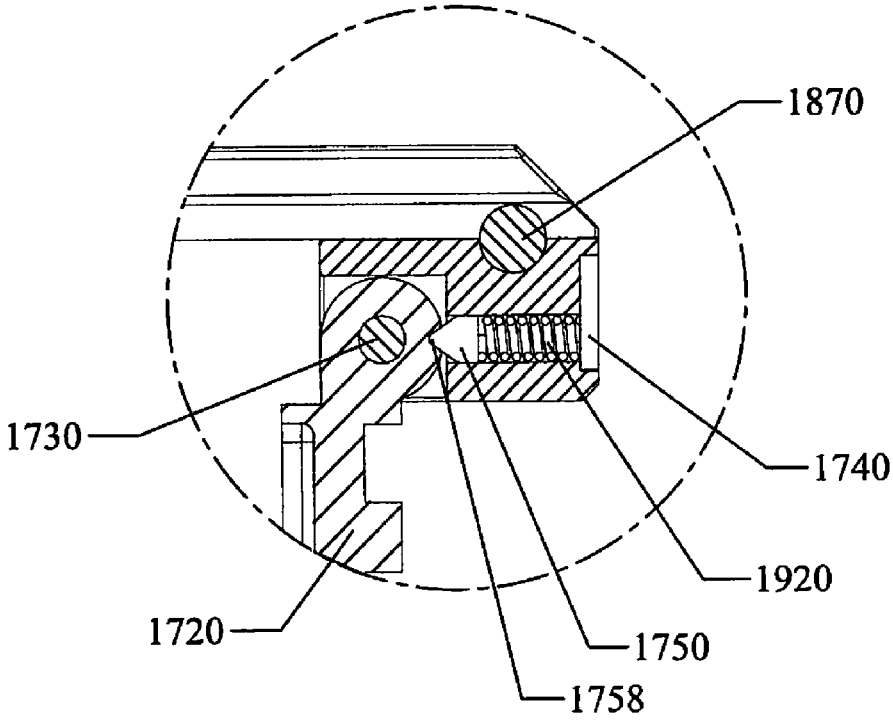
FIG. 51C is another view of the detent latch of FIG. 49C with pivot rail down.
Figure 52:
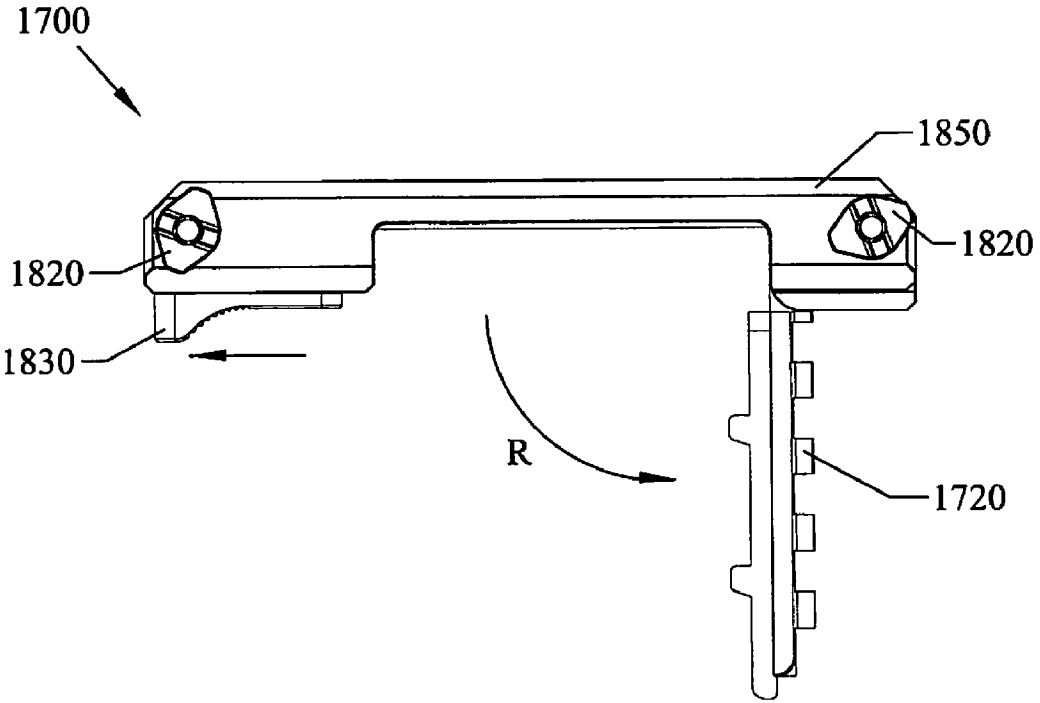
FIG. 52 is a side view w/pivot rail down.
Figure 51:
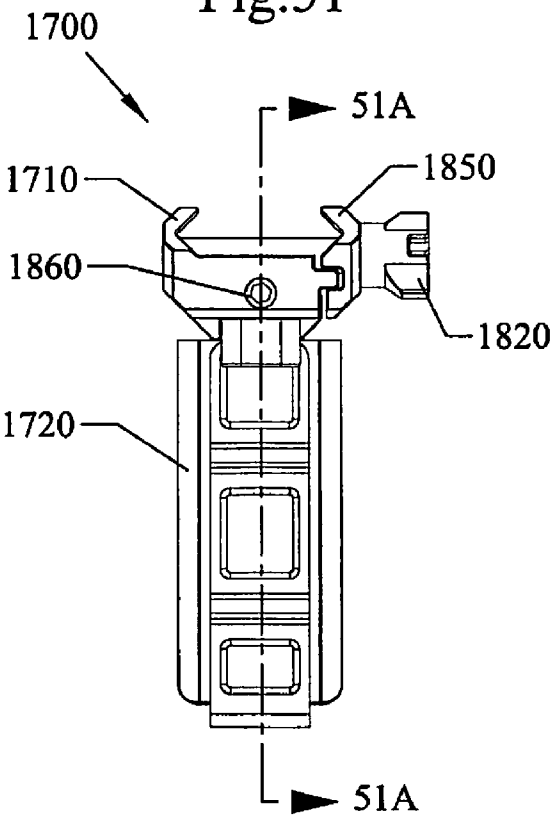
FIG. 51 is a side view of the adapter assembly with swing plate down.

FIG. 49B is an enlarged view of the thumb slide of FIG. 49A. FIG. 49C is an enlarged view of the detent latch of FIG. 49B. FIG. 50 is a side view of the adapter assembly. FIG. 51 is a side view of the adapter assembly with swing plate down. FIG. 51A is a cross-section view of the adapter assembly of FIG. 49A with pivot rail down. FIG. 51B is another view of the thumb slide of FIG. 49B with pivot rail down. FIG. 51C is another view of the detent latch of FIG. 49C with pivot rail plate 1720 down. FIG. 52 is a side view w/pivot rail plate 1720 down.

Referring to FIGS. 32-52, an adapter assembly with one long clamp 1700 can include a rectangular adapter body 1710 having a plate type configuration. Located on the bottom the adapter assembly body 1710 can be swing plate 1720 with side edges 1722 similar to the edges of a picatinny rails (shown as 1760 in FIG. 53) that are often attached underneath of a weapon. The pivoting plate 1720 can be located between the front end 1712 and rear end 1718 of the adapter body 1710. The plate 1720 can have a bottom side 1724 with raised flat ribs, and an upper top side 1726 with raised rounded ribs. One end 1725 of the plate 1720 can be pivotally attached by a pivot pin 1730 to a front end 1712 of the adapter body 1710 (see FIG. 51A).

Detent Plate in Front End

In the front end 1712 of the adapter body 1710 can be detente plate 1740 which holds a detent spring 1920 on inner side. See for example, FIGS. 32, 34, 39A, 41-45, 47, 48, 49C, 51C. The detent plate 1740 can be a fixably attached to the front end 1712 of the adapter body 1710 by screw type fasteners 1745. The detent spring 1920 pushes into a U-shaped slot 1752 of the detent latch 1750. The opposite protruding end 1758 is biased toward and against the pivot hinge 1725. The rounded exterior surface of the pivot hinge 1725 allows for the rail plate 1720 to easily rotate downward until the protruding end 1758 locks into groove 1727 in the exterior surface 1725 of the swing plate 1720 so that the pivoting plate 1720 is locked in a substantially vertical orientation relative to the adapter body 1710. (See FIGS. 49A, 49C, 51A, 51C).

To rotate the pivoting plate 1720 back to a horizontal position, the user can press against the pivoting plate, often by grabbing the accessory clamped to the plate such as the foregrip to overcome the spring tension 1920 of the detent plate 1740.

Thumb Slide in Rear End

In the rear end 1718 of the adapter body 1710 can be a thumb slide 1830. See for, example, FIGS. 32, 33, 35, 37, 38, 40, 45, 46, 47, 48. The thumb slide 1830 can have a raised angled surface and be attached to a slot 1845 in plate latch 1840 by a screw type fastener 1835 (See FIGS. 45, 47, 48). The plate latch 1840 can have raised side edges 1842 form a dovetail shape that allows the plate latch 1840 to slide within a matching grooves inside of dovetail shaped cavity 1719 in rear end 1718 of the adapter body 1710. A longitudinal slot 1717 along the longitudinal axis of the rear end 1718 allows for the thumb slide 1830 to slide relative to the rear end 1718. (See FIGS. 45, 47, 48).

The freely moving protruding end 1848 of the plate latch 1840 when pushed by the thumb slide 1830 in the direction of arrow X1 can latch onto and catch the outer ledge catch step-shaped end 1728 of the freely moving end of the swing plate 1720. The upper surface of the protruding end 1848 can be sloped at an angle so as to lift against the catch step-shaped end 1728 of the swing plate 1720. The spring 1910 pushes the sloped surface of protruding end 1848 so that it takes up any play between itself and the catch step-shaped end 1728. This play can exist based due to manufacturing tolerances and/or regular wear of these parts. See for example, FIGS. 49A, 49B, 51A, 51B.

The rear end 1844 of the plate latch 1840 can push against a slide spring 1910 and the length adjustable set screw 1860 so that the protruding end 1848 of the plate latch 1840 is being pushed in the direction of arrow X1. The spring is sandwiched between the set screw 1860 and the rear end 1844 of the plate latch 1840. By not fully seating the screw 1860 against the spring 1910, the tension of the spring 1910 can be adjusted. Tightening the length adjustable set screw 1860 can further lock the protruding end 1848 of the plate latch against the outer ledge catch end 1728 of the swing plate 1720. Loosening the set screw 1860 can allow for the thumb slide 1830 to more easily slide in place. The user can release the swing plate 1720 from a horizontal position and rotate in the direction of arrow R, by pushing the thumb slide 1830 in the direction of arrow X2, shown in FIGS. 51, 51A, 51B, 52.

A pair of clamp screws 1870 can pass through horizontal slots (1713 in the front end, and horizontal slot 1715 in the rear end 1718 of the adapter body 1710. See for example, FIGS. 39A, 39B, 39C, 40, 45-48. The threaded ends 1875 of the clamp screws 1870 are held against the long clamp 1850 by respective thumb nuts 1820. A radial stress relief slot 1900 can be formed between the long clamp 1850 side and the opposite side of the adapter body 1710. The radial stress relief slot 1900 has interior facing groove side walls that allow for the adapter assembly to wrapped about picatinny rails underneath of a weapon. A user can loosen the thumb nuts 1820 to allow the adapter assembly 1700 to slide about the picatinny rails 1760 underneath a weapon 1790, such as a gun.

Figure 53:
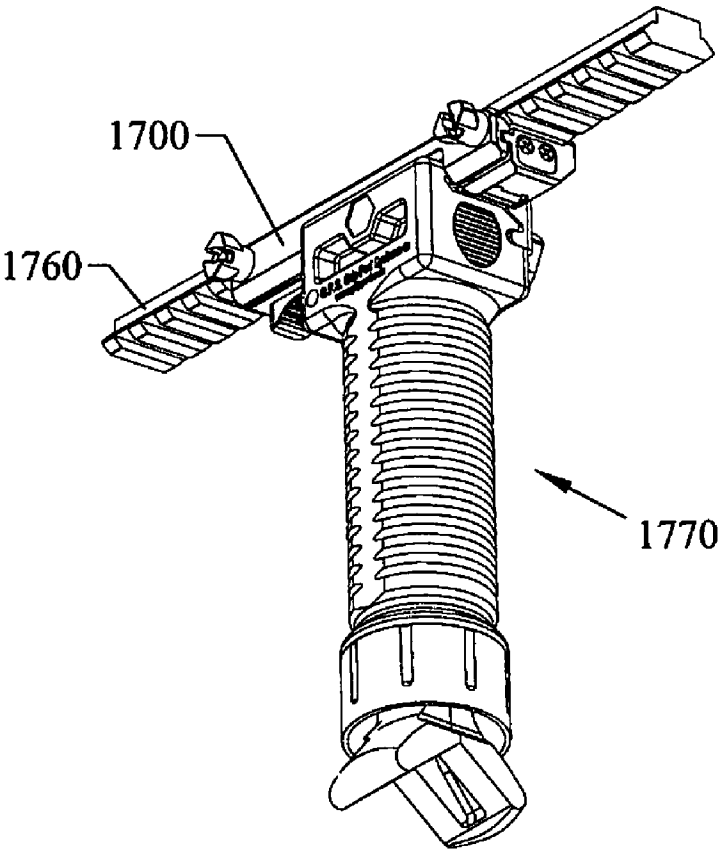
FIG. 53 is a bottom front perspective view of the adapter assembly of the preceding figures with picatinny rail and foregrip with collapsible bipod legs.

FIG. 53 is a bottom front perspective view of the adapter assembly 1700 of the preceding figures with picatinny rail 1760 and foregrip 1770 with collapsible bipod legs. Such a foregrip with collapsible bipod legs can include ones such as those shown and described in U.S. Pat. Nos. D566,219; 7,111,424; 7,409,791; and 7,490,429 to the same assignees of the subject invention, and which are all incorporated by reference.

Figure 54:
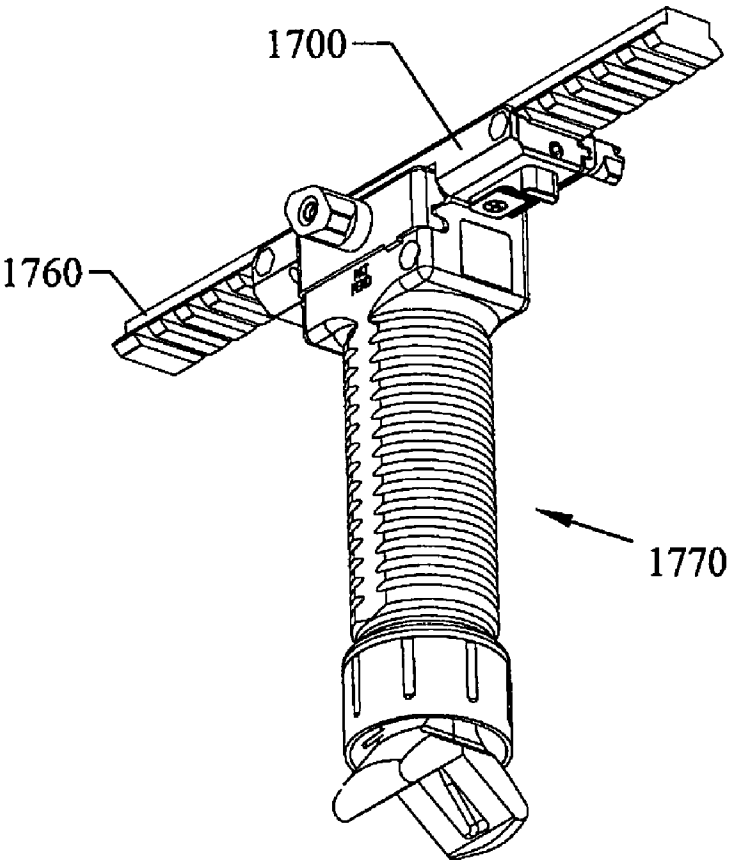
FIG. 54 is a bottom rear perspective view of the adapter assembly with picatinny rail and foregrip with collapsible bipod legs of FIG. 53.
Figure 56:
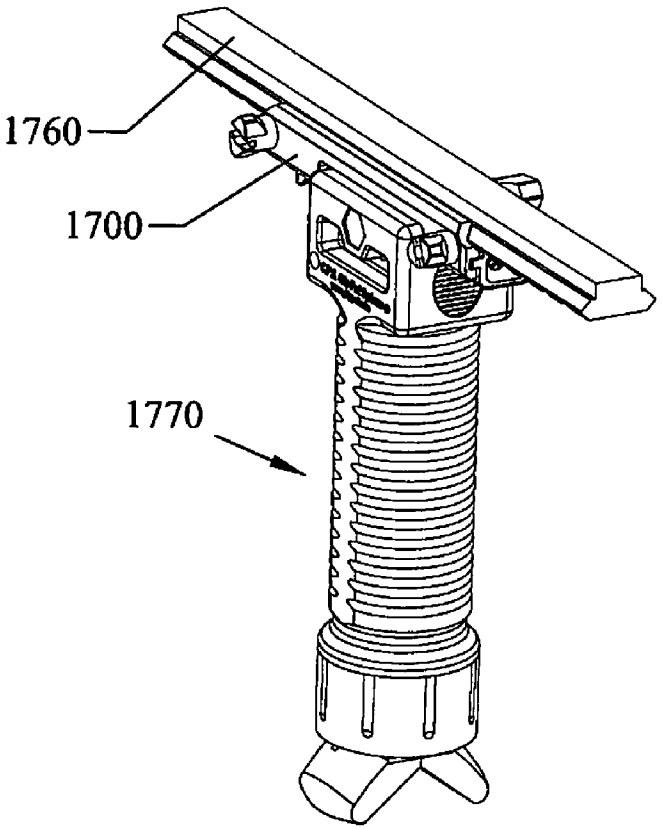
FIG. 56 is a front rear perspective view of the adapter assembly with picatinny rail and foregrip with collapsible bipod legs of FIG. 53.
Figure 55:
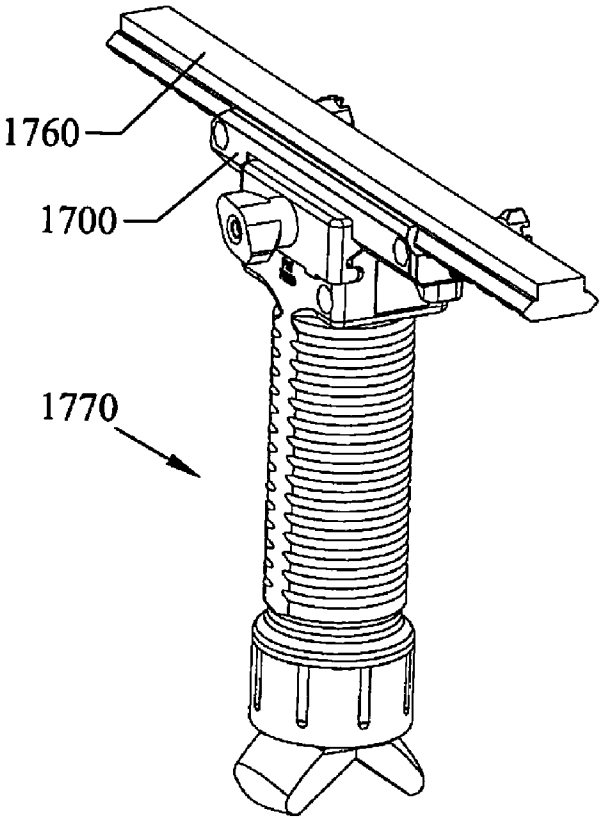
FIG. 55 is a front top perspective view of the adapter assembly with picatinny rail and foregrip with collapsible bipod legs of FIG. 53.
Figure 57:
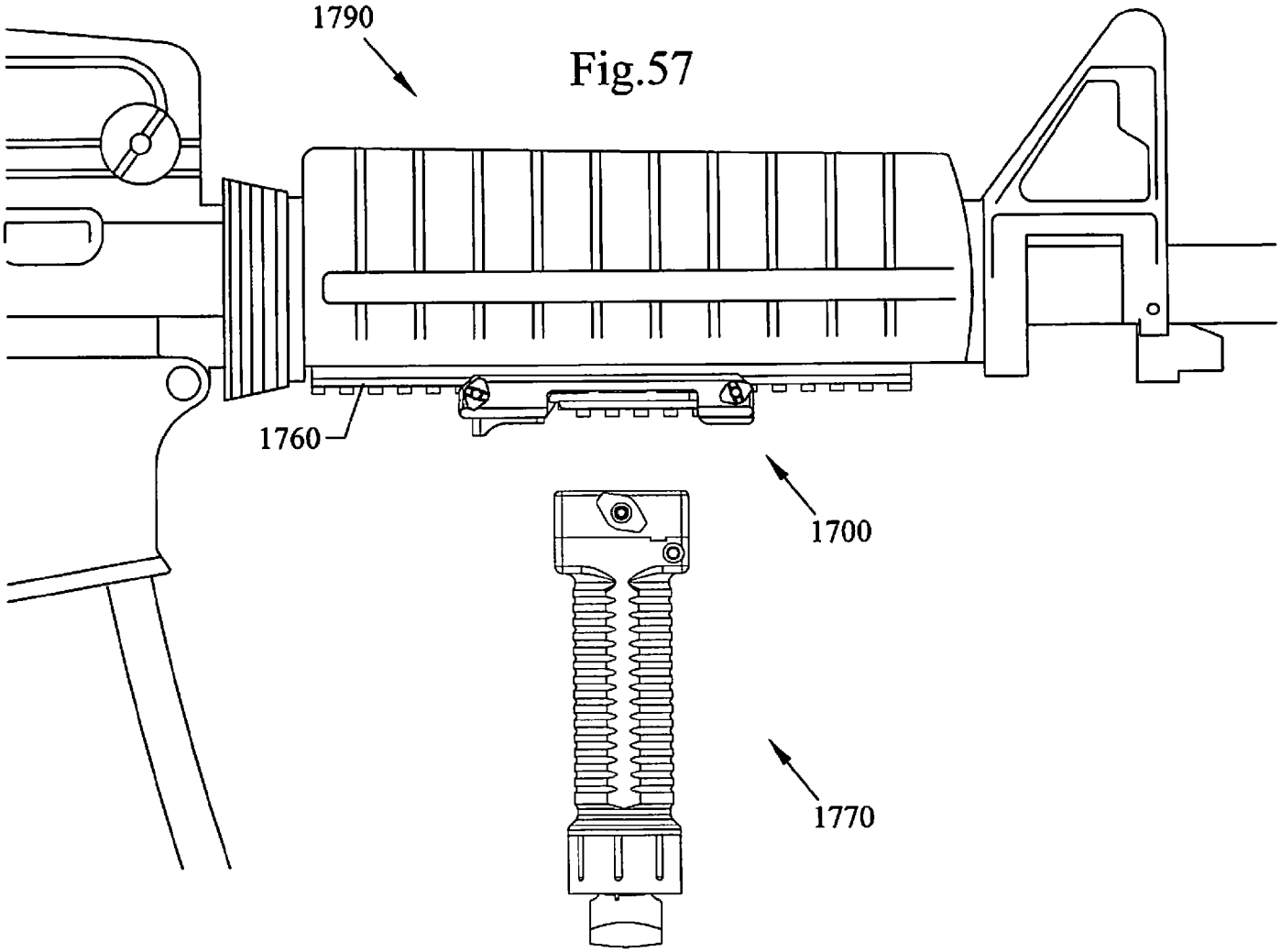
FIG. 57 shows the adapter assembly of the preceding figures locked to a gun's picatinny rail separated from foregrip with collapsible bipod legs.
Figure 58:
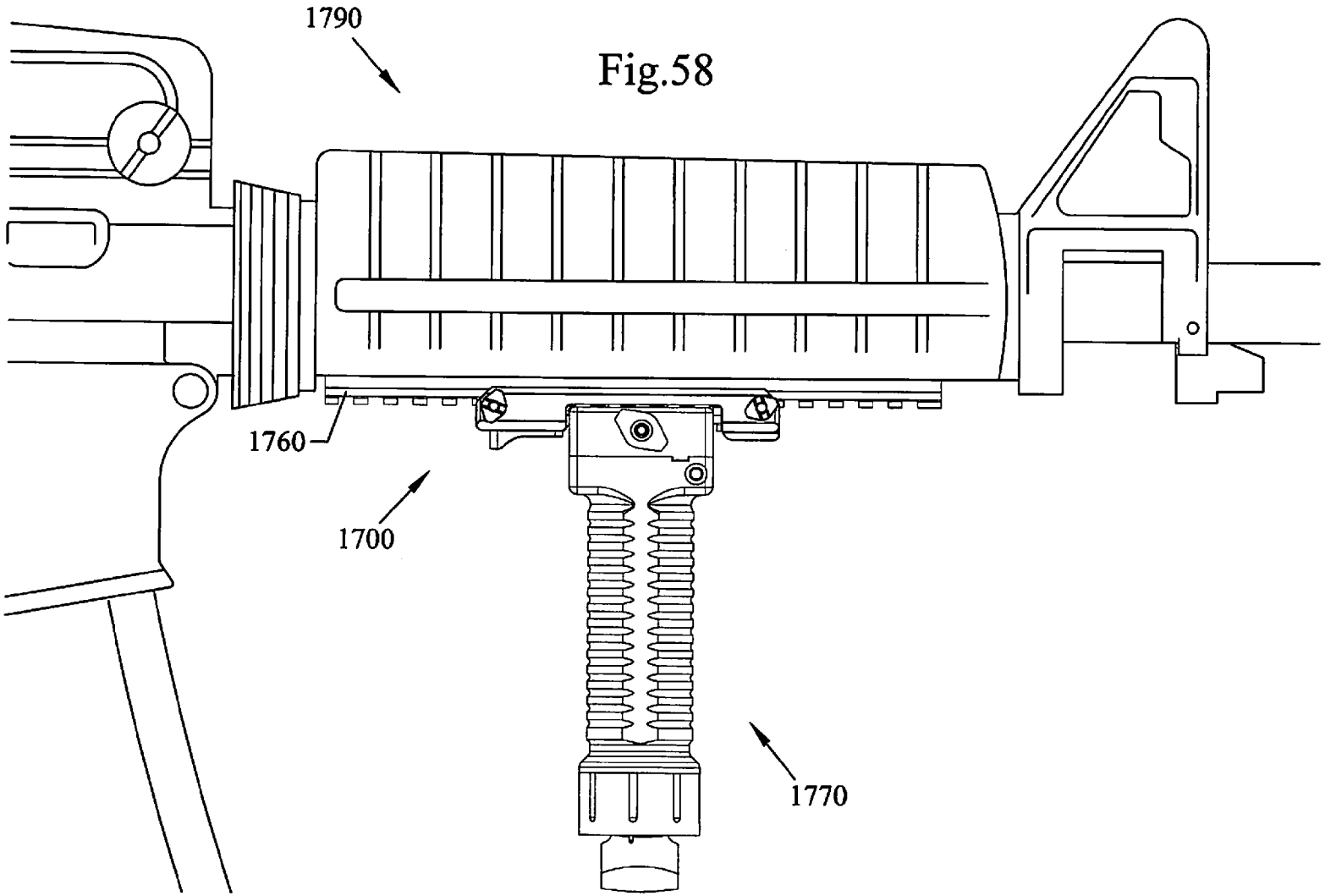
FIG. 58 shows the adapter assembly locked to the gun's picatinny rail of FIG. 57 for foregrip with collapsible legs.
Figure 59:
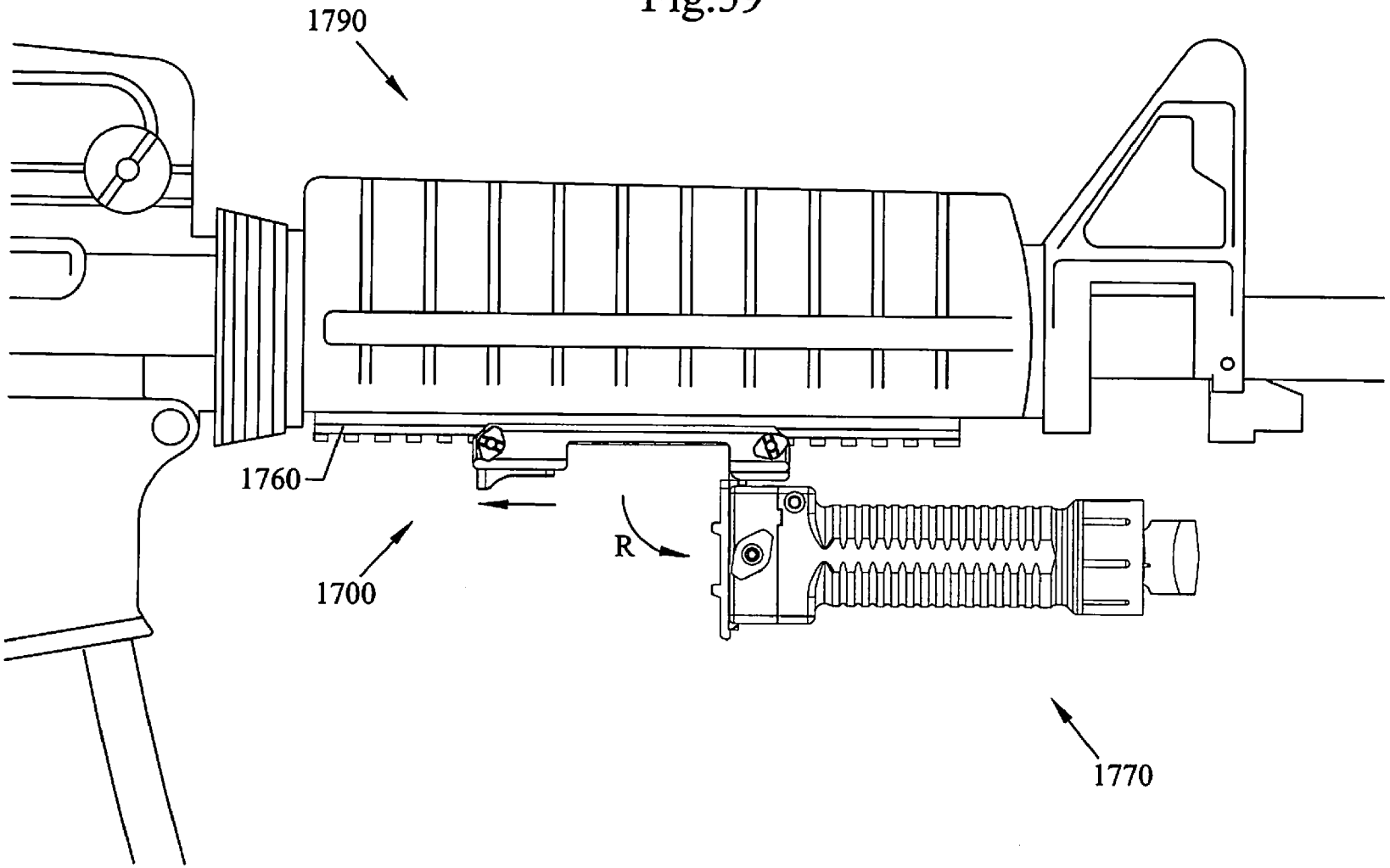
FIG. 59 is another view of the adapter assembly swinging open on an unlatched pivot rail.

FIG. 54 is a bottom rear perspective view of the adapter assembly 1700 attached to a picatinny rail 1760, where the adapter assembly 1700 is attached to a foregrip 1770 with collapsible bipod legs of FIG. 53. FIG. 55 is a front top perspective view of the adapter assembly 1700 with picatinny rail 1760 attached to a foregrip 1770 with collapsible bipod legs of FIG. 53. FIG. 56 is a front rear perspective view of the adapter assembly 1700 attached to picatinny rails 1760, with the adapter assembly 1700 attached to the upper end of a foregrip 1770 with collapsible bipod legs of FIG. 53. FIG. 57 shows the adapter assembly 1700 of the preceding figures locked to a gun's picatinny rail 1760 separated from the foregrip 1770 with collapsible bipod legs. FIG. 58 shows the adapter assembly 1700 locked to the gun's picatinny rail 1760 of FIG. 57 with the adapter assembly 1700 attached to the foregrip 1770 with collapsible legs. FIG. 59 is another view of the adapter assembly 1700 with swing plate 1720 swinging open to an unlatched position.

Adapter Assembly with Two Short Clamps

Figure 43:
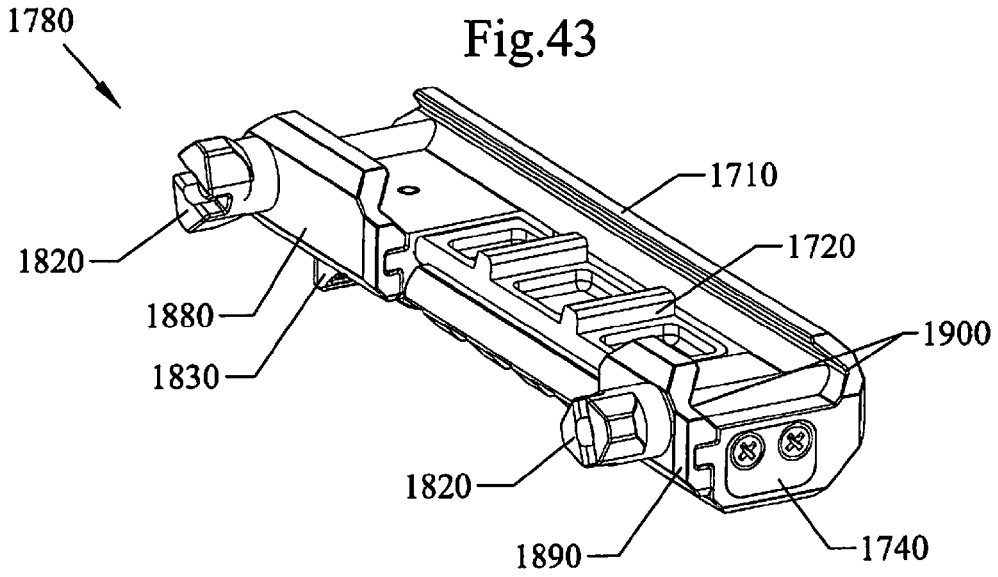
FIG. 43 is a front top perspective view of adapter assembly with two short clamps.
Figure 44:
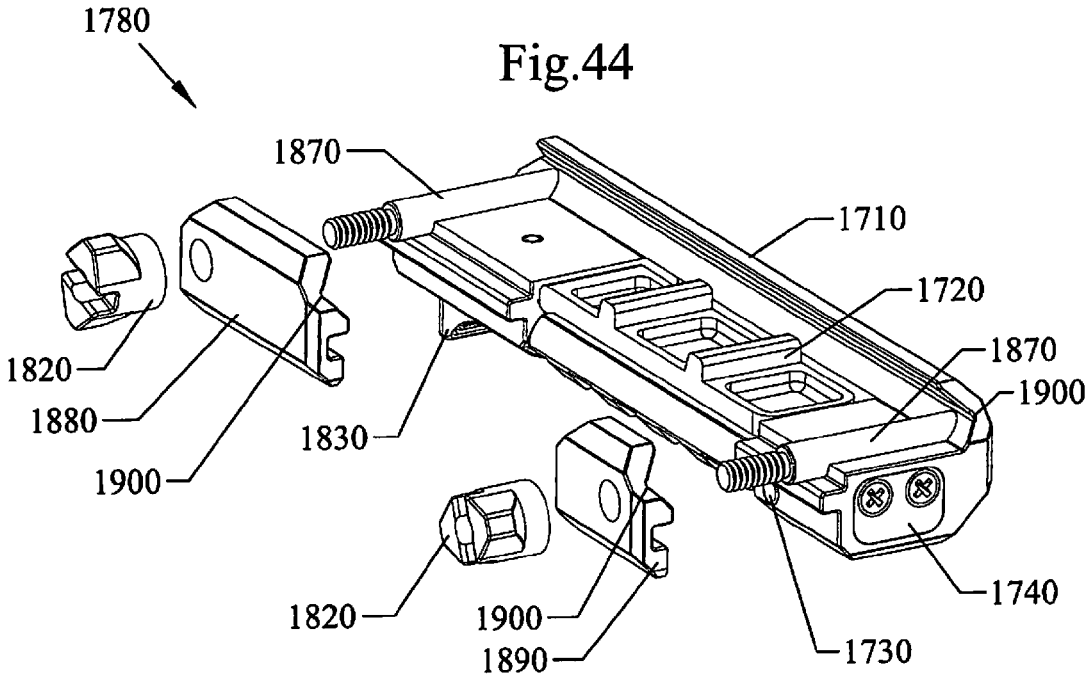
FIG. 44 is a front top perspective view of the adapter assembly of FIG. 32 with exploded short clamps.

FIG. 43 is a front top perspective view of adapter assembly 1780 with two short clamps 1880, 1890. FIG. 44 is a front top perspective view of the adapter assembly 1780 of FIG. 32 with exploded short clamps 1880, 1890. Unlike the previous embodiment, the adapter assembly 1780 has two short clamps 1880, 1890 instead of long clamp 1850. Other than the short clamps 1880, 1890, this embodiment functions similarly to the previous embodiment with long clamp 1850. A radial stress relief slot 1900 is formed between the pair of short clamps 1880, 1890 and opposite side of the adapter body 1710. The two clamps 1880, 1990 together have less weight and less material and be less costly than a single long clamp 1850. Reducing weight of the invention can be desirable in the field where soldiers desire the least amount of weight for their equipment. The single long clamp 1850 can be more stable when attaching about picatinny rails underneath of a firearm.

Folding Rail Assembly

Figure 60:
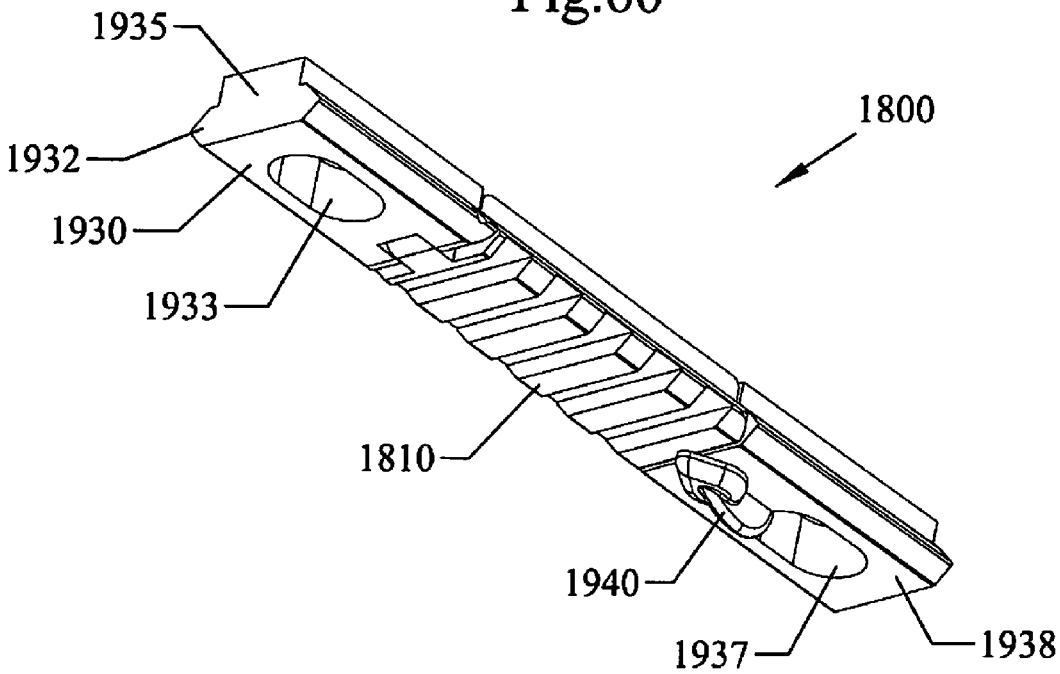
FIG. 60 is a bottom front perspective view of a folding rail assembly.
Figure 61:
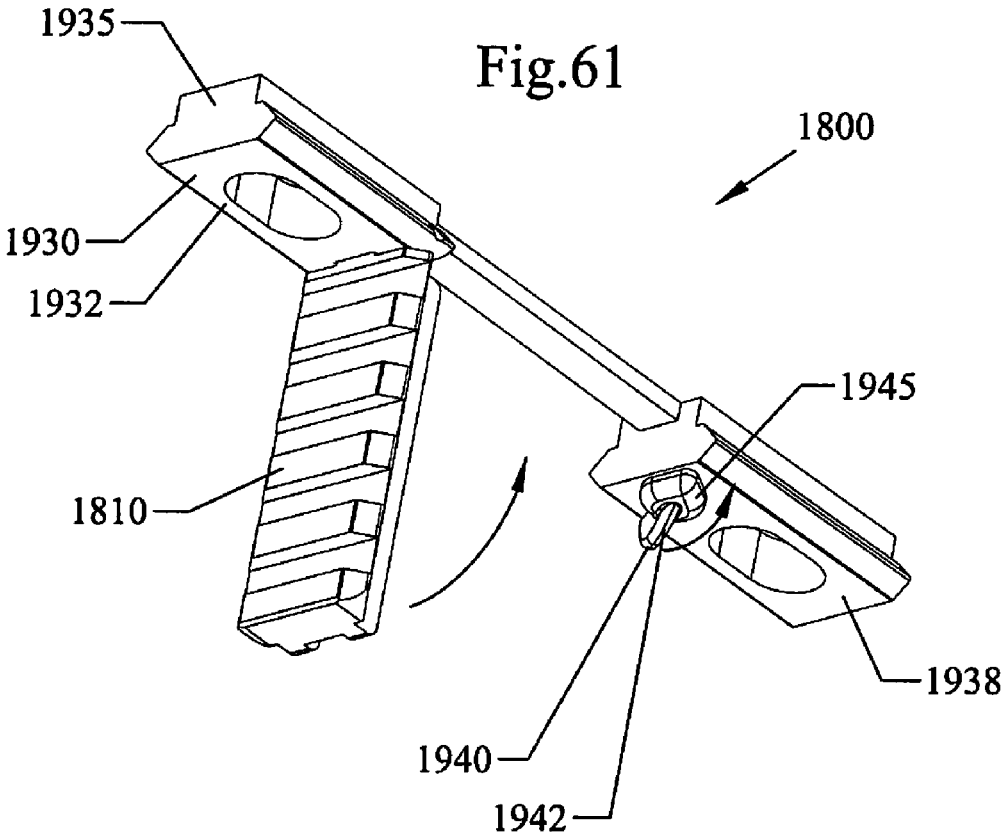
FIG. 61 is a bottom rear perspective view of the folding rail assembly of FIG. 60 with pivot rail down.
Figure 62:
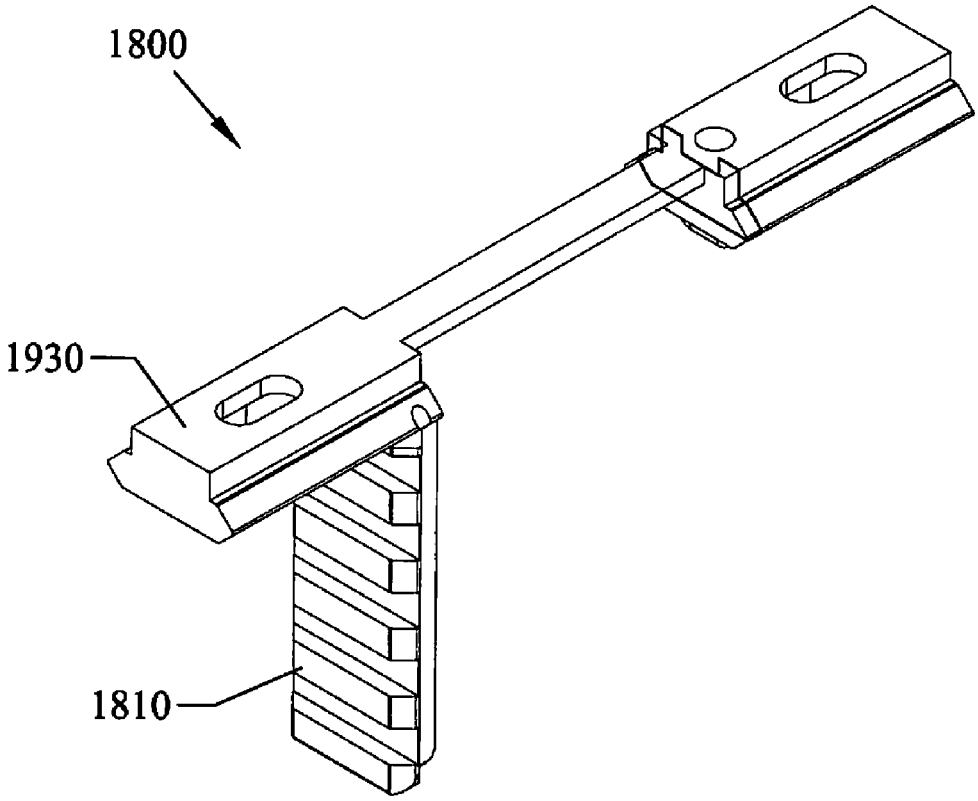
FIG. 62 is a top rear perspective view of the folding rail assembly of FIG. 61 with pivot rail down.
Figure 63:
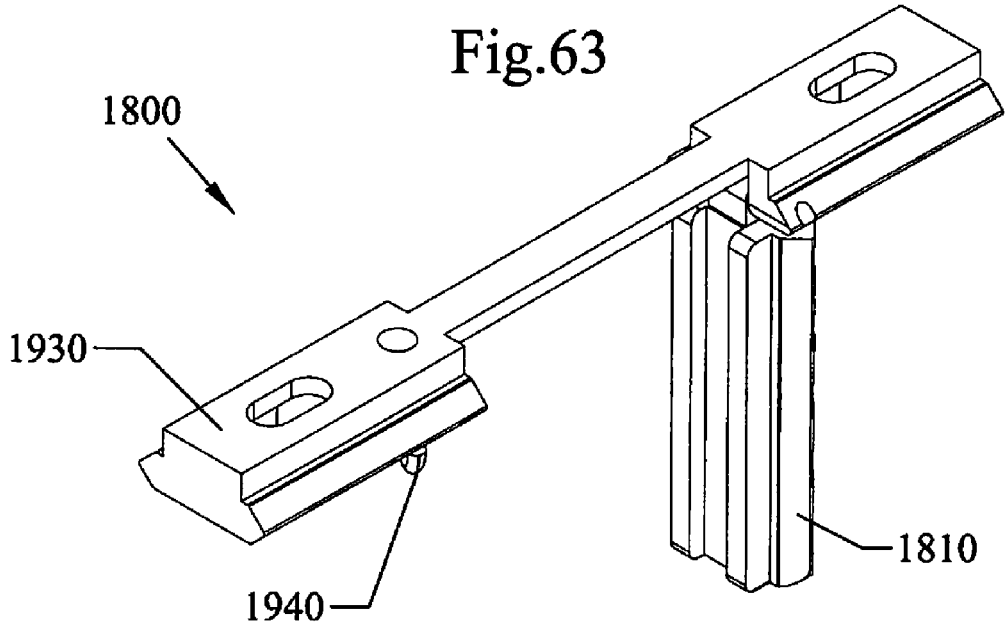
FIG. 63 is another top front perspective view of the folding rail assembly of FIG. 62 with pivot rail down.
Figures 64, 65, 66, 67, 68:
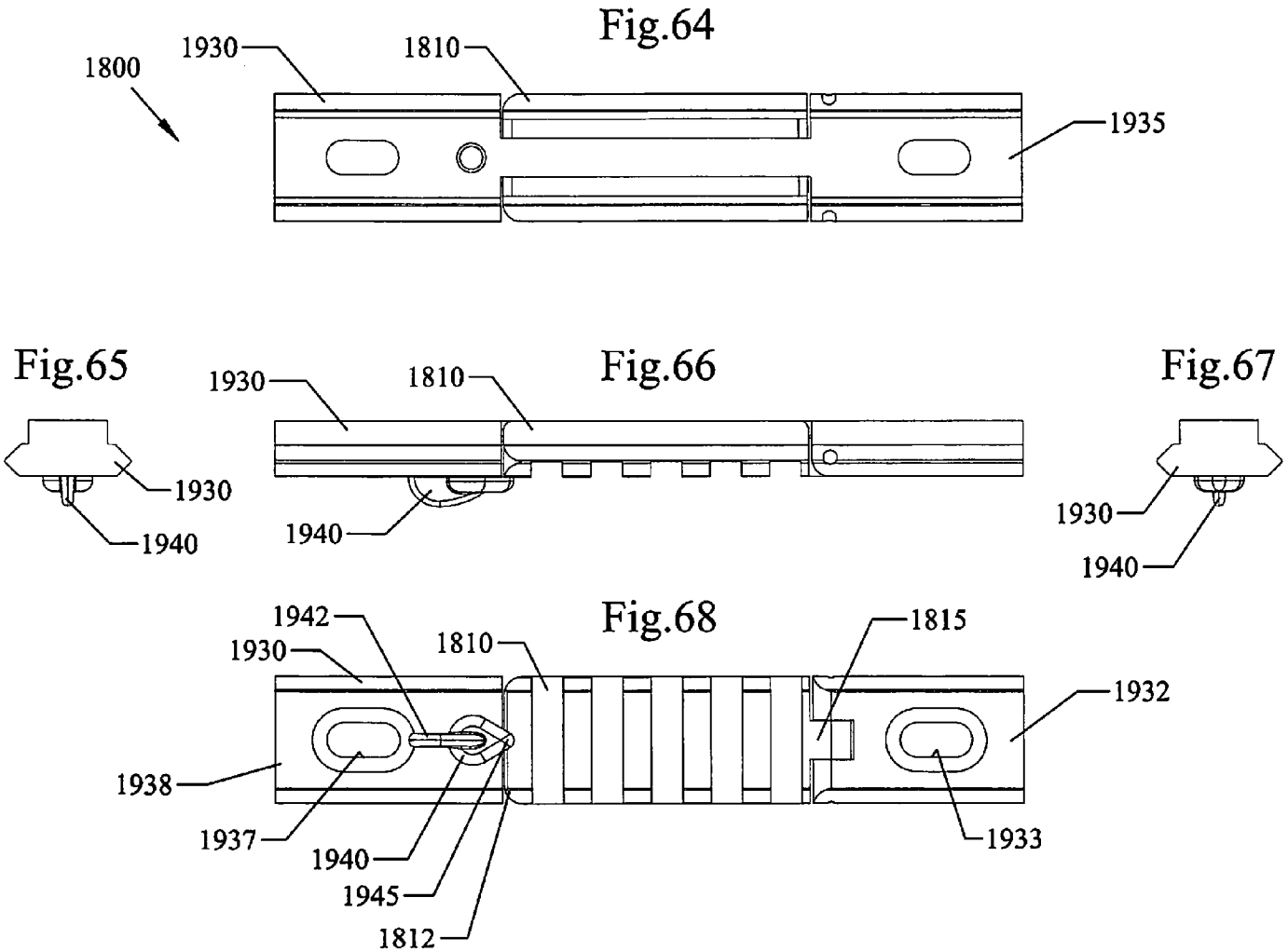
FIG. 64 is a top view of the folding rail assembly of FIG. 60.
FIG. 65 is a left view of the folding rail assembly of FIG. 60.
FIG. 66 is a front view of the folding rail assembly of FIG. 60.
FIG. 67 is a right view of the folding rail assembly of FIG. 60.
FIG. 68 is a bottom view of the folding rail assembly of FIG. 60.

FIG. 60 is a bottom front perspective view of a folding rail assembly 1800. FIG. 61 is a bottom rear perspective view of the folding rail assembly 1800 of FIG. 60 with pivot rail 1810 down. FIG. 62 is a top rear perspective view of the folding rail assembly 1800 of FIG. 61 with pivot rail 1810 down. FIG. 63 is another top front perspective view of the folding rail assembly 1800 of FIG. 62 with pivot rail 1810 down. FIG. 64 is a top view of the folding rail assembly 1800 of FIG. 60. FIG. 65 is a left view of the folding rail assembly 1800 of FIG. 60. FIG. 66 is a front view of the folding rail assembly 1800 of FIG. 60. FIG. 67 is a right view of the folding rail assembly 1800 of FIG. 60. FIG. 68 is a bottom view of the folding rail assembly 1800 of FIG. 60.

Referring to FIGS. 60-68, the folding rail assembly 1800 includes a folding rail body 1930 having a generally planar plate configuration with a foreward end 1932 and a rearward end 1938, each having openings 1933, 1937 for allowing fasteners such as screws and bolts to attach the assembly 1800 to an undersurface of a weapon. In a preferred embodiment both the forward end 1932 and the rearward end 1937 have picatinny type side rails on both sides. In the middle of the assembly 1800 between the forward end 1932 and the rearward end 1937 can be pivotal swing plate 1810 also having picatinny type rails on both sides. A hinge 1815 attaches on end of the swing plate 1810 to the forward end 1932. A swing plate latch 1940 can be on the rearward end 1938 of the rail assembly 1800. The latch 1940 can be rotatable by a raised knob 1942 that allows for an extended portion 1945 to be over the free end 1812 of the swing plate 1810.

On the top of the rail assembly 1800 can be a longitudinal base 1935 having a generally flat surface for allowing the rail assembly to sit flush against the undersurface of a firearm.

Figure 69:
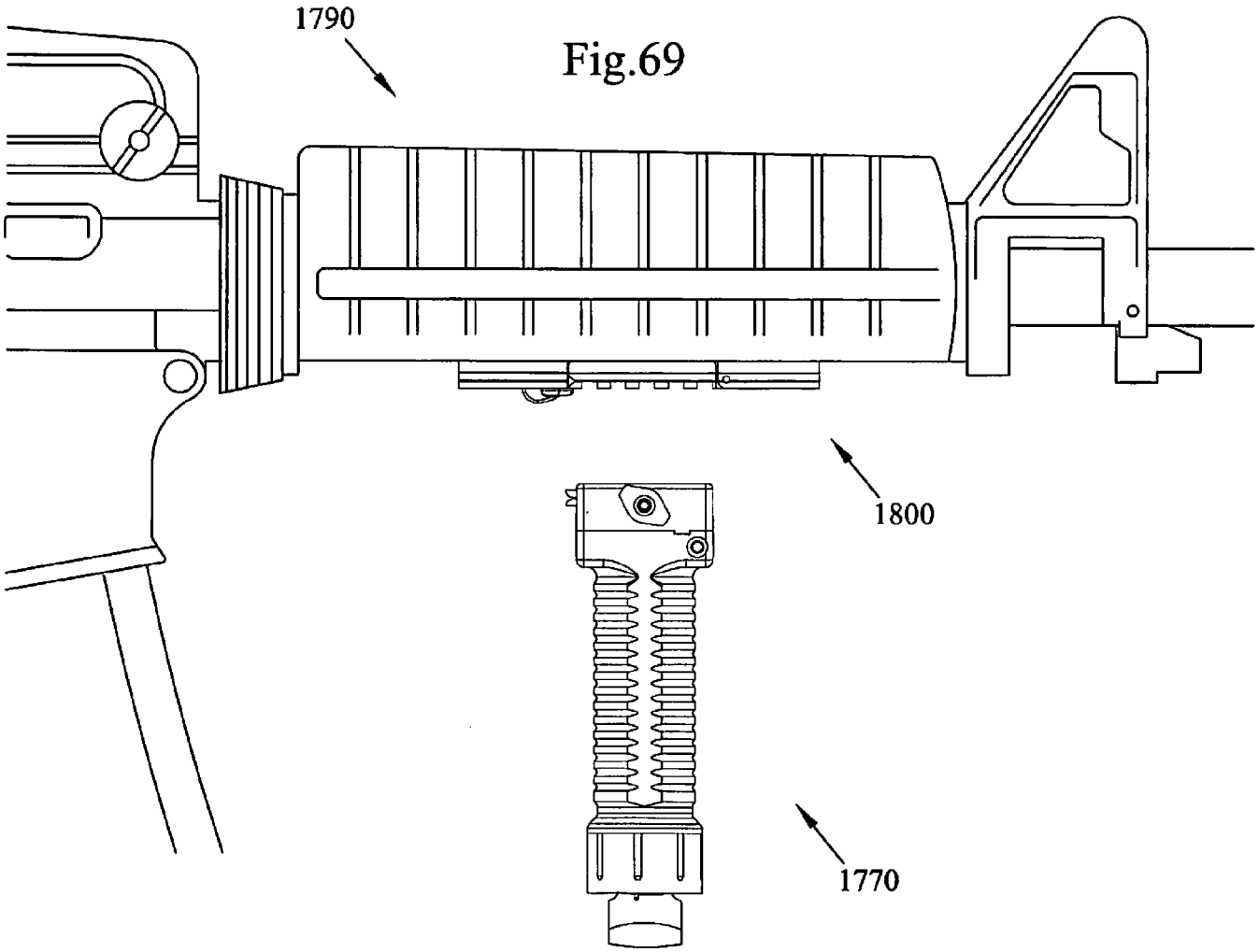
FIG. 69 shows a folding rail assembly being used to replace stock picatinny rail supplied with a gun, and detached foreward grip with collapsible bipod legs.
Figure 70:
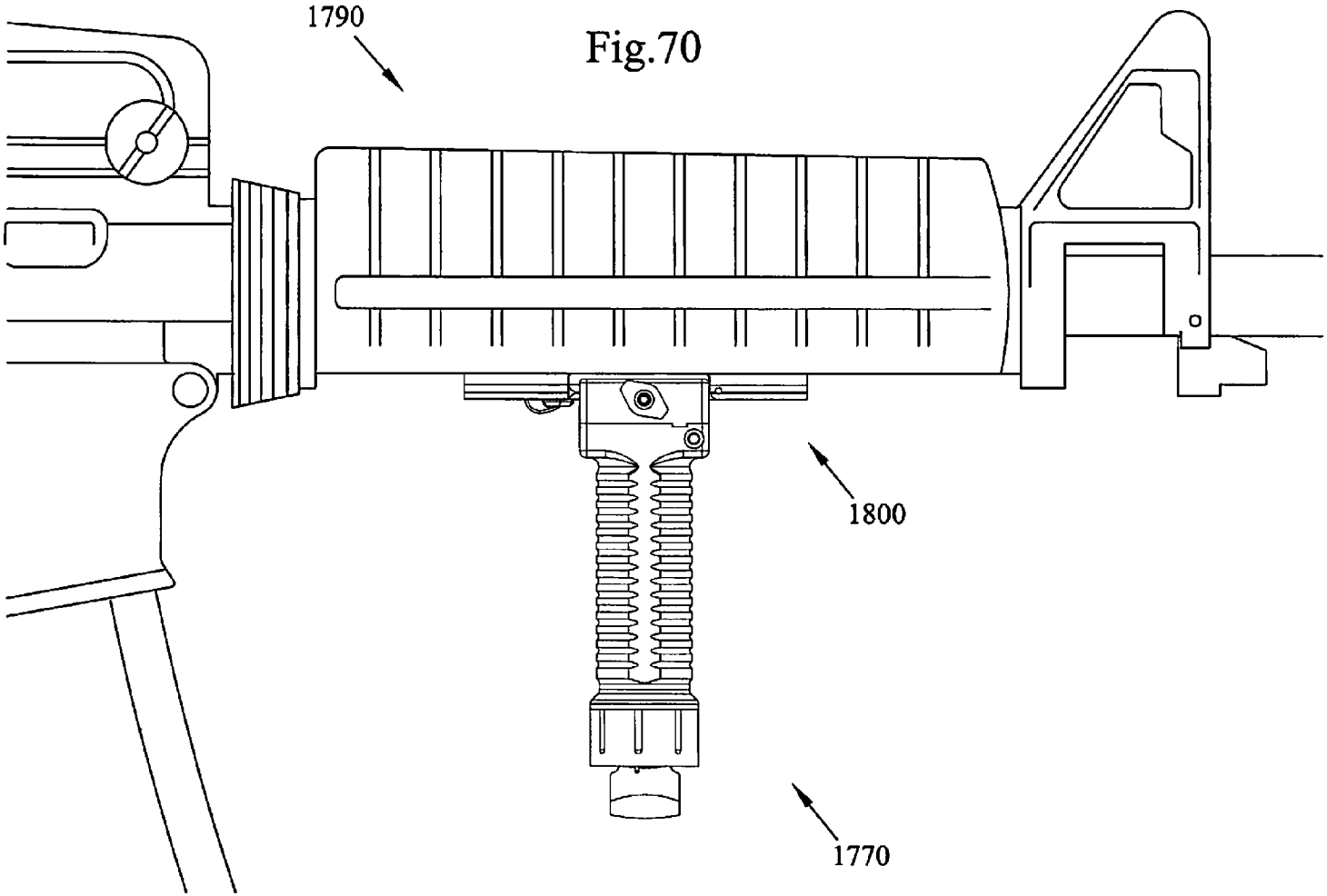
FIG. 70 is another view of FIG. 69 with foreward grip having collapsible bipod legs connected to a locked folding rail assembly on gun.
Figure 71:
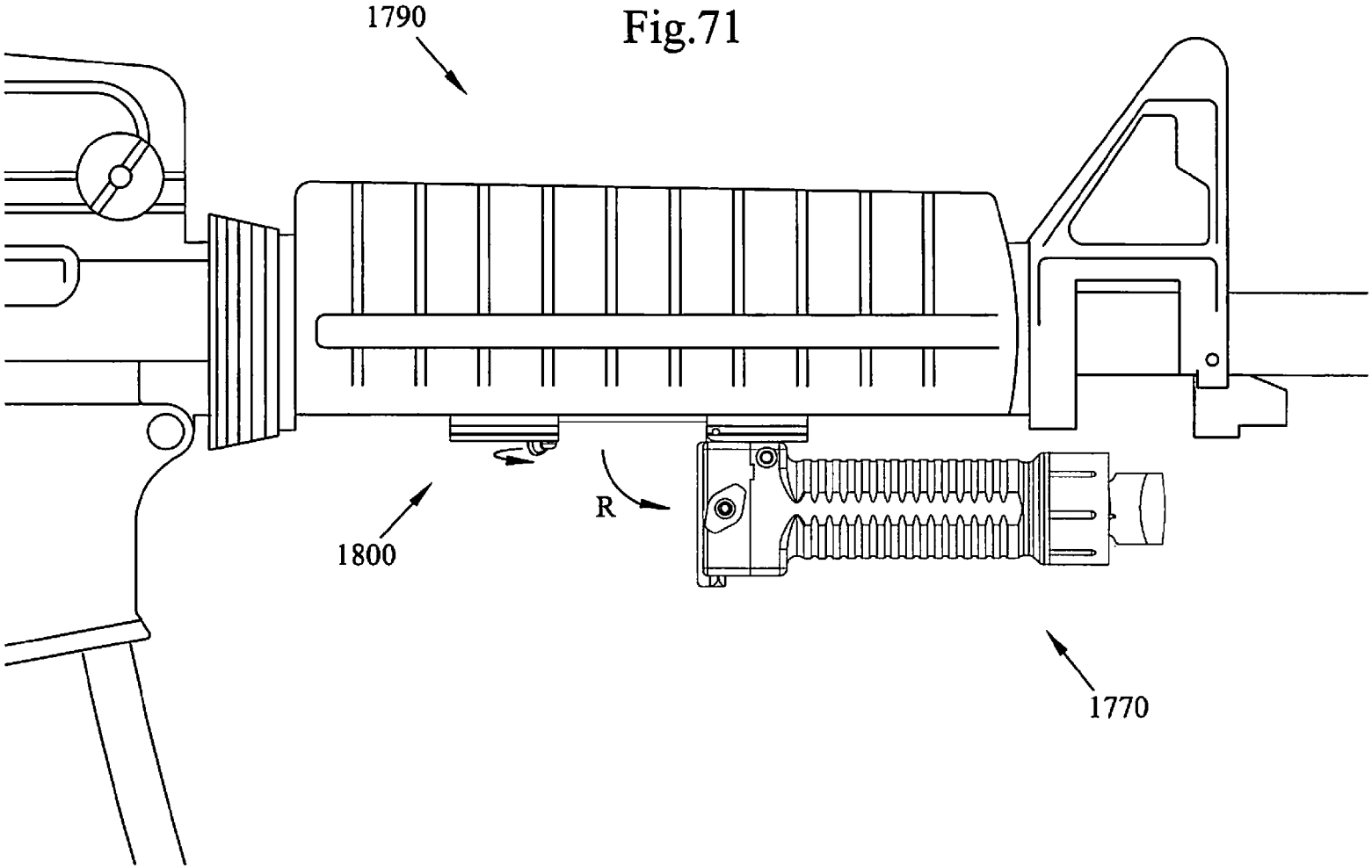
FIG. 71 is another view of FIG. 70 with foreward grip having collapsible bipod legs attached to the folding rail assembly swinging open on unlatched pivot rail.

FIG. 69 shows a folding rail assembly 1800 being used to replace stock picatinny rail that is often supplied with a gun 1790, and detached foreward grip 1770 with collapsible bipod legs. FIG. 70 is another view of FIG. 69 with foreward grip having collapsible bipod legs connected to a locked folding rail assembly on gun 1790. FIG. 71 is another view of FIG. 70 with foreward grip 1770 having collapsible bipod legs attached to the folding rail assembly 1800 swinging open on an unlatched pivot rail.

The folding rail assembly 1800 can be a substitute for the picatinny rails that are often attached underneath of firearm. The folding rail assembly can be used underneath the gun or in other areas, such as but not limited to be attached to one side of the gun or on top of the gun.

The folding rail assembly 1800 has a lower profile than the folding stack embodiments that were previously described. The folding rail assembly 1800 would allow for accessories such as a foregrip to be located closer to the weapon, instead of being spaced away from the weapon. A problem with foregrips is that the lower end of a vertical foregrip can extend further than what is desired. For example the lower bottoms of foregrips have been known to catch on the ground, etc., and/or poke into the user.

The folding rail assembly 1800 is more ergonomic than a folding stack assembly since it does not lengthen the overall length of a foregrip that can be attached thereon.

The folding rail assembly 1800 would be similar in weight to an existing picatinny rail system The folding rail assembly 1800 would have substantially less weight and use less material and be less expensive than the folding stack embodiments.

Similar to the previous embodiments, the folding rail can be modified to lock in both the horizontal and vertical positions, using features similar to that of the previous embodiments.

Although the invention mentions a plate, the invention can include different shapes, such as but not limited to oblong shapes, rectangular shapes, cylindrical shapes, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A method of substituting folding picatinny rails for fixed picatinny rails mounted to firearms, comprising the steps of:

providing a firearm with an existing mounted plate having pair of fixed parallel picatinny rails, the existing mounted plate having a generally planar plate configuration with a set of mounting holes located therethrough for allowing fasteners to mount the existing mounted plate to a rail location on the firearm;

providing another plate having a pair of folding parallel picatinny rails, the another plate having a generally planar plate configuration with another set of mounting holes therethrough that are located at identical locations to the mounting holes in the existing mounted plate;

removing the existing pair of parallel picatinny rails from the firearm; and substituting and mounting the another plate with the pair of folding rails to the rail location on the firearm, by using the another set of the mounting holes with the fasteners.

2. The method of claim 1, further comprising the step of:

hinging the pair of folding parallel picatinny rails to the another plate, so that the pair of folding parallel picatinny rails pivots from a horizontal position with the another plate to a substantially vertical position to the another plate.

3. The method of claim 2, further comprising the steps of:

latching the folding parallel picatinny rails to the horizontal position; and unlatching the folding parallel picatinny rails to be allowed to pivot to the substantially vertical position.

4. The method of claim 3, wherein the latching step includes the step of:

rotating a latch to lock the folding parallel rails to the horizontal position; and rotating the latch to unlock the folding parallel rails to be allowed to pivot to the substantially vertical position.

5. The method of claim 1, further comprising the step of:

providing the another plate with a parallel set of fixed picatinny rails that are not foldable, the another plate of fixed parallel fixed picatinny rails being aligned end to end with the folding parallel picatinny rails.

6. The method of claim 1, further comprising the steps of:

providing the another plate with a first parallel set of fixed picatinny rails that are not foldable, the first parallel fixed picatinny rails being aligned to one end of the folding parallel picatinny rails; and providing the another plate with a second parallel set of fixed picatinny rails that are not foldable, the second parallel fixed picatinny rails being aligned to an opposite end of the folding parallel picatinny rails.

7. The method of claim 6, further comprising the step of:

providing a base member that is fixed to both the first parallel fixed picatinny rails and to the second parallel fixed picatinny rails.

8. The method of claim 1, further comprising the steps of:

providing an upper flat surface on the another plate for mounting against the firearm; and providing the folding rails along edges of a lower surface of the another plate.

9. A folding picatinny rail adapter for being attached to existing mounting holes used for fixed picatinny rails located on firearms, comprising:

a plate having a pair of folding parallel picatinny rails along opposite side edges, the plate having a generally planar plate configuration; and a set of mounting holes through the plate that are located at identical locations to mounting holes on firearms used for attaching fixed picatinny rails to the firearms, wherein the folding picatinny rail adapter are adaptable to be substituted for existing parallel fixed picatinny rails on the firearm; and a rotatable latch that is rotated in one direction for latching the folding parallel picatinny rails to the horizontal position, and is rotated again for unlatching the folding parallel picatinny rails to be allowed to pivot to the substantially vertical position.

10. The folding rail adapter of claim 9, further comprising:

another plate with a parallel set of fixed picatinny rails that are not foldable, the another plate of parallel fixed picatinny rails being aligned end to end with the plate having the folding parallel picatinny rails.

11. The folding rail adapter of claim 9, further comprising:

an first additional plate with a first parallel set of fixed picatinny rails that are not foldable, the first parallel fixed picatinny rails being aligned to one end of the folding parallel picatinny rails; and a second additional plate with a second parallel set of fixed picatinny rails that are not foldable, the second parallel fixed picatinny rails being aligned to an opposite end of the folding parallel picatinny rails.

12. The folding rail adapter of claim 11, further comprising:

a connecting base member that is fixed to both the first additional plate and to the second additional plate.

13. The folding rail adapter of claim 9, further comprising:

an upper flat surface on the plate for mounting against the firearm; and a lower surface on the plate having the folding rails along edges of the lower surface.

14. A folding picatinny rail adapter for being attached to existing mounting holes used for fixed picatinny rails located on firearms, consisting of:

a plate having a generally planar plate configuration, the plate having a base with an upper flat surface for abutting against a surface of a firearm, and the plate having a lower surface;

a parallel pair of picatinny rails on opposite sides of the lower surface of the plate, and the rails having a first end and a second end;

a hinge for pivotally attaching the first end of the picatinny rails to the lower surface of the planar plate;

a set of mounting holes through the plate that are located at identical locations to mounting holes on firearms used for attaching fixed picatinny rails to the firearms; and a latch for latching the folding parallel picatinny rails to a horizontal position along the lower surface of the plate and for unlatching the folding parallel picatinny rails to be allowed to pivot to a substantially vertical position to the plate.

15. The folding rail adapter of claim 9, wherein the plate includes:

a parallel set of fixed picatinny rails that are not foldable, the parallel fixed picatinny rails being aligned end to an end of the folding parallel picatinny rails.

16. The folding rail adapter of claim 9, wherein the plate includes:

a first parallel set of fixed picatinny rails that are not foldable, the first parallel fixed picatinny rails being aligned to the first end of the folding parallel picatinny rails; and a second parallel set of fixed picatinny rails that are not foldable, the second parallel fixed picatinny rails being aligned to the second end of the folding parallel picatinny rails.

17. The folding rail adapter of claim 9, wherein the base includes:

a connecting member that is fixed to both the first parallel set of fixed picatinny rails and to the second parallel set of fixed picatinny rails.

18. A folding picatinny rail adapter for being attached to existing mounting holes used for fixed picatinny rails located on firearms, comprising:

a plate having a pair of folding parallel picatinny rails along opposite side edges, the plate having a generally planar plate configuration; and a set of mounting holes through the plate that are located at identical locations to mounting holes on firearms used for attaching fixed picatinny rails to the firearms, wherein the folding picatinny rail adapter are adaptable to be substituted for existing parallel fixed picatinny rails on the firearm; and another plate with a parallel set of fixed picatinny rails that are not foldable, the another plate of parallel fixed picatinny rails being aligned end to end with the plate having the folding parallel picatinny rails.

19. A folding picatinny rail adapter for being attached to existing mounting holes used for fixed picatinny rails located on firearms, comprising:

a plate having a pair of folding parallel picatinny rails along opposite side edges, the plate having a generally planar plate configuration;

a set of mounting holes through the plate that are located at identical locations to mounting holes on firearms used for attaching fixed picatinny rails to the firearms, wherein the folding picatinny rail adapter are adaptable to be substituted for existing parallel fixed picatinny rails on the firearm; and an first additional plate with a first parallel set of fixed picatinny rails that are not foldable, the first parallel fixed picatinny rails being aligned to one end of the folding parallel picatinny rails; and a second additional plate with a second parallel set of fixed picatinny rails that are not foldable, the second parallel fixed picatinny rails being aligned to an opposite end of the folding parallel picatinny rails.

20. The folding rail adapter of claim 19, further comprising:

a connecting base member that is fixed to both the first additional plate and to the second additional plate.

* * * * *